US010205286B2

(12) United States Patent
Provencher et al.

(10) Patent No.: US 10,205,286 B2
(45) Date of Patent: Feb. 12, 2019

(54) COMPLIANT SHIELD FOR VERY HIGH SPEED, HIGH DENSITY ELECTRICAL INTERCONNECTION

(71) Applicant: Amphenol Corporation, Wallingford, CT (US)

(72) Inventors: Daniel B. Provencher, Nashua, NH (US); Mark W. Gailus, Concord, MA (US); David Manter, Goffstown, NH (US); Vysakh Sivarajan, Nashua, NH (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 15/788,602

(22) Filed: Oct. 19, 2017

(65) Prior Publication Data

US 2018/0109043 A1 Apr. 19, 2018

Related U.S. Application Data

(60) Provisional application No. 62/525,332, filed on Jun. 27, 2017, provisional application No. 62/468,251,
(Continued)

(51) Int. Cl.
*H01R 13/658* (2011.01)
*H01R 13/6587* (2011.01)
(Continued)

(52) U.S. Cl.
CPC ..... *H01R 13/6587* (2013.01); *H01R 12/724* (2013.01); *H01R 12/737* (2013.01);
(Continued)

(58) Field of Classification Search
CPC ..... H01R 13/6587
See application file for complete search history.

(56) References Cited

U.S. PATENT DOCUMENTS 2,996,710 A 8/1961 Pratt
3,002,162 A 9/1961 Garstang
(Continued)

FOREIGN PATENT DOCUMENTS

EP 1 779 472 A1 5/2007
EP 2 169 770 A2 3/2010
(Continued)

OTHER PUBLICATIONS

Extended European Search Report for EP 11166820.8 dated Jan. 24, 2012.
(Continued)

*Primary Examiner* — Ross N Gushi
(74) *Attorney, Agent, or Firm* — Wolf, Greenfield & Sacks, P.C.

(57) ABSTRACT

An interconnection system with a compliant shield between a connector and a substrate such as a PCB. The compliant shield may provide current flow paths between shields internal to the connector and ground structures of the PCB. The connector, compliant shield and PCB may be configured to provide current flow in locations relative to signal conductors that provide desirable signal integrity for signals carried by the signal conductors. In some embodiments, the current flow paths may be adjacent the signal conductors, offset in a transverse direction from an axis of a pair of conductors. Such paths may be created by tabs extending from connector shields. A compliant conductive member of the compliant shield may contact the tabs and a conductive pad on a surface of the PCB. Shadow vias, running from the surface pad to internal ground structures may be positioned adjacent the tip of the tabs.

39 Claims, 29 Drawing Sheets

Related U.S. Application Data filed on Mar. 7, 2017, provisional application No. 62/410,004, filed on Oct. 19, 2016.

(51) Int. Cl.

| | |
|---|---|
| ***H01R 12/72*** | (2011.01) |
| ***H01R 12/73*** | (2011.01) |
| ***H01R 13/02*** | (2006.01) |
| ***H01R 13/518*** | (2006.01) |
| ***H01R 13/6598*** | (2011.01) |
| ***H01R 43/24*** | (2006.01) |
| ***H01R 13/6582*** | (2011.01) |
| *H01R 13/6474* | (2011.01) |

(52) U.S. Cl.

CPC ..... *H01R 13/025* (2013.01); *H01R 13/518* (2013.01); *H01R 13/6582* (2013.01); *H01R 13/6598* (2013.01); *H01R 43/24* (2013.01); *H01R 13/6474* (2013.01)

(56) References Cited

U.S. PATENT DOCUMENTS 3,134,950 A 5/1964 Cook
3,322,885 A 5/1967 May et al.
3,786,372 A 1/1974 Epis et al.
3,825,874 A 7/1974 Peverill
3,863,181 A 1/1975 Glance et al.
4,155,613 A 5/1979 Brandeau
4,195,272 A 3/1980 Boutros
4,276,523 A 6/1981 Boutros et al.
4,371,742 A 2/1983 Manly
4,408,255 A 10/1983 Adkins
4,447,105 A 5/1984 Ruehl
4,471,015 A 9/1984 Ebneth et al.
4,484,159 A 11/1984 Whitley
4,490,283 A 12/1984 Kleiner
4,518,651 A 5/1985 Wolfe, Jr.
4,519,664 A 5/1985 Tillotson
4,519,665 A 5/1985 Althouse et al.
4,636,752 A 1/1987 Saito
4,682,129 A 7/1987 Bakermans et al.
4,751,479 A 6/1988 Parr
4,761,147 A 8/1988 Gauthier
4,846,724 A 7/1989 Sasaki et al.
4,878,155 A 10/1989 Conley
4,948,922 A 8/1990 Varadan et al.
4,970,354 A 11/1990 Iwasa et al.
4,992,060 A 2/1991 Meyer
5,000,700 A 3/1991 Masubuchi et al.
5,141,454 A 8/1992 Garrett et al.
5,150,086 A 9/1992 Ito
5,168,252 A 12/1992 Naito
5,168,432 A 12/1992 Murphy et al.
5,266,055 A 11/1993 Naito et al.
5,280,257 A 1/1994 Cravens et al.
5,287,076 A 2/1994 Johnescu et al.
5,340,334 A 8/1994 Nguyen
5,346,410 A 9/1994 Moore, Jr.
5,456,619 A 10/1995 Belopolsky et al.
5,461,392 A 10/1995 Mott et al.
5,499,935 A 3/1996 Powell
5,551,893 A 9/1996 Johnson
5,562,497 A 10/1996 Yagi et al.
5,597,328 A 1/1997 Mouissie
5,651,702 A 7/1997 Hanning et al.
5,669,789 A 9/1997 Law
5,796,323 A 8/1998 Uchikoba et al.
5,831,491 A 11/1998 Buer et al.
5,924,899 A 7/1999 Paagman
5,981,869 A 11/1999 Kroger
5,982,253 A 11/1999 Perrin et al.
6,019,616 A 2/2000 Yagi et al.
6,152,747 A 11/2000 McNamara
6,168,469 B1 1/2001 Lu
6,174,203 B1 1/2001 Asao
6,174,944 B1 1/2001 Chiba et al.
6,217,372 B1 4/2001 Reed
6,299,483 B1 10/2001 Cohen et al.
6,347,962 B1 2/2002 Kline
6,350,134 B1 2/2002 Fogg et al.
6,364,711 B1 4/2002 Berg et al.
6,375,510 B2 4/2002 Asao
6,379,188 B1 4/2002 Cohen et al.
6,398,588 B1 6/2002 Bickford
6,409,543 B1 6/2002 Astbury, Jr. et al.
6,482,017 B1 11/2002 Van Doorn
6,503,103 B1 1/2003 Cohen et al.
6,506,076 B2 1/2003 Cohen et al.
6,517,360 B1 2/2003 Cohen
6,530,790 B1 3/2003 McNamara et al.
6,537,087 B2 3/2003 McNamara et al.
6,554,647 B1 4/2003 Cohen et al.
6,565,387 B2 5/2003 Cohen
6,579,116 B2 6/2003 Brennan et al.
6,595,802 B1 7/2003 Watanabe et al.
6,602,095 B2 8/2003 Astbury, Jr. et al.
6,616,864 B1 9/2003 Jiang et al.
6,652,318 B1 11/2003 Winings et al.
6,655,966 B2 12/2003 Rothermel et al.
6,709,294 B1 3/2004 Cohen et al.
6,713,672 B1 3/2004 Stickney
6,743,057 B2 6/2004 Davis et al.
6,776,659 B1 8/2004 Stokoe et al.
6,786,771 B2 9/2004 Gailus
6,814,619 B1 11/2004 Stokoe et al.
6,872,085 B1 3/2005 Cohen et al.
6,979,226 B2 12/2005 Otsu et al.
7,044,794 B2 5/2006 Consoli et al.
7,057,570 B2 6/2006 Irion, II et al.
7,074,086 B2 7/2006 Cohen et al.
7,094,102 B2 8/2006 Cohen et al.
7,108,556 B2 9/2006 Cohen et al.
7,163,421 B1 1/2007 Cohen et al.
7,285,018 B2 10/2007 Kenny et al.
7,335,063 B2 2/2008 Cohen et al.
7,371,117 B2 5/2008 Gailus
7,494,383 B2 2/2009 Cohen et al.
7,540,781 B2 6/2009 Kenny et al.
7,581,990 B2 9/2009 Kirk et al.
7,588,464 B2 9/2009 Kim
7,722,401 B2 5/2010 Kirk et al.
7,731,537 B2 6/2010 Amleshi et al.
7,753,731 B2 7/2010 Cohen et al.
7,771,233 B2 8/2010 Gailus
7,794,240 B2 9/2010 Cohen et al.
7,874,873 B2 1/2011 Do et al.
7,887,371 B2 2/2011 Kenny et al.
7,906,730 B2 3/2011 Atkinson et al.
7,914,304 B2 3/2011 Cartier et al.
8,002,581 B1 * 8/2011 Whiteman, Jr. ..... H01R 12/724 439/607.18
8,083,553 B2 12/2011 Manter et al.
8,182,289 B2 5/2012 Stokoe et al.
8,215,968 B2 7/2012 Cartier et al.
8,272,877 B2 9/2012 Stokoe et al.
8,308,512 B2 * 11/2012 Ritter ..... H01R 12/724 439/607.18
8,371,875 B2 2/2013 Gailus
8,382,524 B2 2/2013 Khilchenko et al.
8,535,065 B2 9/2013 Costello et al.
8,550,861 B2 10/2013 Cohen et al.
8,657,627 B2 2/2014 McNamara et al.
8,690,604 B2 * 4/2014 Davis ..... H01R 23/688 439/607.07
8,715,003 B2 5/2014 Buck et al.
8,771,016 B2 7/2014 Atkinson et al.
8,864,521 B2 10/2014 Atkinson et al.
8,888,531 B2 * 11/2014 Jeon ..... H01R 13/65807 439/607.07
8,926,377 B2 1/2015 Kirk et al.
8,944,831 B2 2/2015 Stoner et al.
8,998,642 B2 4/2015 Manter et al.

(56) References Cited

U.S. PATENT DOCUMENTS

| | | | | |
|---|---|---|---|---|
| 9,004,942 | B2 | 4/2015 | Paniauqa | |
| 9,022,806 | B2 | 5/2015 | Girard, Jr. et al. | |
| 9,028,201 | B2 | 5/2015 | Kirk et al. | |
| 9,124,009 | B2 | 9/2015 | Atkinson et al. | |
| 9,219,335 | B2 | 12/2015 | Atkinson et al. | |
| 9,225,085 | B2 | 12/2015 | Girard, Jr. et al. | |
| 9,356,401 | B1 * | 5/2016 | Horning | H01R 13/6585 |
| 9,373,917 | B2 * | 6/2016 | Sypolt | H01R 13/6585 |
| 9,450,344 | B2 | 9/2016 | Cartier, Jr. et al. | |
| 9,509,101 | B2 | 11/2016 | Cartier, Jr. et al. | |
| 9,520,689 | B2 | 12/2016 | Cartier, Jr. et al. | |
| 9,531,133 | B1 * | 12/2016 | Horning | H01R 13/6477 |
| 9,666,961 | B2 * | 5/2017 | Horning | H01R 12/7076 |
| 9,685,736 | B2 | 6/2017 | Gailus et al. | |
| 9,774,144 | B2 | 9/2017 | Cartier, Jr. et al. | |
| 9,929,512 | B1 * | 3/2018 | Trout | H01R 13/6588 |
| 2001/0012730 | A1 | 8/2001 | Ramey et al. | |
| 2001/0042632 | A1 | 11/2001 | Manov et al. | |
| 2002/0042223 | A1 | 4/2002 | Belopolsky et al. | |
| 2002/0088628 | A1 * | 7/2002 | Chen | H05K 9/0018 174/359 |
| 2002/0089464 | A1 | 7/2002 | Joshi | |
| 2002/0098738 | A1 | 7/2002 | Astbury et al. | |
| 2002/0111068 | A1 | 8/2002 | Cohen et al. | |
| 2002/0111069 | A1 | 8/2002 | Astbury et al. | |
| 2004/0018757 | A1 | 1/2004 | Lang et al. | |
| 2004/0020674 | A1 | 2/2004 | McFadden et al. | |
| 2004/0115968 | A1 | 6/2004 | Cohen | |
| 2004/0121652 | A1 | 6/2004 | Gailus | |
| 2004/0196112 | A1 | 10/2004 | Welbon et al. | |
| 2004/0259419 | A1 | 12/2004 | Payne et al. | |
| 2005/0032430 | A1 | 2/2005 | Otsu et al. | |
| 2005/0070160 | A1 | 3/2005 | Cohen et al. | |
| 2005/0133245 | A1 | 6/2005 | Katsuyama et al. | |
| 2005/0176835 | A1 | 8/2005 | Kobayashi et al. | |
| 2005/0283974 | A1 | 12/2005 | Richard et al. | |
| 2005/0287869 | A1 | 12/2005 | Kenny et al. | |
| 2006/0068640 | A1 | 3/2006 | Gailus | |
| 2007/0004282 | A1 | 1/2007 | Cohen et al. | |
| 2007/0021001 | A1 | 1/2007 | Laurx et al. | |
| 2007/0037419 | A1 | 2/2007 | Sparrowhawk | |
| 2007/0042639 | A1 | 2/2007 | Manter et al. | |
| 2007/0054554 | A1 | 3/2007 | Do et al. | |
| 2007/0059961 | A1 | 3/2007 | Cartier et al. | |
| 2007/0197095 | A1 | 8/2007 | Feldman et al. | |
| 2007/0218765 | A1 | 9/2007 | Cohen et al. | |
| 2008/0026638 | A1 | 1/2008 | Cohen et al. | |
| 2008/0194146 | A1 | 8/2008 | Gailus | |
| 2008/0246555 | A1 | 10/2008 | Kirk et al. | |
| 2008/0248658 | A1 | 10/2008 | Cohen et al. | |
| 2008/0248659 | A1 | 10/2008 | Cohen et al. | |
| 2008/0248660 | A1 | 10/2008 | Kirk et al. | |
| 2009/0011641 | A1 | 1/2009 | Cohen et al. | |
| 2009/0011645 | A1 | 1/2009 | Laurx et al. | |
| 2009/0117386 | A1 | 5/2009 | Vacanti et al. | |
| 2009/0227141 | A1 | 9/2009 | Pan | |
| 2009/0239395 | A1 | 9/2009 | Cohen et al. | |
| 2009/0247012 | A1 | 10/2009 | Pan | |
| 2009/0291593 | A1 | 11/2009 | Atkinson et al. | |
| 2010/0081302 | A1 | 4/2010 | Atkinson et al. | |
| 2010/0099299 | A1 | 4/2010 | Moriyama et al. | |
| 2010/0144201 | A1 | 6/2010 | Defibaugh et al. | |
| 2010/0144203 | A1 | 6/2010 | Glover et al. | |
| 2010/0294530 | A1 | 11/2010 | Atkinson et al. | |
| 2011/0003509 | A1 | 1/2011 | Gailus | |
| 2011/0104948 | A1 | 5/2011 | Girard, Jr. et al. | |
| 2011/0212649 | A1 | 9/2011 | Stokoe et al. | |
| 2011/0212650 | A1 | 9/2011 | Amleshi et al. | |
| 2011/0230095 | A1 | 9/2011 | Atkinson et al. | |
| 2011/0230096 | A1 | 9/2011 | Atkinson et al. | |
| 2011/0287663 | A1 | 11/2011 | Gailus et al. | |
| 2012/0077380 | A1 | 3/2012 | Minich et al. | |
| 2012/0094536 | A1 | 4/2012 | Khilchenko et al. | |
| 2012/0156929 | A1 | 6/2012 | Manter et al. | |
| 2012/0202363 | A1 | 8/2012 | McNamara et al. | |
| 2012/0202386 | A1 | 8/2012 | McNamara et al. | |
| 2012/0214344 | A1 | 8/2012 | Cohen et al. | |
| 2013/0012038 | A1 | 1/2013 | Kirk et al. | |
| 2013/0017733 | A1 | 1/2013 | Kirk et al. | |
| 2013/0078870 | A1 | 3/2013 | Milbrand, Jr. | |
| 2013/0109232 | A1 | 5/2013 | Paniaqua | |
| 2013/0196553 | A1 | 8/2013 | Gailus | |
| 2013/0225006 | A1 | 8/2013 | Khilchenko et al. | |
| 2013/0273781 | A1 | 10/2013 | Buck et al. | |
| 2014/0004724 | A1 | 1/2014 | Cartier, Jr. et al. | |
| 2014/0004726 | A1 | 1/2014 | Cartier, Jr. et al. | |
| 2014/0004746 | A1 | 1/2014 | Cartier, Jr. et al. | |
| 2014/0057498 | A1 | 2/2014 | Cohen | |
| 2014/0273557 | A1 | 9/2014 | Cartier, Jr. et al. | |
| 2014/0273627 | A1 | 9/2014 | Cartier, Jr. et al. | |
| 2015/0056856 | A1 | 2/2015 | Atkinson et al. | |
| 2015/0236450 | A1 | 8/2015 | Davis | |
| 2015/0236451 | A1 | 8/2015 | Cartier, Jr. et al. | |
| 2015/0236452 | A1 | 8/2015 | Cartier, Jr. et al. | |
| 2015/0255926 | A1 | 9/2015 | Paniagua | |
| 2016/0013594 | A1 | 1/2016 | Costello et al. | |
| 2016/0141807 | A1 | 5/2016 | Gailus et al. | |
| 2017/0042070 | A1 * | 2/2017 | Baumler | H05K 9/00 |
| 2017/0047692 | A1 | 2/2017 | Cartier, Jr. et al. | |
| 2017/0294743 | A1 | 10/2017 | Gailus et al. | |
| 2018/0219331 | A1 | 8/2018 | Cartier, Jr. et al. | |

FOREIGN PATENT DOCUMENTS

| | | | |
|---|---|---|---|
| GB | 1272347 | A | 4/1972 |
| JP | 07302649 | A | 11/1995 |
| JP | 2011-018651 | A | 1/2011 |
| JP | 2012-516021 | A | 7/2012 |
| JP | 2016-528688 | A | 9/2016 |
| WO | WO 88/05218 | A1 | 7/1988 |
| WO | WO 2004/059794 | A2 | 7/2004 |
| WO | WO 2004/059801 | A1 | 7/2004 |
| WO | WO 2006/039277 | A1 | 4/2006 |
| WO | WO 2007/005597 | A2 | 1/2007 |
| WO | WO 2007/005599 | A1 | 1/2007 |
| WO | WO 2008/124057 | A1 | 10/2008 |
| WO | WO 2010/039188 | A1 | 4/2010 |

OTHER PUBLICATIONS

International Search Report with Written Opinion for International Application No. PCT/US06/25562 dated Oct. 31, 2007.

International Search Report and Written Opinion from PCT Application No. PCT/US2005/034605 dated Jan. 26, 2006.

International Search Report and Written Opinion for International Application No. PCT/US2010/056482 dated Mar. 14, 2011.

International Preliminary Report on Patentability for International Application No. PCT/US2010/056482 dated May 24, 2012.

International Search Report and Written Opinion for PCT/US2011/026139 dated Nov. 22, 2011.

International Preliminary Report on Patentability for PCT/US2011/026139 dated Sep. 7, 2012.

International Search Report and Written Opinion for International Application No. PCT/US2011/034747 dated Jul. 28, 2011.

PCT Search Report and Written Opinion for Application No. PCT/US2012/023689 dated Sep. 12, 2012.

International Preliminary Report on Patentability for Application No. PCT/US2012/023689 dated Aug. 15, 2013.

International Search Report and Written Opinion for PCT/US2012/060610 dated Mar. 29, 2013.

International Search Report and Written Opinion for International Application No. PCT/US2014/026381 dated Aug. 12, 2014.

International Search Report and Written Opinion dated May 13, 2015 for Application No. PCT/US2015/012463.

International Search Report and Written Opinion for International Application No. PCT/US2017/057402 dated Jan. 19, 2018.

[No Author Listed] "Carbon Nanotubes for Electromagnetic Interference Shielding," SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.

(56) References Cited

OTHER PUBLICATIONS

Beaman, High Performance Mainframe Computer Cables, Electronic Components and Technology Conference, 1997, pp. 911-917.
Shi et al, "Improving Signal Integrity in Circuit Boards by Incorporating Absorbing Materials," 2001 Proceedings. 51st Electronic Components and Technology Conference, Orlando FL. 2001:1451-56.
U.S. Appl. No. 15/713,887, filed Sep. 25, 2017, Cartier et al.
U.S. Appl. No. 15/627,063, filed Jun. 19, 2017, Gailus et al.

* cited by examiner

COMPLIANT SHIELD FOR VERY HIGH SPEED, HIGH DENSITY ELECTRICAL INTERCONNECTION

CROSS REFERENCE TO RELATED APPLICATIONS

This patent application claims priority to and the benefit of U.S. Provisional Patent Application Ser. No. 62/410,004, filed on Oct. 19, 2016 and entitled "Compliant Shield for Very High Speed, High Density Electrical Interconnection," which is hereby incorporated herein by reference in its entirety. This patent application also claims priority to and the benefit of U.S. Provisional Patent Application Ser. No. 62/468,251, filed on Mar. 7, 2017 and entitled "Compliant Shield for Very High Speed, High Density Electrical Interconnection," which is hereby incorporated herein by reference in its entirety. This patent application also claims priority to and the benefit of U.S. Provisional Patent Application Ser. No. 62/525,332, filed on Jun. 27, 2017 and entitled "Compliant Shield for Very High Speed, High Density Electrical Interconnection," which is hereby incorporated herein by reference in its entirety.

BACKGROUND

This patent application relates generally to interconnection systems, such as those including electrical connectors, used to interconnect electronic assemblies.

Electrical connectors are used in many electronic systems. It is generally easier and more cost effective to manufacture a system as separate electronic assemblies, such as printed circuit boards ("PCBs"), which may be joined together with electrical connectors. A known arrangement for joining several printed circuit boards is to have one printed circuit board serve as a backplane. Other printed circuit boards, called "daughterboards" or "daughtercards," may be connected through the backplane.

A known backplane is a printed circuit board onto which many connectors may be mounted. Conducting traces in the backplane may be electrically connected to signal conductors in the connectors so that signals may be routed between the connectors. Daughtercards may also have connectors mounted thereon. The connectors mounted on a daughtercard may be plugged into the connectors mounted on the backplane. In this way, signals may be routed among the daughtercards through the backplane. The daughtercards may plug into the backplane at a right angle. The connectors used for these applications may therefore include a right angle bend and are often called "right angle connectors."

Connectors may also be used in other configurations for interconnecting printed circuit boards and for interconnecting other types of devices, such as cables, to printed circuit boards. Sometimes, one or more smaller printed circuit boards may be connected to another larger printed circuit board. In such a configuration, the larger printed circuit board may be called a "mother board" and the printed circuit boards connected to it may be called daughterboards. Also, boards of the same size or similar sizes may sometimes be aligned in parallel. Connectors used in these applications are often called "stacking connectors" or "mezzanine connectors."

Regardless of the exact application, electrical connector designs have been adapted to mirror trends in the electronics industry. Electronic systems generally have gotten smaller, faster, and functionally more complex. Because of these changes, the number of circuits in a given area of an electronic system, along with the frequencies at which the circuits operate, have increased significantly in recent years. Current systems pass more data between printed circuit boards and require electrical connectors that are electrically capable of handling more data at higher speeds than connectors of even a few years ago.

In a high density, high speed connector, electrical conductors may be so close to each other that there may be electrical interference between adjacent signal conductors. To reduce interference, and to otherwise provide desirable electrical properties, shield members are often placed between or around adjacent signal conductors. The shields may prevent signals carried on one conductor from creating "crosstalk" on another conductor. The shield may also impact the impedance of each conductor, which may further contribute to desirable electrical properties.

Examples of shielding can be found in U.S. Pat. Nos. 4,632,476 and 4,806,107, which show connector designs in which shields are used between columns of signal contacts. These patents describe connectors in which the shields run parallel to the signal contacts through both the daughterboard connector and the backplane connector. Cantilevered beams are used to make electrical contact between the shield and the backplane connectors. U.S. Pat. Nos. 5,433,617, 5,429,521, 5,429,520, and 5,433,618 show a similar arrangement, although the electrical connection between the backplane and shield is made with a spring type contact. Shields with torsional beam contacts are used in the connectors described in U.S. Pat. No. 6,299,438. Further shields are shown in U.S. Pre-grant Publication 2013-0109232.

Other connectors have shield plates within only the daughterboard connector. Examples of such connector designs can be found in U.S. Pat. Nos. 4,846,727, 4,975,084, 5,496,183, and 5,066,236. Another connector with shields only within the daughterboard connector is shown in U.S. Pat. No. 5,484,310, U.S. Pat. No. 7,985,097 is a further example of a shielded connector.

Other techniques may be used to control the performance of a connector. For instance, transmitting signals differentially may also reduce crosstalk. Differential signals are carried on a pair of conducting paths, called a "differential pair." The voltage difference between the conductive paths represents the signal. In general, a differential pair is designed with preferential coupling between the conducting paths of the pair. For example, the two conducting paths of a differential pair may be arranged to run closer to each other than to adjacent signal paths in the connector. No shielding is desired between the conducting paths of the pair, but shielding may be used between differential pairs. Electrical connectors can be designed for differential signals as well as for single-ended signals. Examples of differential electrical connectors are shown in U.S. Pat. Nos. 6,293,827, 6,503,103, 6,776,659, 7,163,421, and 7,794,278.

In an interconnection system, such connectors are attached to printed circuit boards. Typically a printed circuit board is formed as a multi-layer assembly manufactured from stacks of dielectric sheets, sometimes called "prepreg". Some or all of the dielectric sheets may have a conductive film on one or both surfaces. Some of the conductive films may be patterned, using lithographic or laser printing techniques, to form conductive traces that are used to make interconnections between circuit boards, circuits and/or circuit elements. Others of the conductive films may be left substantially intact and may act as ground planes or power planes that supply the reference potentials. The dielectric sheets may be formed into an integral board structure such as by pressing the stacked dielectric sheets together under pressure.

To make electrical connections to the conductive traces or ground/power planes, holes may be drilled through the printed circuit board. These holes, or "vias", are filled or plated with metal such that a via is electrically connected to one or more of the conductive traces or planes through which it passes.

To attach connectors to the printed circuit board, contact "tails" from the connectors may be inserted into the vias or attached to conductive pads on a surface of the printed circuit board that are connected to a via.

SUMMARY

Embodiments of a high speed, high density interconnection system are described. Very high speed performance may be achieved in accordance with some embodiments by a compliant shield that provides shielding around contact tails extending from a connector housing. A compliant shield alternatively or additionally may provide current flow in desired locations between shielding members within the connector and ground structures within the printed circuit board.

Accordingly, some embodiments relate to a compliant shield for an electrical connector, the electrical connector comprising a plurality of contact tails for attachment to a printed circuit board. The compliant shield may comprise a conductive body portion comprising a plurality of openings sized and positioned for the contact tails from the electrical connector to pass therethrough. The conductive body provides current flow paths between shields internal to the electrical connector and ground structures of the printed circuit board.

In some embodiments, an electrical connector may have a board mounting face comprising a plurality of contact tails extending therefrom, a plurality of internal shields, and a compliant shield. The compliant shield may comprise a conductive body portion comprising a plurality of openings sized and positioned for the plurality of contact tails to pass therethrough. The conductive body may be in electrical connection with the plurality of internal shields In some embodiments, an electronic device may be provided. The electronic device may comprise a printed circuit board comprising a surface and a connector mounted to the printed circuit board. The connector may comprise a face parallel with the surface, a plurality of conductive elements extending through the face, a plurality of internal shields, and a compliant shield providing current flow paths between the plurality of internal shields and ground structures of the printed circuit board.

The foregoing is a non-limiting summary of the invention, which is defined by the attached claims.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DESCRIPTION OF PREFERRED EMBODIMENTS

Figure 1:
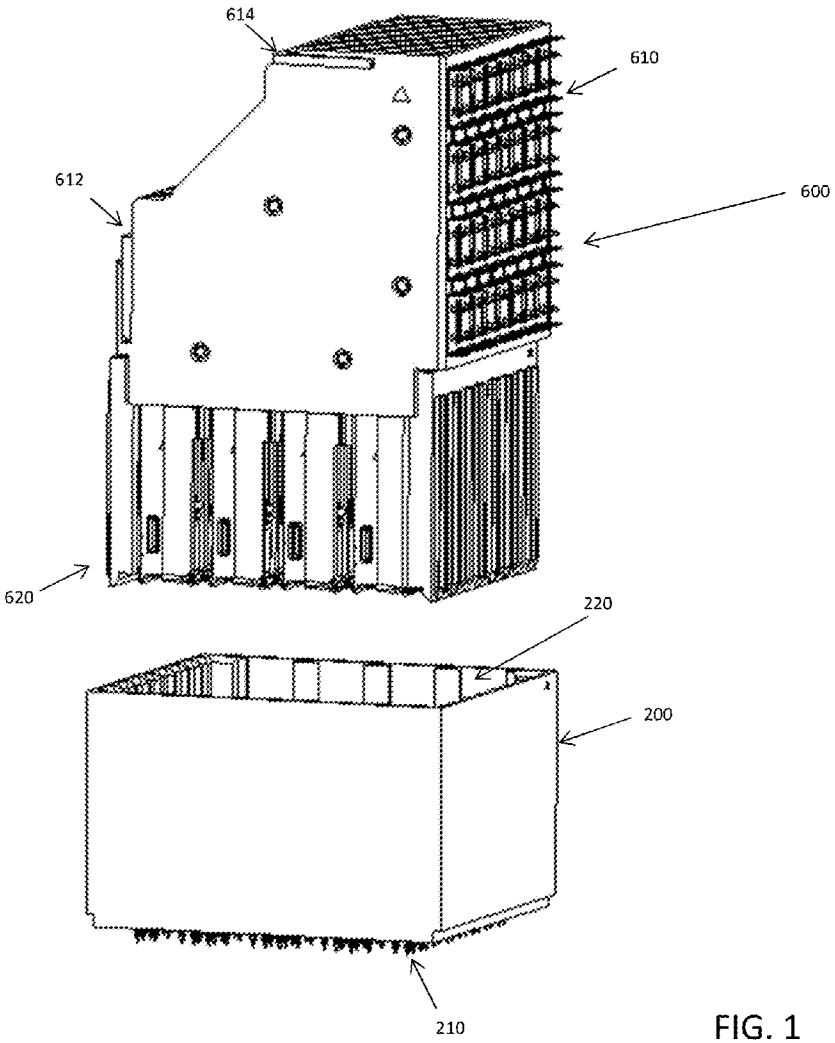
FIG. 1 is an isometric view of an illustrative electrical interconnection system, in accordance with some embodiments.

The inventors have recognized and appreciated that performance of a high density interconnection system may be increased, particularly those that carry very high frequency signals that are necessary to support high data rates, with connector designs that provide for shielding in a region between an electrical connector and a substrate to which the connector is mounted. The shielding may separate contact tails of conductive elements inside the connector. The contact tails may extend from the connector and make electrical connection with a substrate, such as a printed circuit board.

Further, the compliant shield, in conjunction with the connector and printed circuit board to which the connector is mounted, may be configured to provide current paths between the shields within the connector and ground structures in the printed circuit board. These paths may run parallel to current flow paths in signal conductors passing from the connector to the printed circuit board. The inventors have found that such a configuration, though over a small distance, such as 2 mm or less, provides a desirable increase in signal integrity, particularly for high frequency signals.

Such current paths may be provided by conductive elements extending from the connector, which may be tabs. The tabs may be electrically connected to surface pads on the printed circuit board through the compliant shield. The surface pads, in turn, may be connected to inner ground layers of the printed circuit boards through vias receiving contact tails from the connector plus shadow vias. The shadow vias may be positioned adjacent ends of the tabs extending from the connector. Those tabs may be adjacent to contact tails of signal conductors also extending from the connector. Accordingly, a suitably positioned current flow path may exist through shields inside the connector, into the tabs, through the compliant shields, into the pads on the surface of the printed circuit board and to the inner ground layers of the printed circuit board through shadow vias.

Electrical connection through the shield may be facilitated by compliance of the shield such that the shield may be compressed when the connector is mounted to the printed circuit board. Compliance may enable the shield to occupy the space between the connector and the printed circuit board, regardless of variations in separation that may occur as a result of manufacturing tolerances.

Further, the shield may be made of a material that provides force in orthogonal directions when compressed, such as be responding to a force on the shield in a first direction by expanding and exerting force on any adjacent structures in a second direction, which may be orthogonal to the first direction. Suitable compliant, conductive materials to make at least a portion of the shield include elastomers filled with conductive particles.

Exerting force in at least two orthogonal directions when the shield is compressed enables the shield to press against, and therefore make electrical connection to, conducting pads on a surface of the printed circuit board and to conducting elements extending from the connector. Those extending structures may have a surface that is orthogonal to the surface of the printed circuit board. By contacting the extending conducting element on a surface provides a wide area over which contact is made, improving performance of the connector relative to contacting the shield along an edge of the extending conducting element.

To provide mechanical support for the compliant conductive material, as well as other structures, the compliant shield may include an insulative member. The insulative member may have a first portion, which may be generally planar and shaped, on one surface, the fit against a mounting face of the connector. The opposing surface of the insulative member may have a plurality of raised portions, forming islands extending from the first portion. Those islands may have walls, and the compliant conductive material may occupy the space between the walls. The extending conducting elements may be disposed adjacent to the walls such that, when the compliant conductive material is compressed, it expands outwards towards the walls, pressing against the extending conducting elements. The extending conductive elements may be backed and mechanically supported by the walls.

The islands may provide insulative regions of the shield through which signal conductors may pass without being connected to ground through contact with the compliant conductive material. In some embodiments, the islands may be formed of a material that has a dielectric constant that establishes a desired impedance for the signal conductors in the mounting interface of the connector. In some embodiments, the relative dielectric constant may be 3.0 or above. In some embodiments, the relative dielectric constant may be higher, such as 3.4 or above. In some embodiments, the relative dielectric constant of at least the islands may be 3.5 or above, 3.6 or above, 3.7 or above, 3.8 or above, 3.9 or above, or 4.0 or above. Such relative dielectric constants may be achieved by selection of a binder material in combination with a filler. Known materials may be selected to provide a relative dielectric constant of up to 4.5, for example. In some embodiments, the relative dielectric constant may be up to 4.4, up to 4.3, up to 4.2, up to 4.1 or up to 4.0. Relative dielectric constants in these ranges may lead to a higher dielectric constant for the islands than for the insulative housing of the connector. The islands may have a relative dielectric constant that is, in some embodiments, at least 0.1, 0.2, 0.3, 0.4, 0.5 or 0.6 higher than the connector housing. In some embodiments the difference in relative dielectric constant will be in the range of 0.1 to 0.3, or 0.2 to 0.5, or 0.3 to 1.0.

In other embodiments, current paths between the shields within the connector and ground structures in the printed circuit board may be created by contact tails extending from the internal connector shields engaging a compliant shield that engages conductive pads on the printed circuit board. The compliant shield may include a conductive body portion and a plurality of compliant fingers attached to and extending from the conductive body portion. Such a compliant shield may be formed from a sheet of conductive material.

In accordance with some embodiments, the compliant shield may include a conductive body portion and a plurality of compliant members. The compliant members may attached to and extend from the conductive body portion. The compliant members may be in the form of compliant fingers or any other suitable shapes. The conductive body portion may be electrically connected to surface pads on the printed circuit board. The surface pads, in turn, may be connected to inner ground layers of the printed circuit boards through vias receiving contact tails from the connector plus shadow vias.

The compliant shield may be made of a material with desired conductivity for the current paths. The material may also be suitably springy such that fingers cut out of the material generate a sufficient force to make a reliable electrical connection to the surface pads of the printed circuit board and/or to conductive structures extending from the connector. Suitable compliant, conductive materials to make at least a portion of the compliant shield include metals, metal alloys, superelastic and shape memory materials. Superelastic materials and shape memory materials are described in co-pending U.S. Pre-grant Publication 2016-0308296, which is hereby incorporated by reference in its entirety.

Electrical connection through the compliant shield may be facilitated by compliance of the shield such that the shield may be compressed when the connector is mounted to the printed circuit board. Compliance may enable the shield to generate force against the printed circuit board, regardless of variations in separation that may occur as a result of manufacturing tolerances. In embodiments in which compliance is generated by deflection of fingers cut from a sheet of metal, the fingers may be, in an uncompressed state, bent out of the plane of the sheet by an amount equal to the tolerance in positioning a mounting face of the connector against an upper surface of the printed circuit board.

The compliance of the shield may be provided by the resilient fingers, which can deform to accommodate manufacturing variations in separation between the board and the connector. The fingers may extend from a sheet of metal positioned between the connector and the printed circuit board. However, in some embodiments, the fingers may extend from internal shields or ground structures of the connector, passing through and making electrical contact with a metal component between the mounting face of the connector housing and an upper surface of the printed circuit board.

In some embodiments, the shadow vias may be positioned adjacent the distal ends of the fingers extending from the compliant shield. Those fingers may be adjacent to contact tails of signal conductors extending from the connector. In some embodiments, a proximal end of the fingers may be attached to a body of the shield. The shield may be configured to engage ground contact tails, tabs or other conductive structures extending from shields within the connector. Accordingly, a suitably positioned current flow path may exist through shields inside the connector, through the compliant shields, into the pads on the surface of the printed circuit board and to the inner ground layers of the printed circuit board through shadow vias.

FIG. 1 illustrates an electrical interconnection system of the form that may be used in an electronic system. In this example, the electrical interconnection system includes a right angle connector and may be used, for example, in electrically connecting a daughtercard to a backplane. These figures illustrate two mating connectors. In this example, connector 200 is designed to be attached to a backplane and connector 600 is designed to attach to a daughtercard. As can be seen in FIG. 1, daughtercard connector 600 includes contact tails 610 designed to attach to a daughtercard (not shown). Backplane connector 200 includes contact tails 210, designed to attach to a backplane (not shown). These contact tails form one end of conductive elements that pass through the interconnection system. When the connectors are mounted to printed circuit boards, these contact tails will make electrical connection to conductive structures within the printed circuit board that carry signals or are connected to a reference potential. In the example illustrated the contact tails are press fit, "eye of the needle," contacts that are designed to be pressed into vias in a printed circuit board. However, other forms of contact tails may be used.

Each of the connectors also has a mating interface where that connector can mate—or be separated from—the other connector. Daughtercard connector 600 includes a mating interface 620. Backplane connector 200 includes a mating interface 220. Though not fully visible in the view shown in FIG. 1, mating contact portions of the conductive elements are exposed at the mating interface.

Each of these conductive elements includes an intermediate portion that connects a contact tail to a mating contact portion. The intermediate portions may be held within a connector housing, at least a portion of which may be dielectric so as to provide electrical isolation between conductive elements. Additionally, the connector housings may include conductive or lossy portions, which in some embodiments may provide conductive or partially conductive paths between some of the conductive elements. In some embodiments, the conductive portions may provide shielding. The lossy portions may also provide shielding in some instances and/or may provide desirable electrical properties within the connectors.

In various embodiments, dielectric members may be molded or over-molded from a dielectric material such as plastic or nylon. Examples of suitable materials include, but are not limited to, liquid crystal polymer (LCP), polyphenyline sulfide (PPS), high temperature nylon or polyphenylenoxide (PPO) or polypropylene (PP). Other suitable materials may be employed, as aspects of the present disclosure are not limited in this regard.

All of the above-described materials are suitable for use as binder material in manufacturing connectors. In accordance some embodiments, one or more fillers may be included in some or all of the binder material. As a non-limiting example, thermoplastic PPS filled to 30% by volume with glass fiber may be used to form the entire connector housing or dielectric portions of the housings.

Alternatively or additionally, portions of the housings may be formed of conductive materials, such as machined metal or pressed metal powder. In some embodiments, portions of the housing may be formed of metal or other conductive material with dielectric members spacing signal conductors from the conductive portions. In the embodiment illustrated, for example, a housing of backplane connector 200 may have regions formed of a conductive material with insulative members separating the intermediate portions of signal conductors from the conductive portions of the housing.

The housing of daughtercard connector 600 may also be formed in any suitable way. In the embodiment illustrated, daughtercard connector 600 may be formed from multiple subassemblies, referred to herein as "wafers." Each of the wafers (700, FIG. 7) may include a housing portion, which may similarly include dielectric, lossy and/or conductive portions. One or more members may hold the wafers in a desired position. For example, support members 612 and 614 may hold top and rear portions, respectively, of multiple wafers in a side-by-side configuration. Support members 612 and 614 may be formed of any suitable material, such as a sheet of metal stamped with tabs, openings or other features that engage corresponding features on the individual wafers.

Other members that may form a portion of the connector housing may provide mechanical integrity for daughtercard connector 600 and/or hold the wafers in a desired position. For example, a front housing portion 640 (FIG. 6) may receive portions of the wafers forming the mating interface. Any or all of these portions of the connector housing may be dielectric, lossy and/or conductive, to achieve desired electrical properties for the interconnection system.

In some embodiments, each wafer may hold a column of conductive elements forming signal conductors. These signal conductors may be shaped and spaced to form single ended signal conductors. However, in the embodiment illustrated in FIG. 1, the signal conductors are shaped and spaced in pairs to provide differential signal conductors. Each of the columns may include or be bounded by conductive elements serving as ground conductors. It should be appreciated that ground conductors need not be connected to earth ground, but are shaped to carry reference potentials, which may include earth ground, DC voltages or other suitable reference potentials. The "ground" or "reference" conductors may have a shape different than the signal conductors, which are configured to provide suitable signal transmission properties for high frequency signals.

Conductive elements may be made of metal or any other material that is conductive and provides suitable mechanical properties for conductive elements in an electrical connector. Phosphor-bronze, beryllium copper and other copper alloys are non-limiting examples of materials that may be used. The conductive elements may be formed from such materials in any suitable way, including by stamping and/or forming.

The spacing between adjacent columns of conductors may be within a range that provides a desirable density and desirable signal integrity. As a non-limiting example, the conductors may be stamped from 0.4 mm thick copper alloy, and the conductors within each column may be spaced apart by 2.25 mm and the columns of conductors may be spaced apart by 2.4 mm. However, a higher density may be achieved by placing the conductors closer together. In other embodiments, for example, smaller dimensions may be used to provide higher density, such as a thickness between 0.2 and 0.4 mm or spacing of 0.7 to 1.85 mm between columns or between conductors within a column. Moreover, each column may include four pairs of signal conductors, such that a density of 60 or more pairs per linear inch is achieved for the interconnection system illustrated in FIG. 1. However, it should be appreciated that more pairs per column, tighter spacing between pairs within the column and/or smaller distances between columns may be used to achieve a higher density connector.

The wafers may be formed any suitable way. In some embodiments, the wafers may be formed by stamping columns of conductive elements from a sheet of metal and over molding dielectric portions on the intermediate portions of the conductive elements. In other embodiments, wafers may be assembled from modules each of which includes a single, single-ended signal conductor, a single pair of differential signal conductors or any suitable number of single ended or differential pairs.

Assembling wafers from modules may aid in reducing "skew" in signal pairs at higher frequencies, such as between about 25 GHz and 40 GHz, or higher. Skew, in this context, refers to the difference in electrical propagation time between signals of a pair that operates as a differential signal. Modular construction that reduces skew is designed described, for example in application 61/930,411, which is incorporated herein by reference.

In accordance with techniques described in that co-pending application, in some embodiments, connectors may be formed of modules, each carrying a signal pair. The modules may be individually shielded, such as by attaching shield members to the modules and/or inserting the modules into an organizer or other structure that may provide electrical shielding between pairs and/or ground structures around the conductive elements carrying signals.

In some embodiments, signal conductor pairs within each module may be broadside coupled over substantial portions of their lengths. Broadside coupling enables the signal conductors in a pair to have the same physical length. To facilitate routing of signal traces within the connector footprint of a printed circuit board to which a connector is attached and/or constructing of mating interfaces of the connectors, the signal conductors may be aligned with edge to edge coupling in one or both of these regions. As a result, the signal conductors may include transition regions in which coupling changes from edge-to-edge to broadside or vice versa. As described below, these transition regions may be designed to prevent mode conversion or suppress undesired propagation modes that can interfere with signal integrity of the interconnection system.

The modules may be assembled into wafers or other connector structures. In some embodiments, a different module may be formed for each row position at which a pair is to be assembled into a right angle connector. These modules may be made to be used together to build up a connector with as many rows as desired. For example, a module of one shape may be formed for a pair to be positioned at the shortest rows of the connector, sometimes called the a-b rows. A separate module may be formed for conductive elements in the next longest rows, sometimes called the c-d rows. The inner portion of the module with the c-d rows may be designed to conform to the outer portion of the module with the a-b rows.

Figure 8:
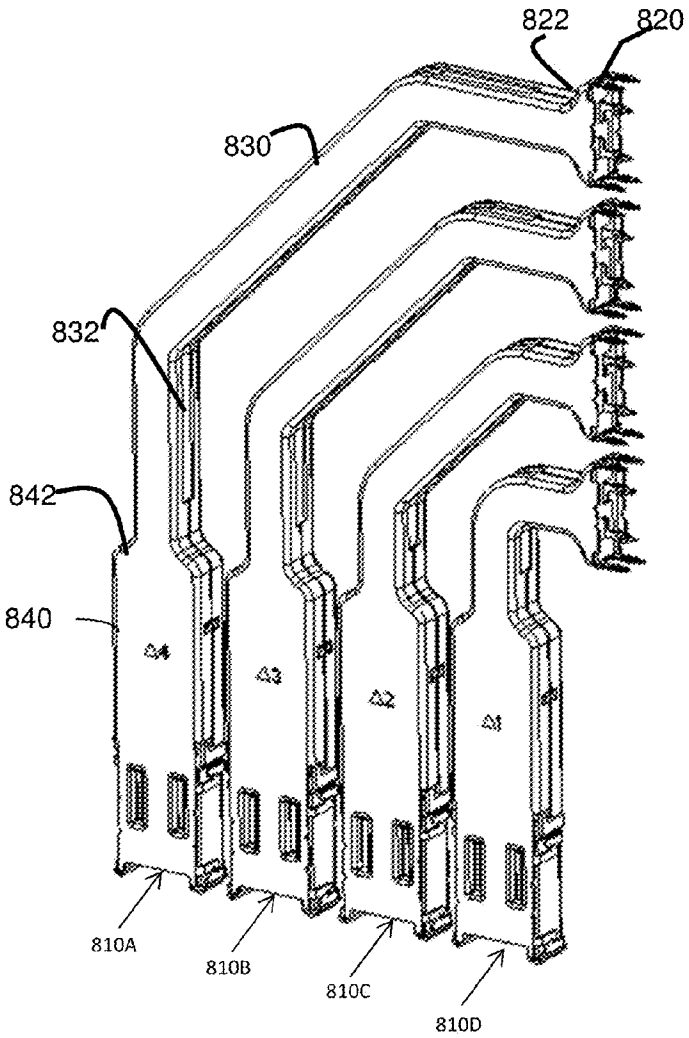
FIG. 8 is an isometric view of wafer modules of the wafer assembly of FIG. 7.

This pattern may be repeated for any number of pairs. Each module may be shaped to be used with modules that carry pairs for shorter and/or longer rows. To make a connector of any suitable size, a connector manufacturer may assemble into a wafer a number of modules to provide a desired number of pairs in the wafer. In this way, a connector manufacturer may introduce a connector family for a widely used connector size—such as 2 pairs. As customer requirements change, the connector manufacturer may procure tools for each additional pair, or, for modules that contain multiple pairs, group of pairs to produce connectors of larger sizes. The tooling used to produce modules for smaller connectors can be used to produce modules for the shorter rows even of the larger connectors. Such a modular connector is illustrated in FIG. 8.

Figure 2:
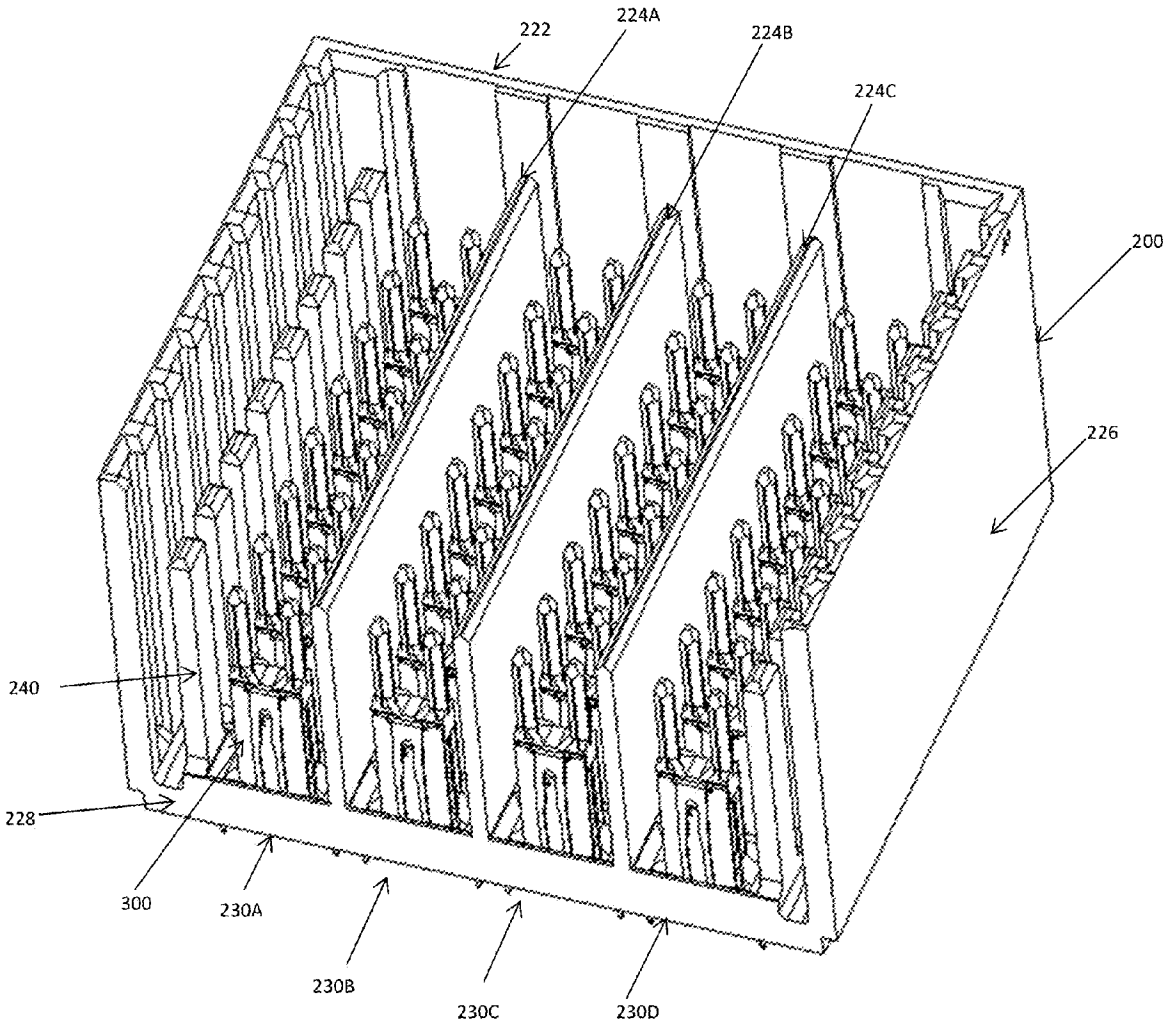
FIG. 2 is an isometric view, partially cutaway, of the backplane connector of FIG. 1.

Further details of the construction of the interconnection system of FIG. 1 are provided in FIG. 2, which shows backplane connector 200 partially cutaway. In the embodiment illustrated in FIG. 2, a forward wall of housing 222 is cut away to reveal the interior portions of mating interface 220.

In the embodiment illustrated, backplane connector 200 also has a modular construction. Multiple pin modules 300 are organized to form an array of conductive elements. Each of the pin modules 300 may be designed to mate with a module of daughtercard connector 600.

In the embodiment illustrated, four rows and eight columns of pin modules 300 are shown. With each pin module having two signal conductors, the four rows 230A, 230B, 230C and 230D of pin modules create columns with four pairs or eight signal conductors, in total. It should be appreciated, however, that the number of signal conductors per row or column is not a limitation of the invention. A greater or lesser number of rows of pin modules may be include within housing 222. Likewise, a greater or lesser number of columns may be included within housing 222. Alternatively or additionally, housing 222 may be regarded as a module of a backplane connector, and multiple such modules may be aligned side to side to extend the length of a backplane connector.

In the embodiment illustrated in FIG. 2, each of the pin modules 300 contains conductive elements serving as signal conductors. Those signal conductors are held within insulative members, which may serve as a portion of the housing of backplane connector 200. The insulative portions of the pin modules 300 may be positioned to separate the signal conductors from other portions of housing 222. In this configuration, other portions of housing 222 may be conductive or partially conductive, such as may result from the use of lossy materials.

In some embodiments, housing 222 may contain both conductive and lossy portions. For example, a shroud including walls 226 and a floor 228 may be pressed from a powdered metal or formed from conductive material in any other suitable way. Pin modules 300 may be inserted into openings within floor 228.

Lossy or conductive members may be positioned adjacent rows 230A, 230B, 230C and 230D of pin modules 300. In the embodiment of FIG. 2, separators 224A, 224B and 224C are shown between adjacent rows of pin modules. Separators 224A, 224B and 224C may be conductive or lossy, and may be formed as part of the same operation or from the same member that forms walls 226 and floor 228. Alternatively, separators 224A, 224B and 224C may be inserted separately into housing 222 after walls 226 and floor 228 are formed. In embodiments in which separators 224A, 224B and 224C formed separately from walls 226 and floor 228 and subsequently inserted into housing 222, separators 224A, 224B and 224C may be formed of a different material than walls 226 and/or floor 228. For example, in some embodiments, walls 226 and floor 228 may be conductive while separators 224A, 224B and 224C may be lossy or partially lossy and partially conductive.

In some embodiments, other lossy or conductive members may extend into mating interface 220, perpendicular to floor 228. Members 240 are shown adjacent to end-most rows 230A and 230D. In contrast to separators 224A, 224B and 224C, which extend across the mating interface 220, separator members 240, approximately the same width as one column, are positioned in rows adjacent row 230A and row 230D. Daughtercard connector 600 may include, in its mating interface 620, slots to receive, separators 224A, 224B and 224C. Daughtercard connector 600 may include openings that similarly receive members 240. Members 240 may have a similar electrical effect to separators 224A, 224B and 224C, in that both may suppress resonances, crosstalk or other undesired electrical effects. Members 240, because they fit into smaller openings within daughtercard connector 600 than separators 224A, 224B and 224C, may enable greater mechanical integrity of housing portions of daughtercard connector 600 at the sides where members 240 are received.

Figure 3:
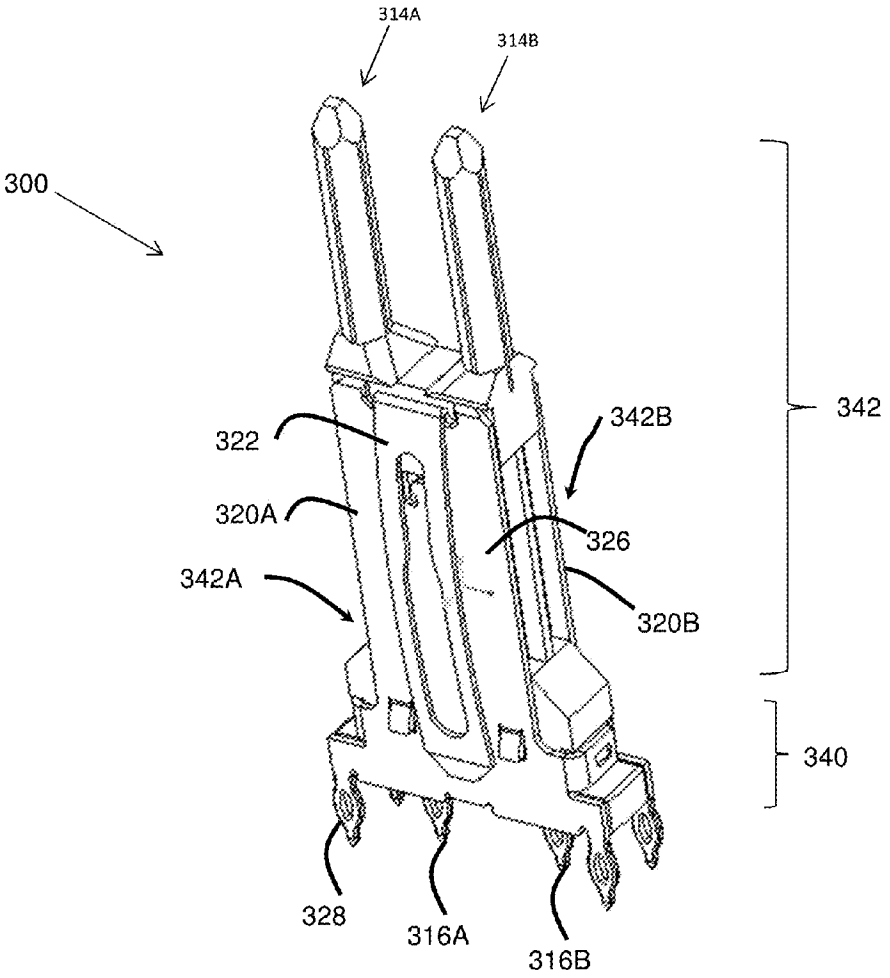
FIG. 3 is an isometric view of a pin assembly of the backplane connector of FIG. 2.

FIG. 3 illustrates a pin module 300 in greater detail. In this embodiment, each pin module includes a pair of conductive elements acting as signal conductors 314A and 314B. Each of the signal conductors has a mating interface portion shaped as a pin. Opposing ends of the signal conductors have contact tails 316A and 316B. In this embodiment, the contact tails are shaped as press fit compliant sections. Intermediate portions of the signal conductors, connecting the contact tails to the mating contact portions, pass through pin module 300.

Conductive elements serving as reference conductors 320A and 320B are attached at opposing exterior surfaces of pin module 300. Each of the reference conductors has contact tails 328, shaped for making electrical connections to vias within a printed circuit board. The reference conductors also have mating contact portions. In the embodiment illustrated, two types of mating contact portions are illustrated. Compliant member 322 may serve as a mating contact portion, pressing against a reference conductor in daughtercard connector 600. In some embodiments, surfaces 324 and 326 alternatively or additionally may serve as mating contact portions, where reference conductors from the mating conductor may press against reference conductors 320A or 320B. However, in the embodiment illustrated, the reference conductors may be shaped such that electrical contact is made only at compliant member 322.

Figure 4:
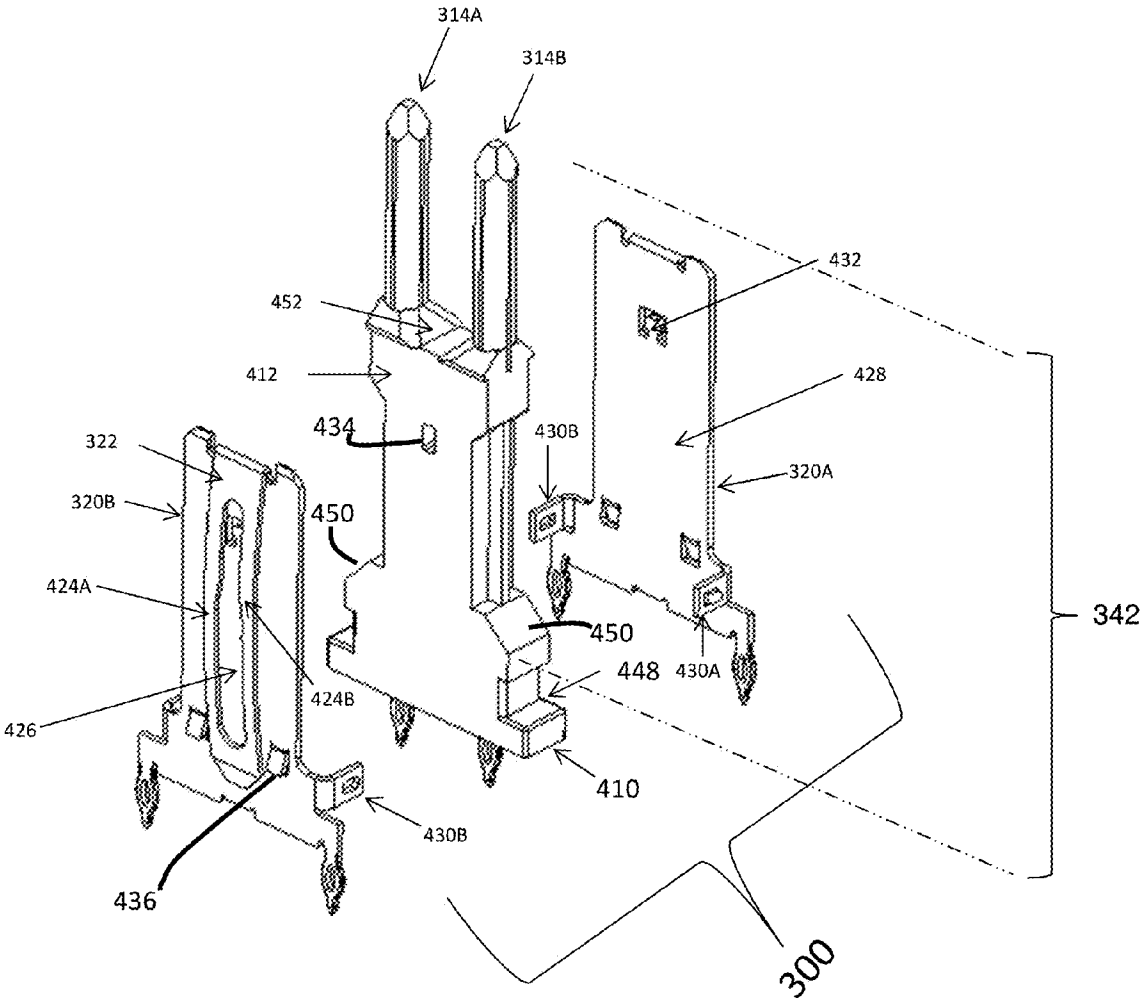
FIG. 4 is an exploded view of the pin assembly of FIG. 3.

FIG. 4 shows an exploded view of pin module 300. Intermediate portions of the signal conductors 314A and 314B are held within an insulative member 410, which may form a portion of the housing of backplane connector 200. Insulative member 410 may be insert molded around signal conductors 314A and 314B. A surface 412 against which reference conductor 320B presses is visible in the exploded view of FIG. 4. Likewise, the surface 428 of reference conductor 320A, which presses against a surface of member 410 not visible in FIG. 4, can also be seen in this view.

As can be seen, the surface 428 is substantially unbroken. Attachment features, such as tab 432 may be formed in the surface 428. Such a tab may engage an opening (not visible in the view shown in FIG. 4) in insulative member 410 to hold reference conductor 320A to insulative member 410. A similar tab (not numbered) may be formed in reference conductor 320B. As shown, these tabs, which serve as attachment mechanisms, are centered between signal conductors 314A and 314B where radiation from or affecting the pair is relatively low. Additionally, tabs, such as 436, may be formed in reference conductors 320A and 320B. Tabs 436 may engage insulative member 410 to hold pin module 300 in an opening in floor 228.

In the embodiment illustrated, compliant member 322 is not cut from the planar portion of the reference conductor 320B that presses against the surface 412 of the insulative member 410. Rather, compliant member 322 is formed from a different portion of a sheet of metal and folded over to be parallel with the planar portion of the reference conductor 320B. In this way, no opening is left in the planar portion of the reference conductor 320B from forming compliant member 322. Moreover, as shown, compliant member 322 has two compliant portions 424A and 424B, which are joined together at their distal ends but separated by an opening 426. This configuration may provide mating contact portions with a suitable mating force in desired locations without leaving an opening in the shielding around pin module 300. However, a similar effect may be achieved in some embodiments by attaching separate compliant members to reference conductors 320A and 320B.

The reference conductors 320A and 320B may be held to pin module 300 in any suitable way. As noted above, tabs 432 may engage an opening 434 in the housing portion. Additionally or alternatively, straps or other features may be used to hold other portions of the reference conductors. As shown each reference conductor includes straps 430A and 430B. Straps 430A include tabs while straps 430B include openings adapted to receive those tabs. Here reference conductors 320A and 320B have the same shape, and may be made with the same tooling, but are mounted on opposite surfaces of the pin module 300. As a result, a tab 430A of one reference conductor aligns with a tab 430B of the opposing reference conductor such that the tab 430A and the tab 430B interlock and hold the reference conductors in place. These tabs may engage in an opening 448 in the insulative member, which may further aid in holding the reference conductors in a desired orientation relative to signal conductors 314A and 314B in pin module 300.

FIG. 4 further reveals a tapered surface 450 of the insulative member 410. In this embodiment surface 450 is tapered with respect to the axis of the signal conductor pair formed by signal conductors 314A and 314B. Surface 450 is tapered in the sense that it is closer to the axis of the signal conductor pair closer to the distal ends of the mating contact portions and further from the axis further from the distal ends. In the embodiment illustrated, pin module 300 is symmetrical with respect to the axis of the signal conductor pair and a tapered surface 450 is formed adjacent each of the signal conductors 314A and 314B.

In accordance with some embodiments, some or all of the adjacent surfaces in mating connectors may be tapered. Accordingly, though not shown in FIG. 4, surfaces of the insulative portions of daughtercard connector 600 that are adjacent to tapered surfaces 450 may be tapered in a complementary fashion such that the surfaces from the mating connectors conform to one another when the connectors are in the designed mating positions.

Tapered surfaces in the mating interfaces may avoid abrupt changes in impedance as a function of connector separation. Accordingly, other surfaces designed to be adjacent a mating connector may be similarly tapered. FIG. 4 shows such tapered surfaces 452. As shown, tapered surfaces 452 are between signal conductors 314A and 314B. Surfaces 450 and 452 cooperate to provide a taper on the insulative portions on both sides of the signal conductors.

Figure 5:
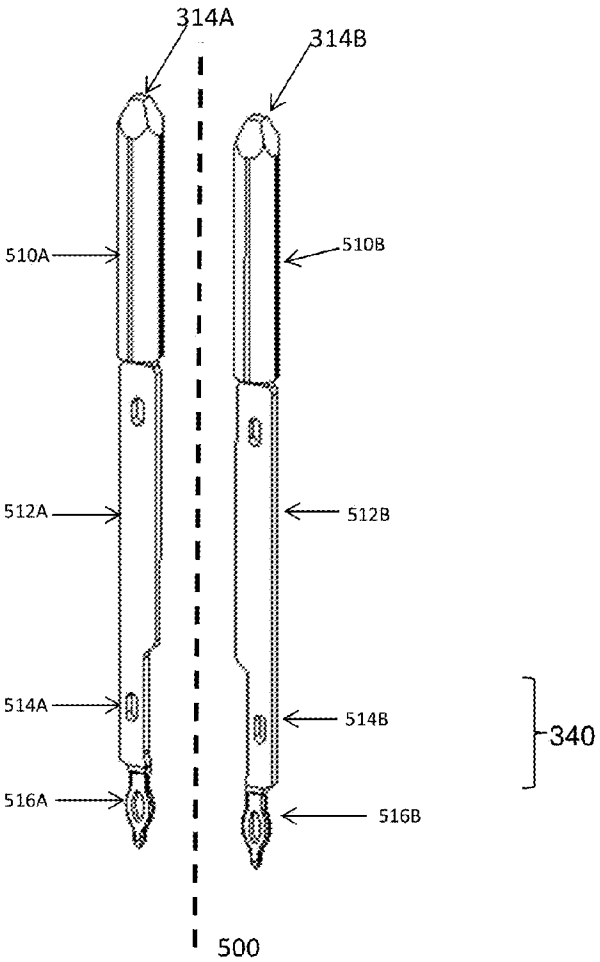
FIG. 5 is an isometric view of signal conductors of the pin assembly of FIG. 3.

FIG. 5 shows further detail of pin module 300. Here, the signal conductors are shown separated from the pin module. FIG. 5 illustrates the signal conductors before being over molded by insulative portions or otherwise being incorporated into a pin module 300. However, in some embodiments, the signal conductors may be held together by a carrier strip or other suitable support mechanism, not shown in FIG. 5, before being assembled into a module.

In the illustrated embodiment, the signal conductors 314A and 314B are symmetrical with respect to an axis 500 of the signal conductor pair. Each has a mating contact portion, 510A or 510B shaped as a pin. Each also has an intermediate portion 512A or 512B, and 514A or 514B. Here, different widths are provided to provide for matching impedance to a mating connector and a printed circuit board, despite different materials or construction techniques in each. A transition region may be included, as illustrated, to provide a gradual transition between regions of different width. Contact tails 516A or 516B may also be included.

In the embodiment illustrated, intermediate portions 512A, 512B, 514A and 514B may be flat, with broadsides and narrower edges. The signal conductors of the pairs are, in the embodiment illustrated, aligned edge-to-edge and are thus configured for edge coupling. In other embodiments, some or all of the signal conductor pairs may alternatively be broadside coupled.

Mating contact portions may be of any suitable shape, but in the embodiment illustrated, they are cylindrical. The cylindrical portions may be formed by rolling portions of a sheet of metal into a tube or in any other suitable way. Such a shape may be created, for example, by stamping a shape from a sheet of metal that includes the intermediate portions. A portion of that material may be rolled into a tube to provide the mating contact portion. Alternatively or additionally, a wire or other cylindrical element may be flattened to form the intermediate portions, leaving the mating contact portions cylindrical. One or more openings (not numbered) may be formed in the signal conductors. Such openings may ensure that the signal conductors are securely engaged with the insulative member 410.

Figure 6:
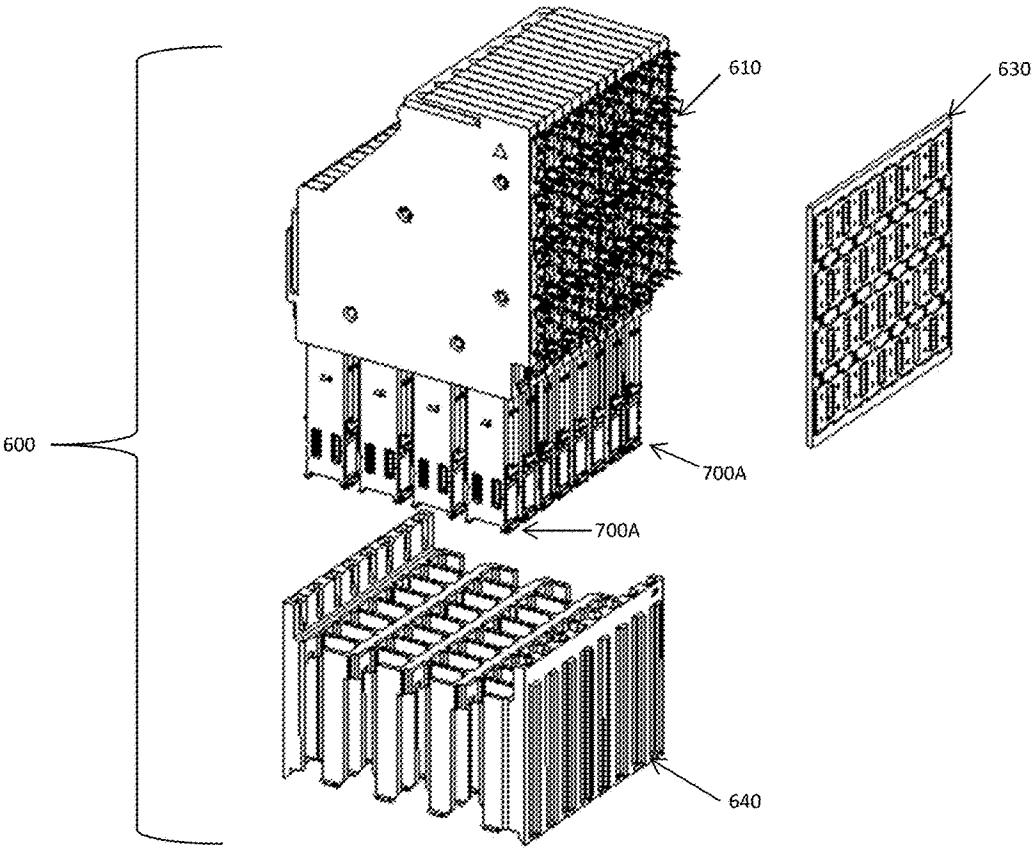
FIG. 6 is an isometric view, partially exploded, of the daughtercard connector of FIG. 1.

Turning to FIG. 6, further details of daughtercard connector 600 are shown in a partially exploded view. As shown, connector 600 includes multiple wafers 700A held together in a side-by-side configuration. Here, eight wafers, corresponding to the eight columns of pin modules in backplane connector 200, are shown. However, as with backplane connector 200, the size of the connector assembly may be configured by incorporating more rows per wafer, more wafers per connector or more connectors per interconnection system.

Conductive elements within the wafers 700A may include mating contact portions and contact tails. Contact tails 610 are shown extending from a surface of connector 600 adapted for mounting against a printed circuit board. In some embodiments, contact tails 610 may pass through a member 630. Member 630 may include insulative, lossy or conductive portions. In some embodiments, contact tails associated with signal conductors may pass through insulative portions of member 630. Contact tails associated with reference conductors may pass through lossy or conductive portions of member 630.

Mating contact portions of the wafers 700A are held in a front housing portion 640. The front housing portion may be made of any suitable material, which may be insulative, lossy or conductive or may include any suitable combination or such materials. For example the front housing portion may be molded from a filled, lossy material or may be formed from a conductive material, using materials and techniques similar to those described above for the housing walls 226. As shown, the wafers are assembled from modules 810A, 810B, 810C and 810D (FIG. 8), each with a pair of signal conductors surrounded by reference conductors. In the embodiment illustrated, front housing portion 640 has multiple passages, each positioned to receive one such pair of signal conductors and associated reference conductors. However, it should be appreciated that each module might contain a single signal conductor or more than two signal conductors.

Figure 7:
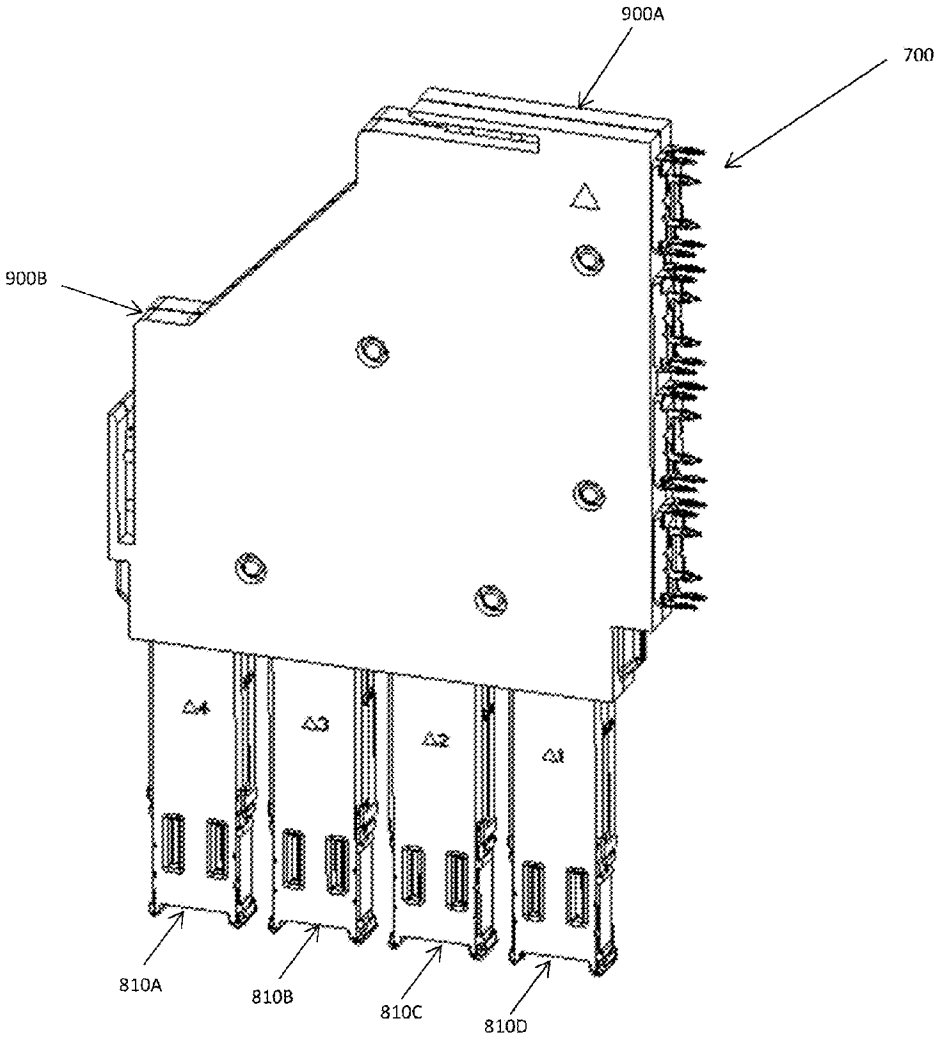
FIG. 7 is an isometric view of a wafer assembly of the daughtercard connector of FIG. 6.

FIG. 7 illustrates a wafer 700. Multiple such wafers may be aligned side-by-side and held together with one or more support members, or in any other suitable way, to form a daughtercard connector. In the embodiment illustrated, wafer 700 is formed from multiple modules 810A, 810B, 810C and 810D. The modules are aligned to form a column of mating contact portions along one edge of wafer 700 and a column of contact tails along another edge of wafer 700. In the embodiment in which the wafer is designed for use in a right angle connector, as illustrated, those edges are perpendicular.

In the embodiment illustrated, each of the modules includes reference conductors that at least partially enclose the signal conductors. The reference conductors may similarly have mating contact portions and contact tails.

The modules may be held together in any suitable way. For example, the modules may be held within a housing, which in the embodiment illustrated is formed with members 900A and 900B. Members 900A and 900B may be formed separately and then secured together, capturing modules 810A . . . 810D between them. Members 900A and 900B may be held together in any suitable way, such as by attachment members that form an interference fit or a snap fit. Alternatively or additionally, adhesive, welding or other attachment techniques may be used.

Members 900A and 900B may be formed of any suitable material. That material may be an insulative material. Alternatively or additionally, that material may be or may include portions that are lossy or conductive. Members 900A and 900B may be formed, for example, by molding such materials into a desired shape. Alternatively, members 900A and 900B may be formed in place around modules 810A . . . 810D, such as via an insert molding operation. In such an embodiment, it is not necessary that members 900A and 900B be formed separately. Rather, a housing portion to hold modules 810A . . . 810D may be formed in one operation.

FIG. 8 shows modules 810A . . . 810D without members 900A and 900B. In this view, the reference conductors are visible. Signal conductors (not visible in FIG. 8) are enclosed within the reference conductors, forming a waveguide structure. Each waveguide structure includes a contact tail region 820, an intermediate region 830 and a mating contact region 840. Within the mating contact region 840 and the contact tail region 820, the signal conductors are positioned edge to edge. Within the intermediate region 830, the signal conductors are positioned for broadside coupling. Transition regions 822 and 842 are provided to transition between the edge coupled orientation and the broadside coupled orientation.

The transition regions 822 and 842 in the reference conductors may correspond to transition regions in signal conductors, as described below. In the illustrated embodiment, reference conductors form an enclosure around the signal conductors. A transition region in the reference conductors, in some embodiments, may keep the spacing between the signal conductors and reference conductors generally uniform over the length of the signal conductors. Thus, the enclosure formed by the reference conductors may have different widths in different regions.

The reference conductors provide shielding coverage along the length of the signal conductors. As shown, coverage is provided over substantially all of the length of the signal conductors, with coverage in the mating contact portion and the intermediate portions of the signal conductors. The contact tails are shown exposed so that they can make contact with the printed circuit board. However, in use, these mating contact portions will be adjacent ground structures within a printed circuit board such that being exposed as shown in FIG. 8 does not detract from shielding coverage along substantially all of the length of the signal conductor. In some embodiments, mating contact portions might also be exposed for mating to another connector. Accordingly, in some embodiments, shielding coverage may be provided over more than 80%, 85%, 90% or 95% of the intermediate portion of the signal conductors. Similarly shielding coverage may also be provided in the transition regions, such that shielding coverage may be provided over more than 80%, 85%, 90% or 95% of the combined length of the intermediate portion and transition regions of the signal conductors. In some embodiments, as illustrated, the mating contact regions and some or all of the contact tails may also be shielded, such that shielding coverage may be, in various embodiments, over more than 80%, 85%, 90% or 95% of the length of the signal conductors.

In the embodiment illustrated, a waveguide-like structure formed by the reference conductors has a wider dimension in the column direction of the connector in the contact tail regions 820 and the mating contact region 840 to accommodate for the wider dimension of the signal conductors being side-by-side in the column direction in these regions. In the embodiment illustrated, contact tail regions 820 and the mating contact region 840 of the signal conductors are separated by a distance that aligns them with the mating contacts of a mating connector or contact structures on a printed circuit board to which the connector is to be attached.

These spacing requirements mean that the waveguide will be wider in the column dimension than it is in the transverse direction, providing an aspect ratio of the waveguide in these regions that may be at least 2:1, and in some embodiments may be on the order of at least 3:1. Conversely, in the intermediate region 830, the signal conductors are oriented with the wide dimension of the signal conductors overlaid in the column dimension, leading to an aspect ratio of the waveguide that may be less than 2:1, and in some embodiments may be less than 1.5:1 or on the order of 1:1.

With this smaller aspect ratio, the largest dimension of the waveguide in the intermediate region 830 will be smaller than the largest dimension of the waveguide in regions 830 and 840. Because that the lowest frequency propagated by a waveguide is inversely proportional to the length of its shortest dimension, the lowest frequency mode of propagation that can be excited in intermediate region 830 is higher than can be excited in contact tail regions 820 and the mating contact region 840. The lowest frequency mode that can be excited in the transition regions will be intermediate between the two. Because the transition from edge coupled to broadside coupling has the potential to excite undesired modes in the waveguides, signal integrity may be improved if these modes are at higher frequencies than the intended operating range of the connector, or at least are as high as possible.

These regions may be configured to avoid mode conversion upon transition between coupling orientations, which would excite propagation of undesired signals through the waveguides. For example, as shown below, the signal conductors may be shaped such that the transition occurs in the intermediate region 830 or the transition regions 822 and 842, or partially within both. Additionally or alternatively, the modules may be structured to suppress undesired modes excited in the waveguide formed by the reference conductors, as described in greater detail below.

Though the reference conductors may substantially enclose each pair, it is not a requirement that the enclosure be without openings. Accordingly, in embodiments shaped to provide rectangular shielding, the reference conductors in the intermediate regions may be aligned with at least portions of all four sides of the signal conductors. The reference conductors may combine for example to provide 360 degree coverage around the pair of signal conductors. Such coverage may be provided, for example, by overlapping or physically contact reference conductors. In the illustrated embodiment, the reference conductors are U-shaped shells and come together to form an enclosure.

Three hundred sixty degree coverage may be provided regardless of the shape of the reference conductors. For example, such coverage may be provided with circular, elliptical or reference conductors of any other suitable shape. However, it is not a requirement that the coverage be complete. The coverage, for example, may have an angular extent in the range between about 270 and 365 degrees. In some embodiments, the coverage may be in the range of about 340 to 360 degrees. Such coverage may be achieved for example, by slots or other openings in the reference conductors.

In some embodiments, the shielding coverage may be different in different regions. In the transition regions, the shielding coverage may be greater than in the intermediate regions. In some embodiments, the shielding coverage may have an angular extent of greater than 355 degrees, or even in some embodiments 360 degrees, resulting from direct contact, or even overlap, in reference conductors in the transition regions even if less shielding coverage is provided in the transition regions.

The inventors have recognized and appreciated that, in some sense, fully enclosing a signal pair in reference conductors in the intermediate regions may create effects that undesirably impact signal integrity, particularly when used in connection with a transition between edge coupling and broadside coupling within a module. The reference conductors surrounding the signal pair may form a waveguide. Signals on the pair, and particularly within a transition region between edge coupling and broadside coupling, may cause energy from the differential mode of propagation between the edges to excite signals that can propagate within the waveguide. In accordance with some embodiments, one or more techniques to avoid exciting these undesired modes, or to suppress them if they are excited, may be used.

Some techniques that may be used to increase the frequency that will excite the undesired modes. In the embodiment illustrated, the reference conductors may be shaped to leave openings 832. These openings may be in the narrower wall of the enclosure. However, in embodiments in which there is a wider wall, the openings may be in the wider wall. In the embodiment illustrated, openings 832 run parallel to the intermediate portions of the signal conductors and are between the signal conductors that form a pair. These slots lower the angular extent of the shielding, such that, adjacent the broadside coupled intermediate portions of the signal conductors, the angular extent of the shielding may be less than 360 degrees. It may, for example, be in the range of 355 of less. In embodiments in which members 900A and 900B are formed by over molding lossy material on the modules, lossy material may be allowed to fill openings 832, with or without extending into the inside of the waveguide, which may suppress propagation of undesired modes of signal propagation, that can decrease signal integrity.

In the embodiment illustrated in FIG. 8, openings 832 are slot shaped, effectively dividing the shielding in half in intermediate region 830. The lowest frequency that can be excited in a structure serving as a waveguide, as is the effect of the reference conductors that substantially surround the signal conductors as illustrated in FIG. 8, is inversely proportional to the dimensions of the sides. In some embodiments, the lowest frequency waveguide mode that can be excited is a TEM mode. Effectively shortening a side by incorporating slot-shaped opening 832, raises the frequency of the TEM mode that can be excited. A higher resonant frequency can mean that less energy within the operating frequency range of the connector is coupled into undesired propagation within the waveguide formed by the reference conductors, which improves signal integrity.

In region 830, the signal conductors of a pair are broadside coupled and the openings 832, with or without lossy material in them, may suppress TEM common modes of propagation. While not being bound by any particular theory of operation, the inventors theorize that openings 832, in combination with an edge coupled to broadside coupled transition, aids in providing a balanced connector suitable for high frequency operation.

Figure 9:
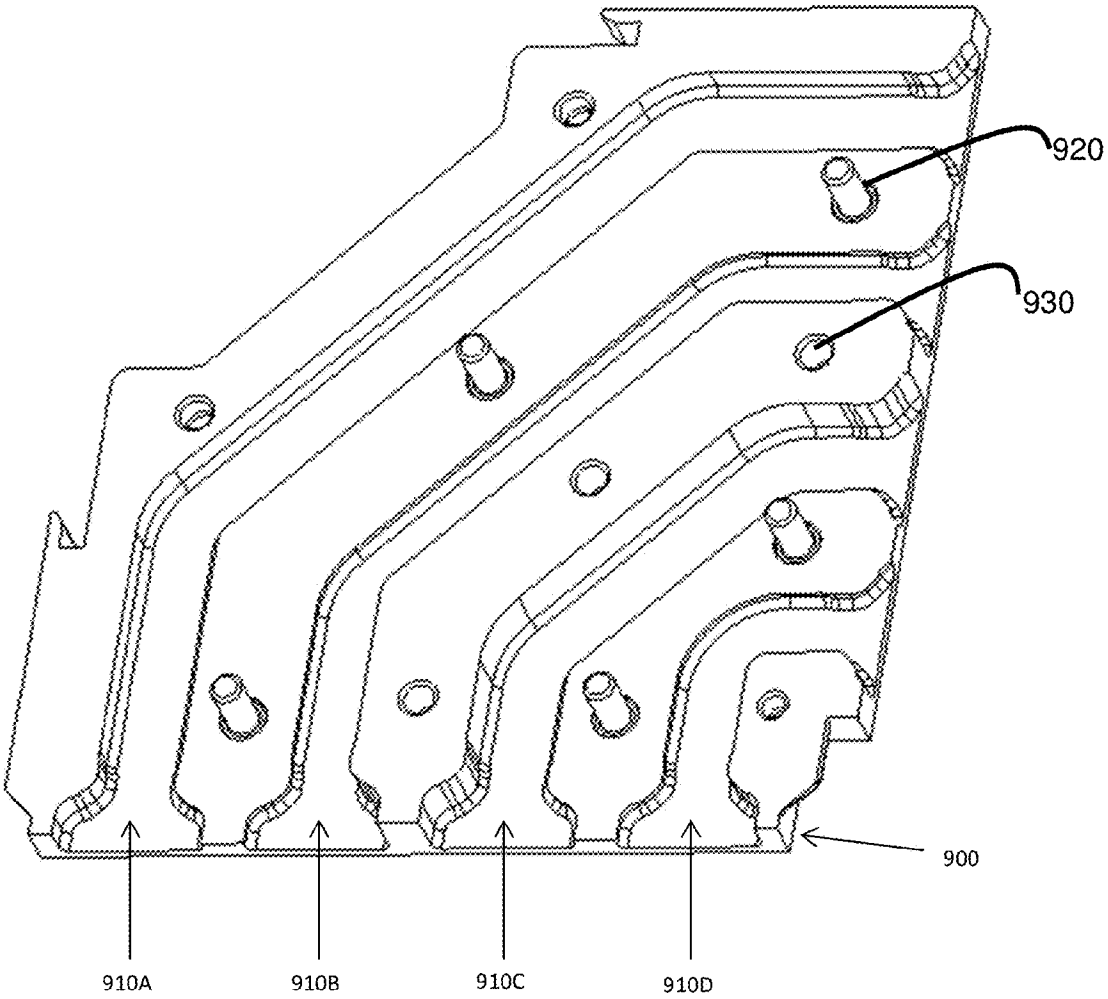
FIG. 9 is an isometric view of a portion of the insulative housing of the wafer assembly of FIG. 7.

FIG. 9 illustrates a member 900, which may be a representation of member 900A or 900B. As can be seen, member 900 is formed with channels 910A . . . 910D shaped to receive modules 810A . . . 810D shown in FIG. 8. With the modules in the channels, member 900A may be secured to member 900B. In the illustrated embodiment, attachment of members 900A and 900B may be achieved by posts, such as post 920, in one member, passing through a hole, such as hole 930, in the other member. The post may be welded or otherwise secured in the hole. However, any suitable attachment mechanism may be used.

Members 900A and 900B may be molded from or include a lossy material. Any suitable lossy material may be used for these and other structures that are "lossy." Materials that conduct, but with some loss, or material which by another physical mechanism absorbs electromagnetic energy over the frequency range of interest are referred to herein generally as "lossy" materials. Electrically lossy materials can be formed from lossy dielectric and/or poorly conductive and/or lossy magnetic materials. Magnetically lossy material can be formed, for example, from materials traditionally regarded as ferromagnetic materials, such as those that have a magnetic loss tangent greater than approximately 0.05 in the frequency range of interest. The "magnetic loss tangent" is the ratio of the imaginary part to the real part of the complex electrical permeability of the material. Practical lossy magnetic materials or mixtures containing lossy magnetic materials may also exhibit useful amounts of dielectric loss or conductive loss effects over portions of the frequency range of interest. Electrically lossy material can be formed from material traditionally regarded as dielectric materials, such as those that have an electric loss tangent greater than approximately 0.05 in the frequency range of interest. The "electric loss tangent" is the ratio of the imaginary part to the real part of the complex electrical permittivity of the material. Electrically lossy materials can also be formed from materials that are generally thought of as conductors, but are either relatively poor conductors over the frequency range of interest, contain conductive particles or regions that are sufficiently dispersed that they do not provide high conductivity or otherwise are prepared with properties that lead to a relatively weak bulk conductivity compared to a good conductor such as copper over the frequency range of interest.

Electrically lossy materials typically have a bulk conductivity of about 1 Siemen/meter to about 10,000 Siemens/meter and preferably about 1 siemen/meter to about 5,000 Siemens/meter. In some embodiments material with a bulk conductivity of between about 10 Siemens/meter and about 200 Siemens/meter may be used. As a specific example, material with a conductivity of about 50 Siemens/meter may be used. However, it should be appreciated that the conductivity of the material may be selected empirically or through electrical simulation using known simulation tools to determine a suitable conductivity that provides a suitably low crosstalk with a suitably low signal path attenuation or insertion loss.

Electrically lossy materials may be partially conductive materials, such as those that have a surface resistivity between 1 Ω/square and 100,000 Ω/square. In some embodiments, the electrically lossy material has a surface resistivity between 10 Ω/square and 1000 Ω/square. As a specific example, the material may have a surface resistivity of between about 20 Ω/square and 80 Ω/square.

In some embodiments, electrically lossy material is formed by adding to a binder a filler that contains conductive particles. In such an embodiment, a lossy member may be formed by molding or otherwise shaping the binder with filler into a desired form. Examples of conductive particles that may be used as a filler to form an electrically lossy material include carbon or graphite formed as fibers, flakes, nanoparticles, or other types of particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. The binder or matrix may be any material that will set, cure, or can otherwise be used to position the filler material. In some embodiments, the binder may be a thermoplastic material traditionally used in the manufacture of electrical connectors to facilitate the molding of the electrically lossy material into the desired shapes and locations as part of the manufacture of the electrical connector. Examples of such materials include liquid crystal polymer (LCP) and nylon. However, many alternative forms of binder materials may be used. Curable materials, such as epoxies, may serve as a binder. Alternatively, materials such as thermosetting resins or adhesives may be used.

Also, while the above described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic component or a metal component. As used herein, the term "binder" encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name Celestran® by Celanese Corporation which can be filled with carbon fibers or stainless steel filaments. A lossy material, such as lossy conductive carbon filled adhesive preform, such as those sold by Techfilm of Billerica, Mass., US may also be used. This preform can include an epoxy binder filled with carbon fibers and/or other carbon particles. The binder surrounds carbon particles, which act as a reinforcement for the preform. Such a preform may be inserted in a connector wafer to form all or part of the housing. In some embodiments, the preform may adhere through the adhesive in the preform, which may be cured in a heat treating process. In some embodiments, the adhesive may take the form of a separate conductive or non-conductive adhesive layer. In some embodiments, the adhesive in the preform alternatively or additionally may be used to secure one or more conductive elements, such as foil strips, to the lossy material.

Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

In some embodiments, a lossy member may be manufactured by stamping a preform or sheet of lossy material. For example, an insert may be formed by stamping a preform as described above with an appropriate pattern of openings. However, other materials may be used instead of or in addition to such a preform. A sheet of ferromagnetic material, for example, may be used.

However, lossy members also may be formed in other ways. In some embodiments, a lossy member may be formed by interleaving layers of lossy and conductive material such as metal foil. These layers may be rigidly attached to one another, such as through the use of epoxy or other adhesive, or may be held together in any other suitable way. The layers may be of the desired shape before being secured to one another or may be stamped or otherwise shaped after they are held together.

Figure 10:
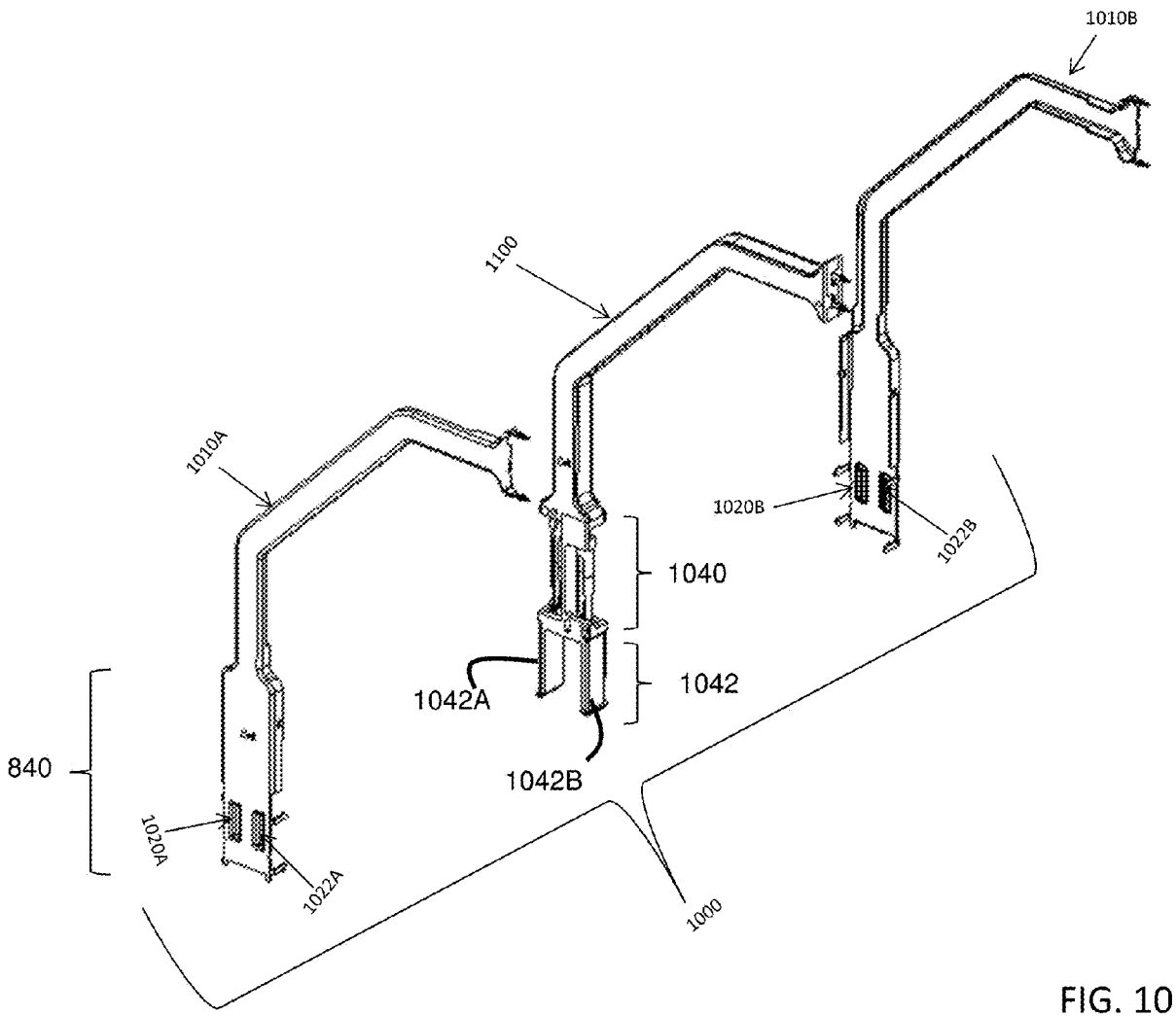
FIG. 10 is an isometric view, partially exploded, of a wafer module of the wafer assembly of FIG. 7.

FIG. 10 shows further details of construction of a wafer module 1000. Module 1000 may be representative of any of the modules in a connector, such as any of the modules 810A . . . 810D shown in FIGS. 7-8. Each of the modules 810A . . . 810D may have the same general construction, and some portions may be the same for all modules. For example, the contact tail regions 820 and mating contact regions 840 may be the same for all modules. Each module may include an intermediate portion region 830, but the length and shape of the intermediate portion region 830 may vary depending on the location of the module within the wafer.

In the embodiment illustrated, module 1000 includes a pair of signal conductors 1310A and 1310B (FIG. 13) held within an insulative housing portion 1100. Insulative housing portion 1100 is enclosed, at least partially, by reference conductors 1010A and 1010B. This subassembly may be held together in any suitable way. For example, reference conductors 1010A and 1010B may have features that engage one another. Alternatively or additionally, reference conductors 1010A and 1010B may have features that engage insulative housing portion 1100. As yet another example, the reference conductors may be held in place once members 900A and 900B are secured together as shown in FIG. 7.

The exploded view of FIG. 10 reveals that mating contact region 840 includes subregions 1040 and 1042. Subregion 1040 includes mating contact portions of module 1000. When mated with a pin module 300, mating contact portions from the pin module will enter subregion 1040 and engage the mating contact portions of module 1000. These components may be dimensioned to support a "functional mating range," such that, if the module 300 and module 1000 are fully pressed together, the mating contact portions of module 1000 will slide along the pins from pin module 300 by the "functional mating range" distance during mating.

The impedance of the signal conductors in subregion 1040 will be largely defined by the structure of module 1000. The separation of signal conductors of the pair as well as the separation of the signal conductors from reference conductors 1010A and 1010B will set the impedance. The dielectric constant of the material surrounding the signal conductors, which in this embodiment is air, will also impact the impedance. In accordance with some embodiments, design parameters of module 1000 may be selected to provide a nominal impedance within region 1040. That impedance may be designed to match the impedance of other portions of module 1000, which in turn may be selected to match the impedance of a printed circuit board or other portions of the interconnection system such that the connector does not create impedance discontinuities.

If the modules 300 and 1000 are in their nominal mating position, which in this embodiment is fully pressed together, the pins will be within mating contact portions of the signal conductors of module 1000. The impedance of the signal conductors in subregion 1040 will still be driven largely by the configuration of subregion 1040, providing a matched impedance to the rest of module 1000.

A subregion 340 (FIG. 3) may exist within pin module 300. In subregion 340, the impedance of the signal conductors will be dictated by the construction of pin module 300. The impedance will be determined by the separation of signal conductors 314A and 314B as well as their separation from reference conductors 320A and 320B. The dielectric constant of insulative portion 410 may also impact the impedance. Accordingly, these parameters may be selected to provide, within subregion 340, an impedance, which may be designed to match the nominal impedance in subregion 1040.

The impedance in subregions 340 and 1040, being dictated by construction of the modules, is largely independent of any separation between the modules during mating. However, modules 300 and 1000 have, respectively, subregions 342 and 1042 that interact with components from the mating module that could influence impedance. Because the positioning of these components could influence impedance, the impedance could vary as a function of separation of the mating modules. In some embodiments, these components are positioned to reduce changes of impedance, regardless of separation distance, or to reduce the impact of changes of impedance by distributing the change across the mating region.

When pin module 300 is pressed fully against module 1000, the components in subregions 342 and 1042 may combine to provide the nominal mating impedance. Because the modules are designed to provide functional mating range, signal conductors within pin module 300 and module 1000 may mate, even if those modules are separated by an amount that equals the functional mating range, such that separation between the modules can lead to changes in impedance, relative to the nominal value, at one or more places along the signal conductors in the mating region. Appropriate shape and positioning of these members can reduce that change or reduce the effect of the change by distributing it over portions of the mating region.

In the embodiments illustrated in FIG. 3 and FIG. 10, subregion 1042 is designed to overlap pin module 300 when module 1000 is pressed fully against pin module 300. Projecting insulative members 1042A and 1042B are sized to fit within spaces 342A and 342B, respectively. With the modules pressed together, the distal ends of insulative members 1042A and 1042B press against surfaces 450 (FIG. 4). Those distal ends may have a shape complementary to the taper of surfaces 450 such that insulative members 1042A and 1042B fill spaces 342A and 342B, respectively. That overlap creates a relative position of signal conductors, dielectric, and reference conductors that may approximate the structure within subregion 340. These components may be sized to provide the same impedance as in subregion 340 when modules 300 and 1000 are fully pressed together. When the modules are fully pressed together, which in this example is the nominal mating position, the signal conductors will have the same impedance across the mating region made up by subregions 340, 1040 and where subregions 342 and 1042 overlap.

These components also may be sized and may have material properties that provide impedance control as a function of separation of modules 300 and 1000. Impedance control may be achieved by providing approximately the same impedance through subregions 342 and 1042, even if those subregions do not fully overlap, or by providing gradual impedance transitions, regardless of separation of the modules.

In the illustrated embodiment, this impedance control is provided in part by projecting insulative members 1042A and 1042B, which fully or partially overlap module 300, depending on separation between modules 300 and 1000. These projecting insulative members can reduce the magnitude of changes in relative dielectric constant of material surrounding pins from pin module 300. Impedance control is also provided by projections 1020A and 1022A and 1020B and 1022B in the reference conductors 1010A and 1010B. These projections impact the separation, in a direction perpendicular to the axis of the signal conductor pair, between portions of the signal conductor pair and the reference conductors 1010A and 1010B. This separation, in combination with other characteristics, such as the width of the signal conductors in those portions, may control the impedance in those portions such that it approximates the nominal impedance of the connector or does not change abruptly in a way that may cause signal reflections. Other parameters of either or both mating modules may be configured for such impedance control.

Figure 11:
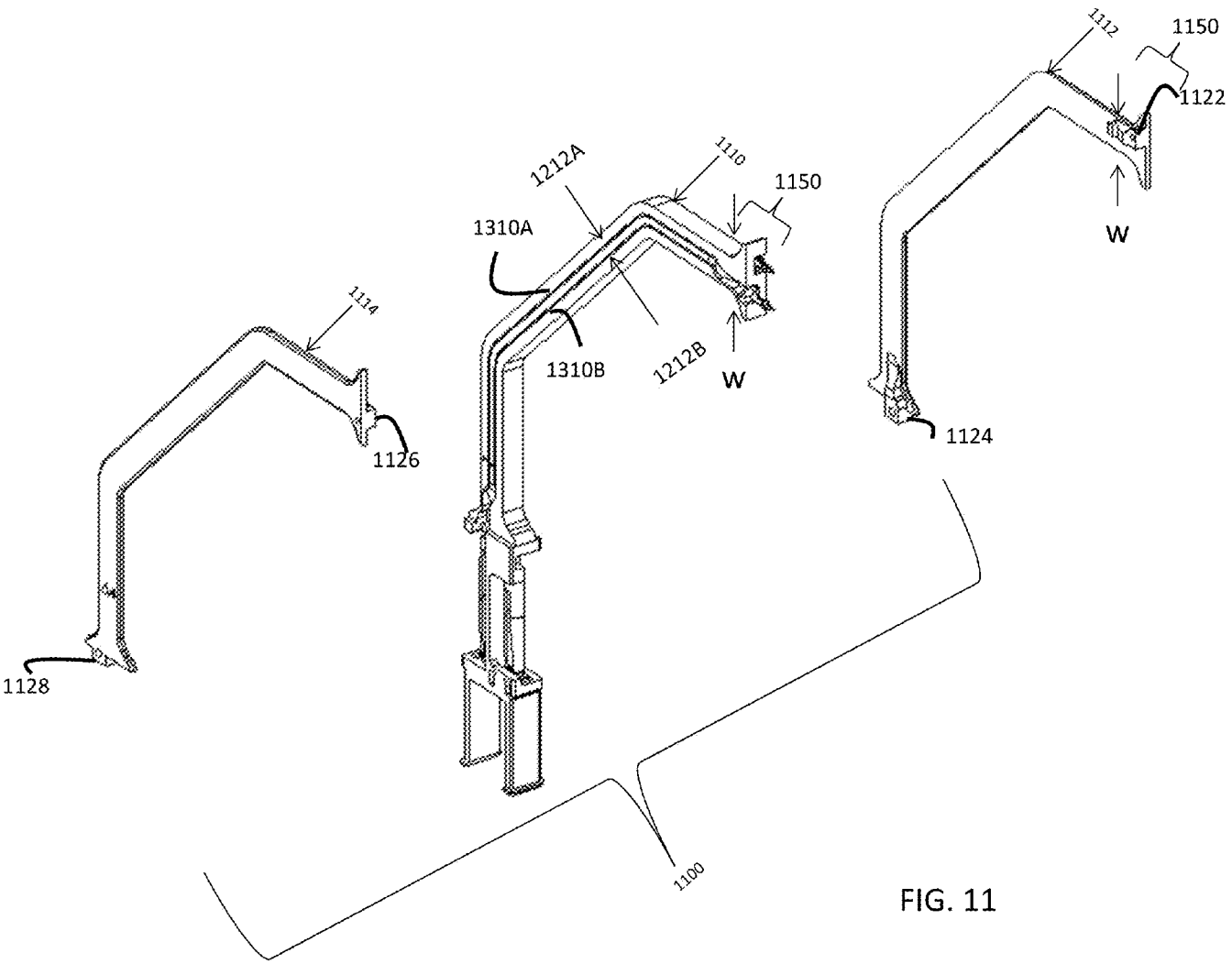
FIG. 11 is an isometric view, partially exploded, of a portion of a wafer module of the wafer assembly of FIG. 7.

Turning to FIG. 11, further details of exemplary components of a module 1000 are illustrated. FIG. 11 is an exploded view of module 1000, without reference conductors 1010A and 1010B shown. Insulative housing portion 1100 is, in the illustrated embodiment, made of multiple components. Central member 1110 may be molded from insulative material. Central member 1110 includes two grooves 1212A and 1212B into which conductive elements 1310A and 1310B, which in the illustrated embodiment form a pair of signal conductors, may be inserted.

Covers 1112 and 1114 may be attached to opposing sides of central member 1110. Covers 1112 and 1114 may aid in holding conductive elements 1310A and 1310B within grooves 1212A and 1212B and with a controlled separation from reference conductors 1010A and 1010B. In the embodiment illustrated, covers 1112 and 1114 may be formed of the same material as central member 1110. However, it is not a requirement that the materials be the same, and in some embodiments, different materials may be used, such as to provide different relative dielectric constants in different regions to provide a desired impedance of the signal conductors.

In the embodiment illustrated, grooves 1212A and 1212B are configured to hold a pair of signal conductors for edge coupling at the contact tails and mating contact portions. Over a substantial portion of the intermediate portions of the signal conductors, the pair is held for broadside coupling. To transition between edge coupling at the ends of the signal conductors to broadside coupling in the intermediate portions, a transition region may be included in the signal conductors. Grooves in central member 1110 may be shaped to provide the transition region in the signal conductors. Projections 1122, 1124, 1126 and 1128 on covers 1112 and 1114 may press the conductive elements against central portion 1110 in these transition regions.

In the embodiment illustrated in FIG. 11, it can be seen that the transition between broadside and edge coupling occurs over a region 1150. At one end of this region, the signal conductors are aligned edge-to-edge in the column direction in a plane parallel to the column direction. Traversing region 1150 in towards the intermediate portion, the signal conductors jog in opposition direction perpendicular to that plane and jog towards each other. As a result, at the end of region 1150, the signal conductors are in separate planes parallel to the column direction. The intermediate portions of the signal conductors are aligned in a direction perpendicular to those planes.

Region 1150 includes the transition region, such as 822 or 842 where the waveguide formed by the reference conductor transitions from its widest dimension to the narrower dimension of the intermediate portion, plus a portion of the narrower intermediate region 830. As a result, at least a portion of the waveguide formed by the reference conductors in this region 1150 has a widest dimension of W, the same as in the intermediate region 830. Having at least a portion of the physical transition in a narrower part of the waveguide reduces undesired coupling of energy into waveguide modes of propagation.

Having full 360 degree shielding of the signal conductors in region 1150 may also reduce coupling of energy into undesired waveguide modes of propagation. Accordingly, openings 832 do not extend into region 1150 in the embodiment illustrated.

Figure 12:
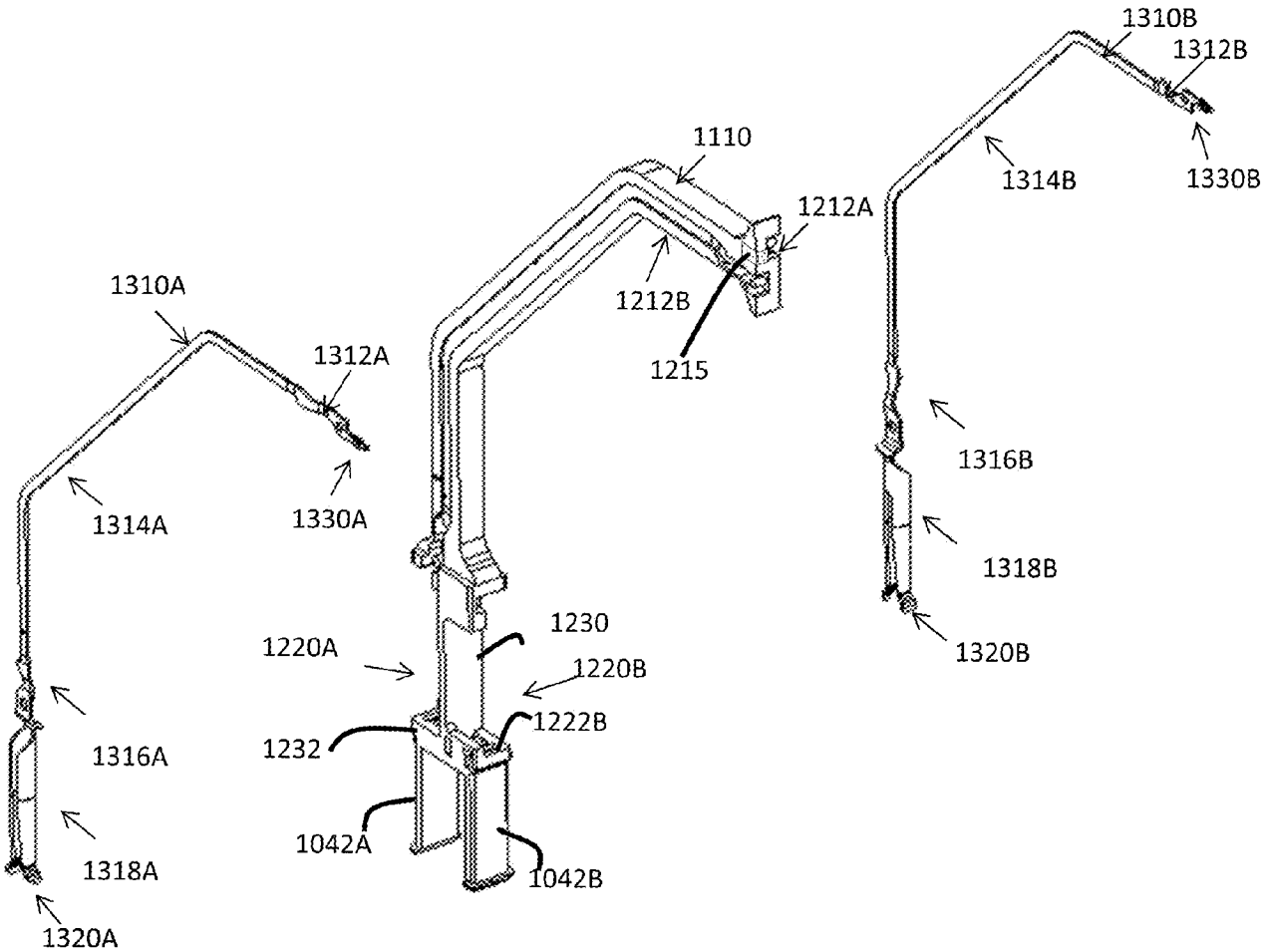
FIG. 12 is an isometric view, partially exploded, of a portion of a wafer module of the wafer assembly of FIG. 7.

FIG. 12 shows further detail of a module 1000. In this view, conductive elements 1310A and 1310B are shown separated from central member 1110. For clarity, covers 1112 and 1114 are not shown. Transition region 1312A between contact tail 1330A and intermediate portion 1314A is visible in this view. Similarly, transition region 1316A between intermediate portion 1314A and mating contact portion 1318A is also visible. Similar transition regions 1312 B and 1316B are visible for conductive element 1310B, allowing for edge coupling at contact tails 1330B and mating contact portions 1318B and broadside coupling at intermediate portion 1314B.

The mating contact portions 1318A and 1318 B may be formed from the same sheet of metal as the conductive elements. However, it should be appreciated that, in some embodiments, conductive elements may be formed by attaching separate mating contact portions to other conductors to form the intermediate portions. For example, in some embodiments, intermediate portions may be cables such that the conductive elements are formed by terminating the cables with mating contact portions.

In the embodiment illustrated, the mating contact portions are tubular. Such a shape may be formed by stamping the conductive element from a sheet of metal and then rolling the mating contact portions into a tubular shape. The circumference of the tube may be large enough to accommodate a pin from a mating pin module, but may conform to the pin. The tube may be split into two or more segments, forming compliant beams. Two such beams are shown in FIG. 12. Bumps or other projections may be formed in distal portions of the beams, creating contact surfaces. Those contact surfaces may be coated with gold or other conductive, ductile material to enhance reliability of an electrical contact.

When conductive elements 1310A and 1310B are mounted in central member 1110, mating contact portions 1318A and 1318B fit within openings 1220A 1220B. The mating contact portions are separated by wall 1230. The distal ends 1320A and 1320B of mating contact portions 1318A and 1318 B may be aligned with openings, such as opening 1222B, in platform 1232. These openings may be positioned to receive pins from the mating pin module 300. Wall 1230, platform 1232 and insulative projecting members 1042A and 1042B may be formed as part of portion 1110, such as in one molding operation. However, any suitable technique may be used to form these members.

FIG. 12 shows a further technique that may be used, instead of or in addition to techniques described above, for reducing energy in undesired modes of propagation within the waveguides formed by the reference conductors in transition regions 1150. Conductive or lossy material may be integrated into each module so as to reduce excitation of undesired modes or to damp undesired modes. FIG. 12, for example, shows lossy region 1215. Lossy region 1215 may be configured to fall along the center line between signal conductors 1310A and 1310B in some or all of region 1150. Because signal conductors 1310A and 1310B jog in different directions through that region to implement the edge to broadside transition, lossy region 1215 may not be bounded by surfaces that are parallel or perpendicular to the walls of the waveguide formed by the reference conductors. Rather, it may be contoured to provide surfaces equidistant from the edges of the signal conductors 1310A and 1310B as they twist through region 1150. Lossy region 1215 may be electrically connected to the reference conductors in some embodiments. However, in other embodiments, the lossy region 1215 may be floating.

Though illustrated as a lossy region 1215, a similarly positioned conductive region may also reduce coupling of energy into undesired waveguide modes that reduce signal integrity. Such a conductive region, with surfaces that twist through region 1150, may be connected to the reference conductors in some embodiments. While not being bound by any particular theory of operation, a conductor, acting as a wall separating the signal conductors and as such twists to follow the twists of the signal conductors in the transition region, may couple ground current to the waveguide in such a way as to reduce undesired modes. For example, the current may be coupled to flow in a differential mode through the walls of the reference conductors parallel to the broadside coupled signal conductors, rather than excite common modes.

Figure 13:
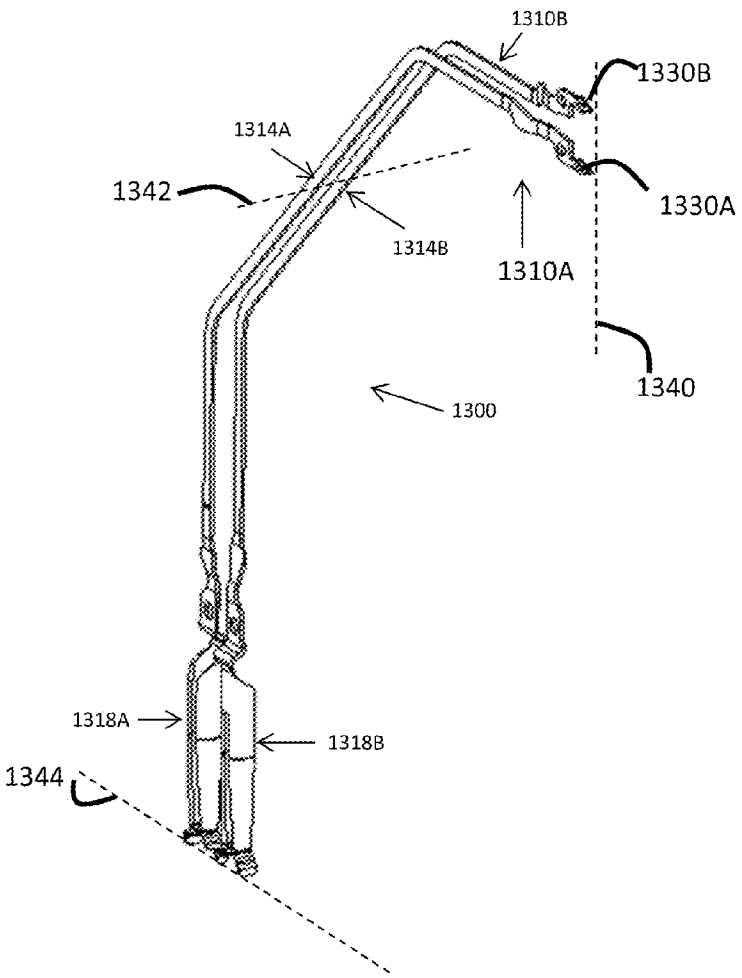
FIG. 13 is an isometric view of a pair of conducting elements of a wafer module of the wafer assembly of FIG. 7.

FIG. 13 shows in greater detail the positioning of conductive members 1310A and 1310B, forming a pair 1300 of signal conductors. In the embodiment illustrated, conductive members 1310A and 1310B each have edges and broader sides between those edges. Contact tails 1330A and 1330B are aligned in a column 1340. With this alignment, edges of conductive elements 1310A and 1310B face each other at the contact tails 1330A and 1330B. Other modules in the same wafer will similarly have contact tails aligned along column 1340. Contact tails from adjacent wafers will be aligned in parallel columns. The space between the parallel columns creates routing channels on the printed circuit board to which the connector is attached. Mating contact portions 1318A and 1318B are aligned along column 1344. Though the mating contact portions are tubular, the portions of conductive elements 1310A and 1310B to which mating contact portions 1318A and 1318B are attached are edge coupled. Accordingly, mating contact portions 1318A and 1318B may similarly be said to be edge coupled.

In contrast, intermediate portions 1314A and 1314B are aligned with their broader sides facing each other. The intermediate portions are aligned in the direction of row 1342. In the example of FIG. 13, conductive elements for a right angle connector are illustrated, as reflected by the right angle between column 1340, representing points of attachment to a daughtercard, and column 1344, representing locations for mating pins attached to a backplane connector.

In a conventional right angle connector in which edge coupled pairs are used within a wafer, within each pair the conductive element in the outer row at the daughtercard is longer. In FIG. 13, conductive element 1310B is attached at the outer row at the daughtercard. However, because the intermediate portions are broadside coupled, intermediate portions 1314A and 1314B are parallel throughout the portions of the connector that traverse a right angle, such that neither conductive element is in an outer row. Thus, no skew is introduced as a result of different electrical path lengths.

Moreover, in FIG. 13, a further technique for avoiding skew is introduced. While the contact tail 1330B for conductive element 1310B is in the outer row along column 1340, the mating contact portion of conductive element 1310B (mating contact portion 1318 B) is at the shorter, inner row along column 1344. Conversely, contact tail 1330A conductive element 1310A is at the inner row along column 1340 but mating contact portion 1318A of conductive element 1310A is in the outer row along column 1344. As a result, longer path lengths for signals traveling near contact tails 1330B relative to 1330A may be offset by shorter path lengths for signals traveling near mating contact portions 1318B relative to mating contact portion 1318A. Thus, the technique illustrated may further reduce skew.

Figure 14B:
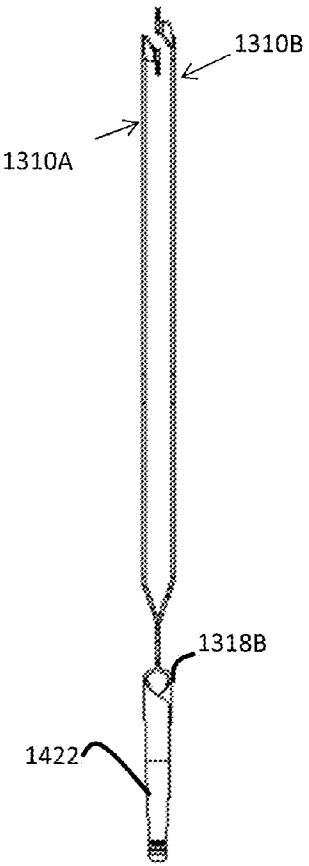
FIG. 14B is an end view of the pair of conducting elements of FIG. 13 taken along the line B-B of FIG. 14 A.
Figure 14A:
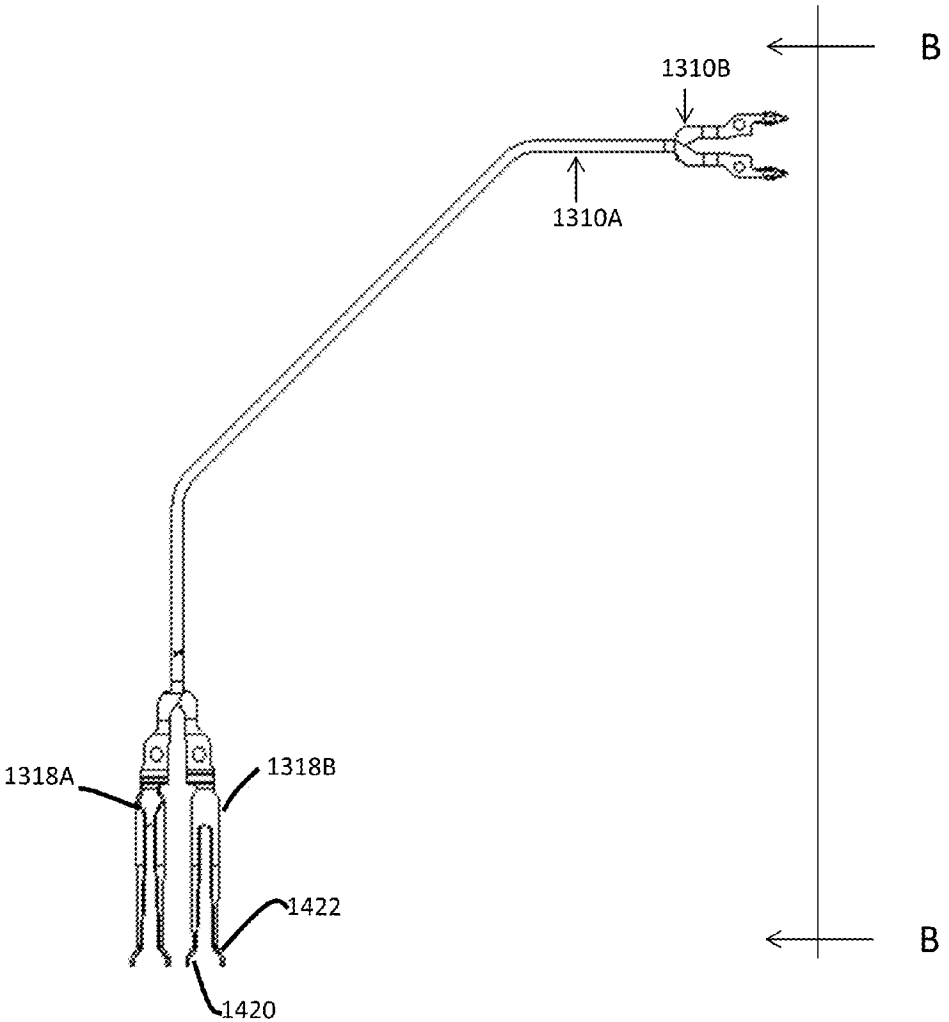
FIG. 14A is a side view of the pair of conducting elements of FIG. 13.

FIGS. 14A and 14B illustrate the edge and broadside coupling within the same pair of signal conductors. FIG. 14A is a side view, looking in the direction of row 1342. FIG. 14B is an end view, looking in the direction of column 1344. FIGS. 14A and 14B illustrate the transition between edge coupled mating contact portions and contact tails and broadside coupled intermediate portions.

Additional details of mating contact portions such as 1318A and 1318B are also visible. The tubular portion of mating contact portion 1318A is visible in the view shown in FIG. 14A and of mating contact portion 1318B in the view shown in FIG. 14B. Beams, of which beams 1420 and 1422 of mating contact portion 1318B are numbered, are also visible.

The inventors have recognized and appreciated that the member 630 in FIG. 6 is suitable for many applications, but when used over large areas is susceptible to small gaps opening between portions of conductive shielding. For example, small gaps may open in different locations between a conductive portion on member 630 and a surface ground pad on a PCB and/or between a conductive portion on member 630 and reference conductors 1010 on the wafer modules 810. Small gaps can undesirably impact signal integrity and introduce signal crosstalk, particularly when used in a very high-density interconnection system that carries very high-frequency signals. The small gaps can allow energy from the differential mode supported by the differential conductors to leak out of the waveguide formed by the reference conductor and contribute to signal loss. The small gaps may also contribute to unwanted mode conversion at the connector interface with the PCB. A compliant shield that can mitigate signal loss and mode conversion is described in connection with FIG. 15 through FIG. 17B and FIGS. 22A-B.

Figure 15:
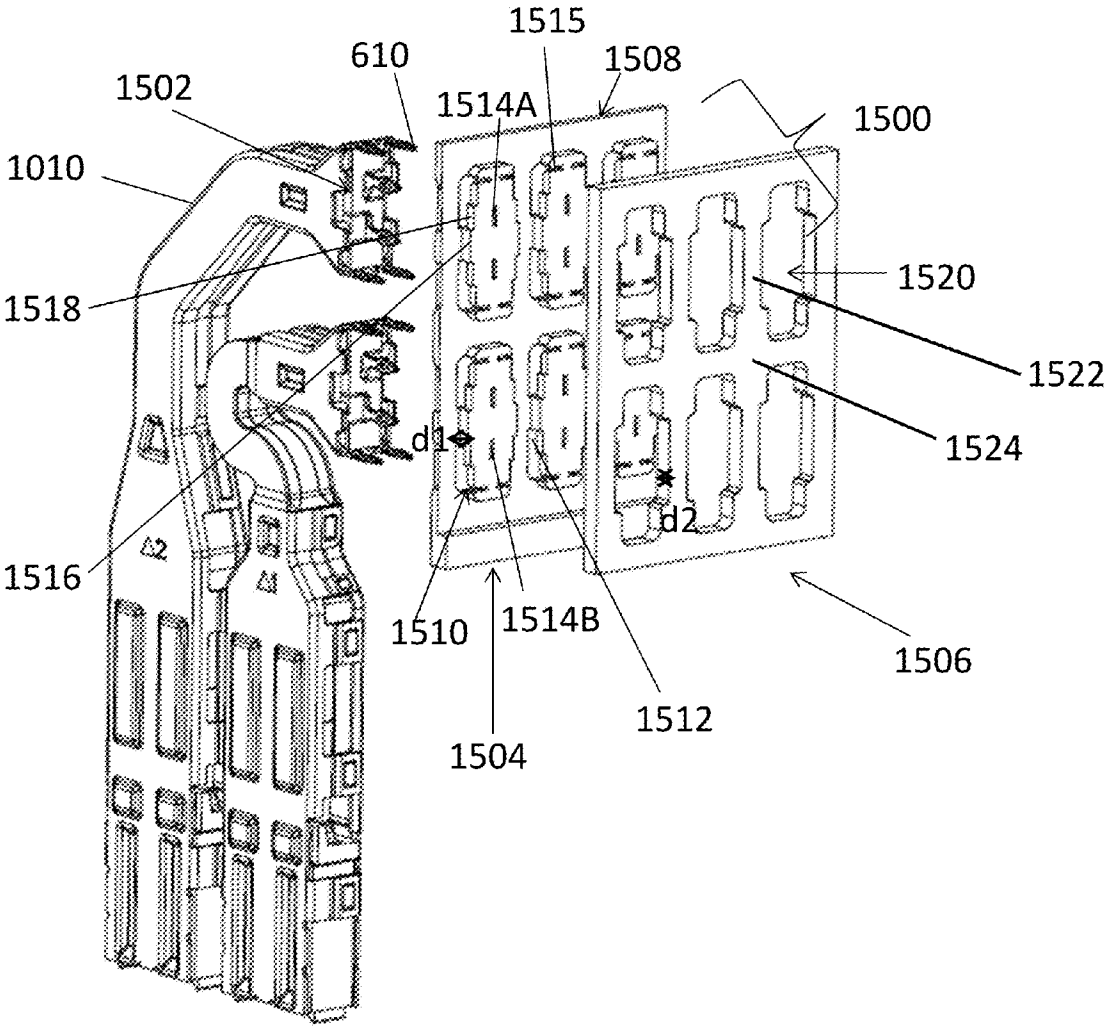
FIG. 15 is an isometric view of two wafer modules and a partially exploded view of a compliant shield of a connector, according to some embodiments.

FIG. 15 illustrates an embodiment of a two piece compliant shield 1500 that may be used with a plurality of wafer modules. To simplify the drawings, the compliant shield is shown for use with six differential pairs of conductors, though the invention is not limited to only six. A compliant shield may be used with, for example, 12, 16, 32, 64, 128 differential pairs of conductors or any other suitable number of differential pairs of conductors.

According to some embodiments, a compliant shield 1500 may include an insulative portion 1504 and a compliant conductive member 1506. The insulative portion may be formed from a hard or firm polymer, and the compliant conductive member may be formed from a conductive elastomer. The insulative portion 1504 may be configured to receive contact tails from the wafer modules 1310. The compliant conductive member may be configured to abut the insulative portion, and to provide electrical connectivity between the reference conductors 1010 on the wafer modules 1310 and a reference pad (not shown) on a PCB. In some cases, an insulative portion 1504 may not be used, and the compliant conductive member 1506 may abut the ends of the wafer modules.

Figure 16:
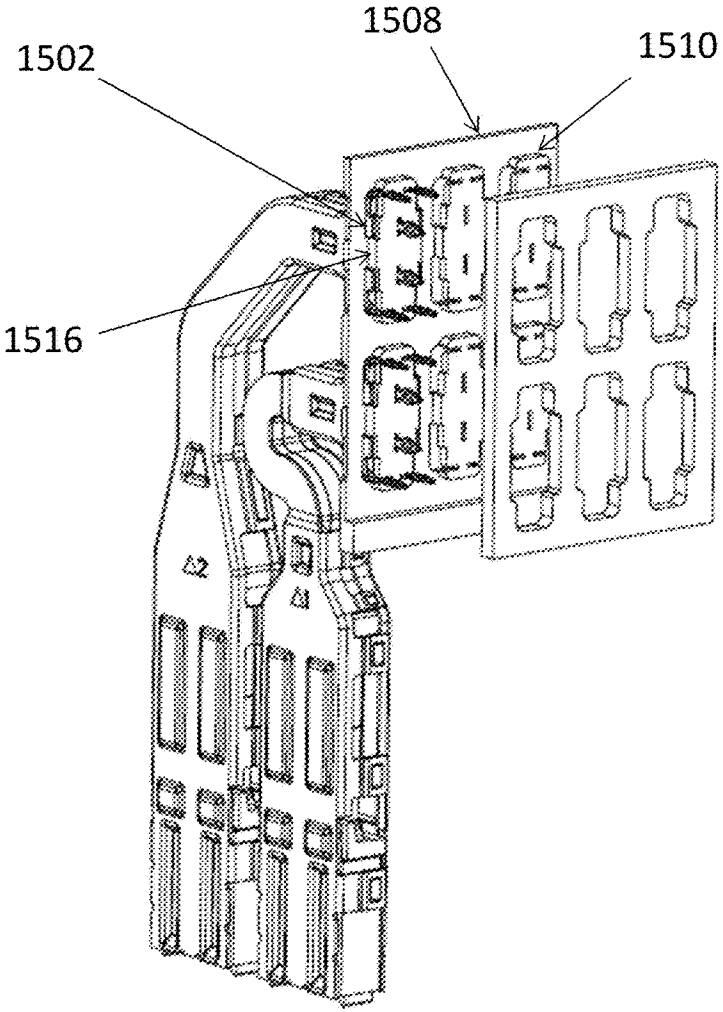
FIG. 16 is an isometric view showing an insulative portion of the compliant shield of FIG. 15 attached to two wafer modules and showing a compliant conductive member.

The insulative portion 1504 may be a molded or cast component, and may be planar in some embodiments. In some implementations, the insulative portion may include surface structure as depicted in FIG. 15, and have a first level 1508, which may be generally planar. In some cases, the first level may have openings 1512 that receive ends of the wafer modules 130, as depicted in FIG. 16. The openings 1512 may be sized and shaped to receive tabs 1502 that extend from the wafer modules and connect to reference conductors 1010 of the wafer modules. As shown, tabs 1502 extend above the reference conductor 1010. Tabs may be electrically connected to surface pads 1910 on printed circuit boards through compliant shield 1500. In some embodiments, tabs may be adjacent to contact tails of signal conductors also extending from the connector. In the illustrated embodiment, two tabs are aligned parallel to column 1340 at one edge of the contact tail region 820 and two tabs are at the opposing edge of the contact tail region 820. One or more tabs may be formed and arranged in any suitable way.

The insulative portion may include a plurality of raised islands 1510 extending from the first level by a distance d1. The islands may have walls 1516 extending from the first level 1508 and supporting the islands above the first level. There may be channels or notches 1518 formed on the edges of the islands 1510 that are sized and shaped to receive the tabs 1502 from the wafer modules. The island edges at the notches 1518 may provide a backing for the ends of the tabs 1502, so that lateral force can be applied against the tabs. When the insulative portion is installed over the ends of the wafer modules, the ends of the tabs 1502 may be below or approximately flush with a surface of the islands that is toward a PCB (not shown) to which the connector connects.

The insulative portion 1504 may include contact slots 1514A, 1514B and 1515 that are formed in and extend through the islands. The contact slots may be sized and positioned to receive the contact tails 610 and to allow the contact tails to pass therethrough. In some embodiments, a plurality of contact slots may have two closed ends. In some embodiments, a plurality of contact slots may have one closed end and one open end. For example, each island 1510 has four contact slots with one open end that accommodate four contact tails from a wafer module. In some embodiments, contact slots may have an aspect ratio between 1.5:1 and 4:1. The contact slots 1514A, 1514B may be arranged in a repeating pattern of subpatterns. For example, each island 1510 may have a copy of the subpattern.

In some embodiments, at least the islands 1510 of the insulative portion 1504 may be formed of a material that has a dielectric constant that establishes a desired impedance for the signal conductors in the mounting interface of the connector. In some embodiments, the relative dielectric constant may be in the range of 3.0 to 4.5. In some embodiments, the relative dielectric constant may be higher, such as in the range of 3.4 to 4.5. In some embodiments, the relative dielectric constant of the island may be in one of the following ranges: 3.5 to 4.5, 3.6 to 4.5, 3.7 to 4.5, 3.8 to 4.5, 3.9 to 4.5, or 4.0 to 4.5. Such relative dielectric constants may be achieved by selection of a binder material in combination with a filler. Known materials may be selected to provide a relative dielectric constant of up to 4.5, for example. Relative dielectric constants in these ranges may lead to a higher dielectric constant for the islands than for the insulative housing of the connector. The islands may have a relative dielectric constant that is, in some embodiments, at least 0.1, 0.2, 0.3, 0.4, 0.5 or 0.6 higher than the connector housing. In some embodiments the difference in relative dielectric constant will be in the range of 0.1 to 0.3, or 0.2 to 0.5, or 0.3 to 1.0.

Figure 17B:
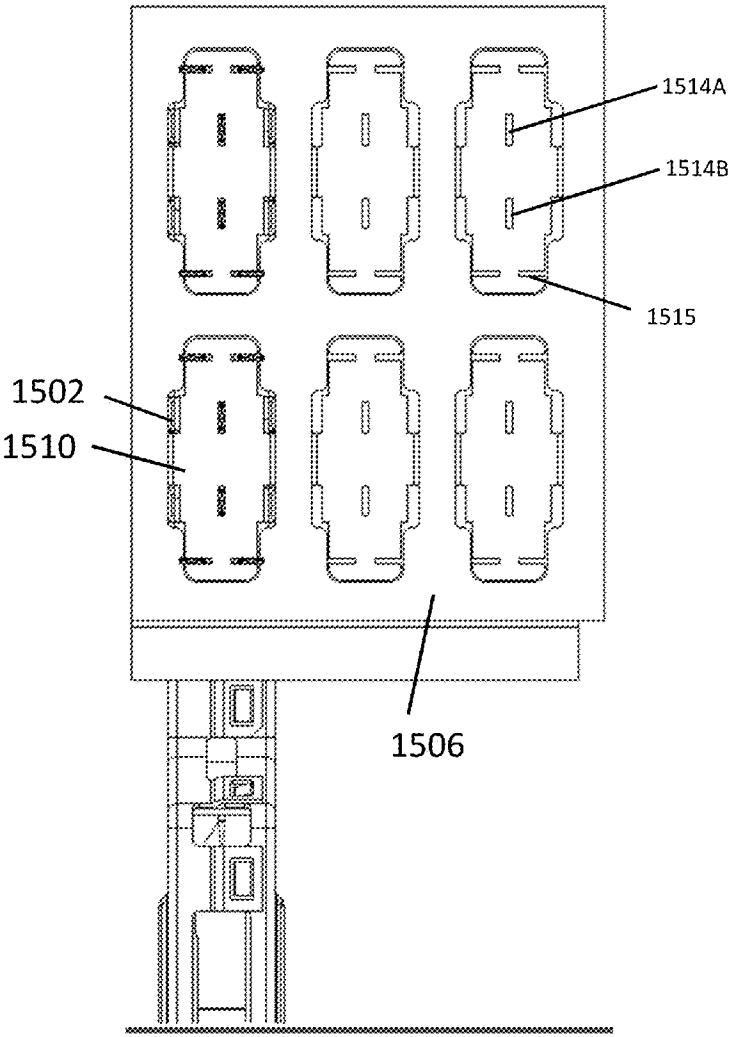
FIG. 17B is a plan view of a board-facing surface of the compliant shield.
Figure 17A:
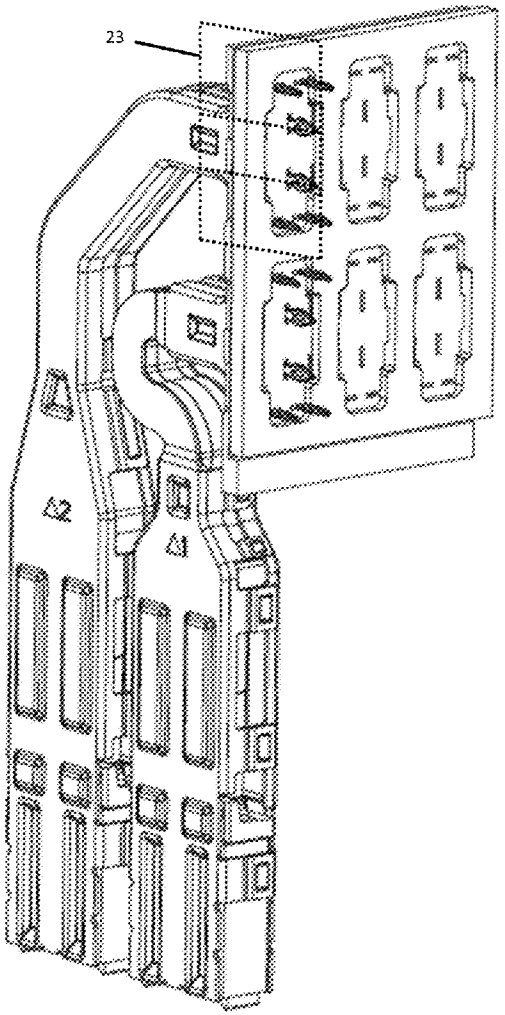
FIG. 17A is an isometric view showing a compliant conductive member mounted adjacent to the insulative portion of the compliant shield of FIG. 16.

The compliant conductive member 1506 may include a plurality of openings 1520 sized and shaped to receive the islands 1510 when mounted to the insulative portion 1504, as illustrated in FIG. 17A and FIG. 17B. In some embodiments, the openings 1520 are sized and shaped so that interior walls of the compliant conductive member 1506 contact reference tabs 1502 and reference contact tails extending through the islands 1510 when installed over the insulative portion 1504.

In an uncompressed state, the compliant conductive member 1506 has a thickness d2. In some embodiments, the thickness d2 may be about 20 mil, or in other embodiments between 10 and 30 mils. In some embodiments, d2 may be greater than d1. Because the thickness d2 of the compliant conductive member is greater than the height d1 of the islands 1510, when the connector is pressed onto a PCB engaging the contact tails, the compliant conductive member is compressed by a normal force (a force normal to the plane of the PCB). As used herein, "compression" means that the material is reduced in size in one or more directions in response to application of a force. In some embodiments, the compression may be in the range of 3% to 40%, or any value or subrange within the range, including for example, between 5% and 30% or between 5% and 20% or between 10% and 30%, for example. Compression may result in a change in height of the compliant conductive member in a direction normal to the surface of a printed circuit board (e.g., d2). A reduction in size may result from a decrease in volume of the compliant member, such as when the compliant member is made from an open-cell foam material from which air is expelled from the cells when a force is applied to the material. Alternatively or additionally, the change in height in one dimension may result from displacement of the material. In some embodiments, the material forming the compliant conductive member, when pressed in a direction normal to the surface of a printed circuit board, may expand laterally, parallel to the surface of the board.

The compliant conductive member may have different feature sizes at different areas as a result of the positions of the openings 1520. In some embodiments, the thickness d2 may not be uniform across the whole member but rather may depend on the feature sizes of the member. For example, area 1524 may have bigger dimensions and/or larger area than area 1522. As a result, when the connector is pressed onto a PCB, the normal force may cause less compression at area 1524 than area 1522. In order to achieve similar amount of lateral expansion and thus consistent contact with the reference tabs and reference contact tails, d2 around area 1524 may be thicker than d2 around area 1522.

The compression of the compliant conductive member can accommodate a non-flat reference pad on the PCB surface and cause lateral forces within the compliant conductive member that laterally expand the compliant conductive member to press against the reference tabs 1502 and reference contact tails. In this manner, gaps between the compliant conductive member and reference tabs and reference contact tails and between the compliant conductive member and reference pad on the PCB can be avoided.

A suitable compliant conductive member 1506 may have a volume resistivity between 0.001 and 0.020 Ohm-cm. Such a material may have a hardness on the Shore A scale in the range of 35 to 90. Such a material may be a conductive elastomer, such as a silicone elastomer filled with conductive particles such as particles of silver, gold, copper, nickel, aluminum, nickel coated graphite, or combinations or alloys thereof. Non-conductive fillers, such as glass fibers, may also be present. Alternatively or additionally, the conductive complaint material may be partially conductive or exhibit resistive loss such that it would be considered a lossy material as described above. Such a result may be achieved by filling all or portions of an elastomer or other binder with different types or different amounts of conductive particles so as to provide a volume resistivity associated with the materials described above as "lossy." In some embodiments, the conductive compliant member may have an adhesive backing such that it may stick to the insulative portion 1504. In some embodiments a compliant conductive member 1506 may be die cut from a sheet of conductive elastomer having a suitable thickness, electrical, and other mechanical properties. In some implementations, a compliant conductive member may be cast in a mold. In some embodiments, the compliant conductive member 1506 of the compliant shield 1500 may be formed from a conductive elastomer and comprise a single layer of material.

FIG. 16 shows an insulative portion 1504 attached to two wafer modules 1310 of a connector, according to some embodiments. Contact tails 610 from the wafer modules pass through contact slots 1514A and 1514B and are electrically isolated from each other by dielectric material of islands 1510 within the insulative portion. Tabs 1502 pass through openings 1512 and abut notches 1518 in walls 1516 on the islands. The tabs are electrically isolated from the differential pair of contact tails by dielectric material of the insulative portion.

FIG. 17A and FIG. 17B show the conductive compliant member 1506 mounted around the islands 1510, according to some embodiments. Tabs 1502 may electrically connect to surface pads on a printed circuit board through the conductive compliant member, when the connector is pressed onto a PCB. As described above, the compliant conductive member may be compressed in a direction perpendicular to the surface of a PCB when the connector is pressed onto the PCB, and expand laterally towards the island walls 1516, pressing against the tabs 1502 and reference contact tails. The view in 17B shows a board-facing surface of the compliant shield 1500, and shows four reference contact tails and differential contact tails extending through contact slots 1514A and 1514B for two wafer modules. The regions between islands 1510 are filled with conductive compliant material.

In the embodiment illustrated, each subpattern includes a pair of contact slots 1514A, 1514B aligned with longer dimensions disposed in a line and at least two additional contact slots 1515. The longer dimensions of contact slots 1515 disposed in parallel lines that are perpendicular to the line of the pair of contact slots 1514A, 1514B. In some embodiments, the contact tails 610 of each module are arranged in a pattern with the contact tails of the signal conductors in the center and contact tails of the shield at the periphery. In some embodiments, contact slots 1514A, 1514B are positioned to receive contact tails 610 that carry signal conductors and contact slots 1515 are positioned to receive contact tails that carry reference conductors.

Figure 18:
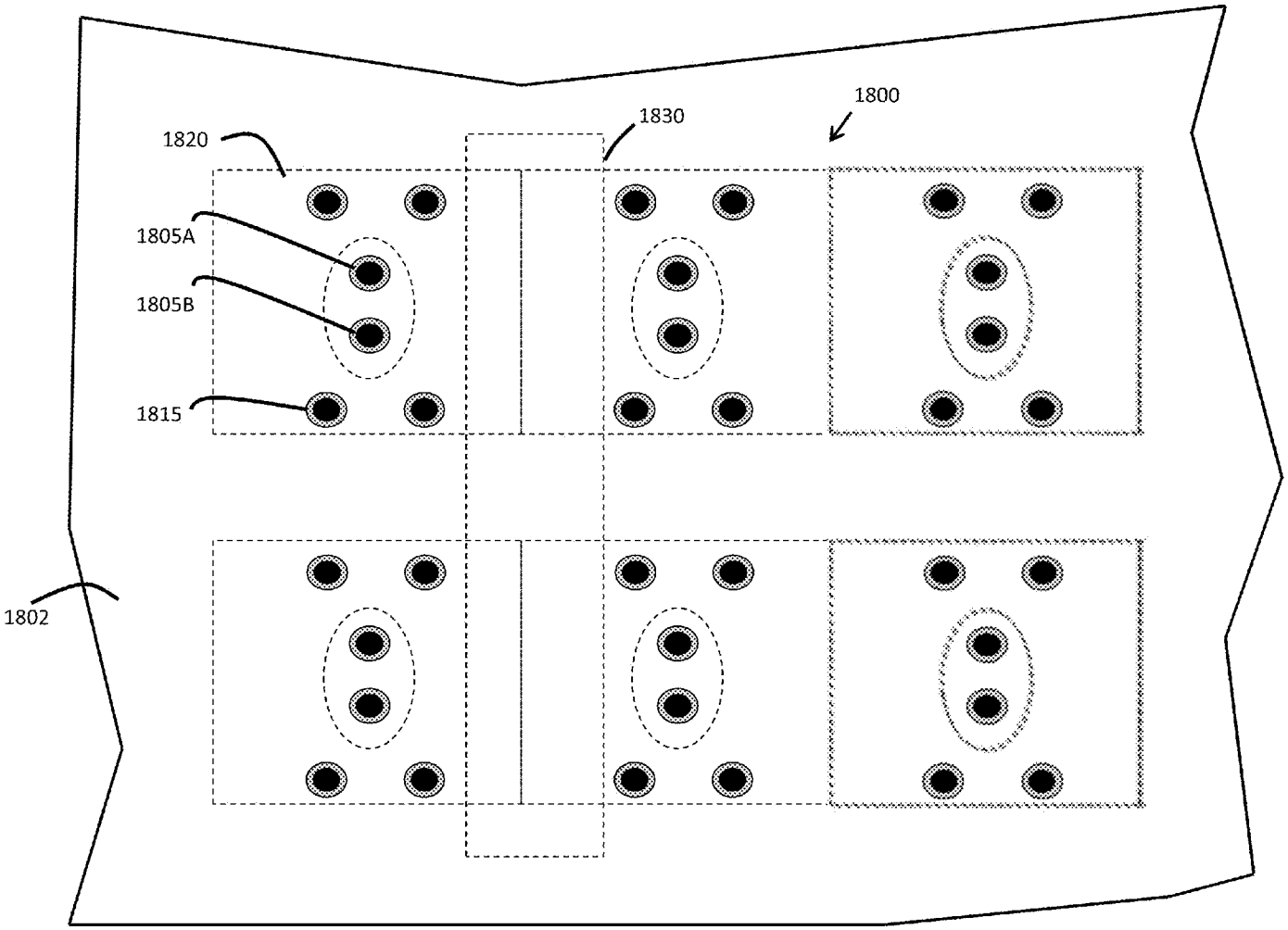
FIG. 18 depicts a connector footprint in a printed circuit board with wide routing channels, according to some embodiments.

FIG. 18 illustrates a connector footprint 1800 on a printed circuit board 1802 to which a connector as described herein might be mounted, according to some embodiments. FIG. 18 illustrates a pattern of vias 1805, 1815 in the printed circuit board to which contact tails of a connector 600, as described above, may be mounted. The pattern of vias shown in FIG. 18 may correspond to the pattern of contact tails for wafer modules 1310 as illustrated, for example, in FIG. 15. A module footprint 1820 for one wafer module may include a pattern of vias that is repeated across a surface of a PCB 1802 to form a connector footprint. As was the case for the connector illustrated in FIG. 15, there may be more than six module footprints for larger connectors.

Module footprint 1820 may include a pair of signal vias 1805A and 1805B positioned to receive contact tails from a differential pair of signal conductors. One or more reference or ground vias 1815 may be arranged around the pair of signal vias. For the illustrated embodiment, pairs of reference vias are located at opposing ends of the pair of signal vias. The illustrated pattern arranges the reference vias in columns, aligned with the column direction of the connector, with routing channel regions 1830 between columns. This configuration provides relatively wide routing channel regions within a printed circuit board that are easily accessed by the differential signal pairs, so that a high-density interconnectivity may be achieved with desirable high-frequency performance.

Figure 19:
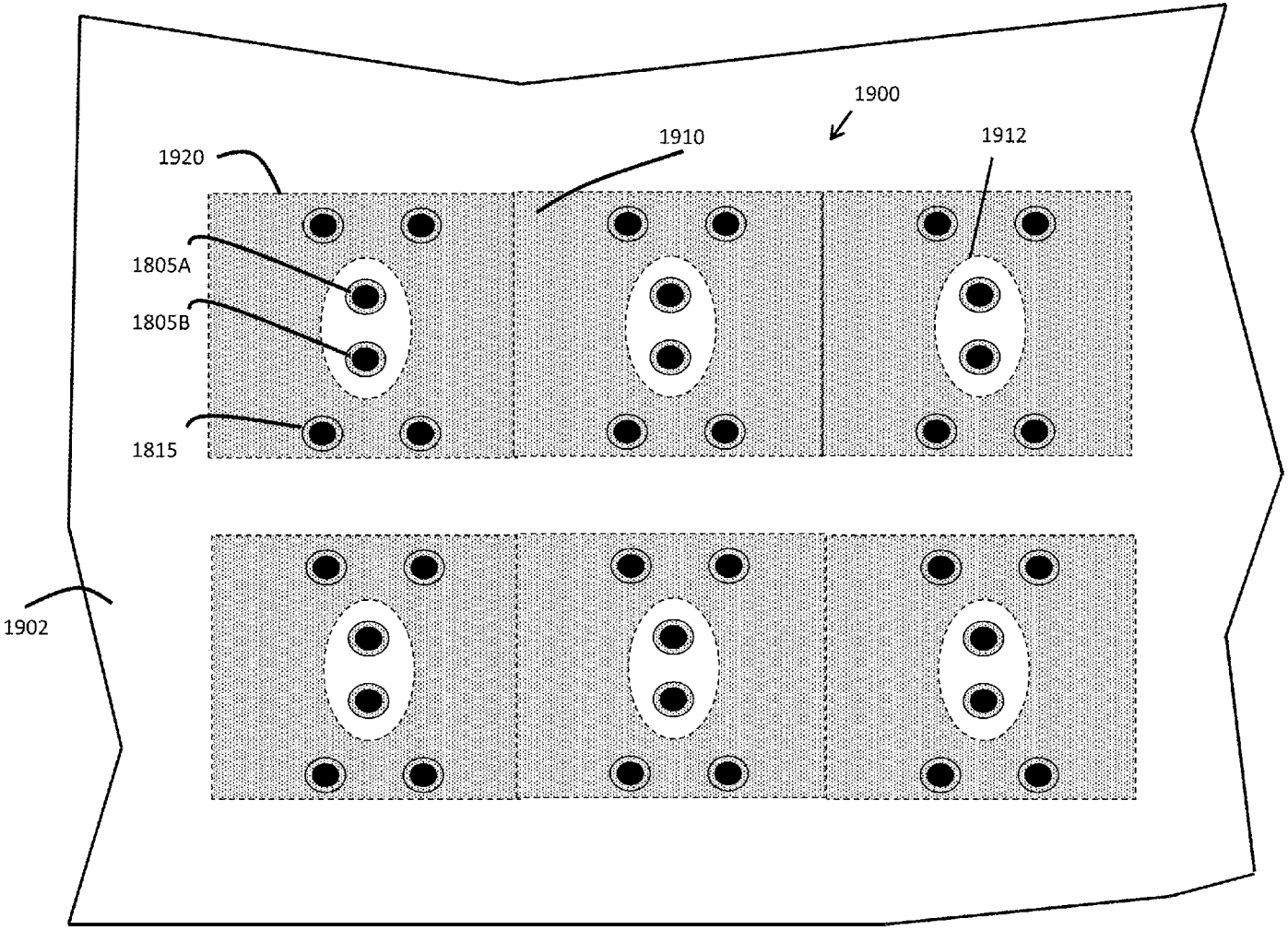
FIG. 19 depicts a connector footprint in a printed circuit board with a surface ground pad, according to some embodiments.

FIG. 19 illustrates a connector footprint 1900 on a printed circuit board 1902 configured for use with a compliant shield 1500, according to some embodiments. The embodiment of FIG. 19 differs from the embodiment of FIG. 18 in that each module footprint 1920 includes a conductive surface pad 1910. According to some embodiments, the surface pads 1910 may electrically connect to the reference vias 1815 (e.g., at the vias' peripheries), and thereby connect to one or more internal reference layers (e.g., ground planes) of the printed circuit board. Holes 1912 may be formed in the surface pads, such that vias that receive contact tails from differential signal conductors are electrically isolated from the surface pads. In the embodiment illustrated, holes are in the shape of an oval. However, it is not a requirement that the holes are oval-shaped, and in some embodiments, different shapes may be used, such as rectangular, circular, hexagonal, or any other suitable opening shape. In some implementations, the surface pads 1910 may be formed from a single continuous layer of conductive material (e.g., copper or a copper alloy).

The inventors have recognized and appreciated that in embodiments in which a printed circuit board includes a conductive surface layer, such as surface pads 1910, that is contacted by a conductive structure connecting ground structures within a connector or other component to grounds within the printed circuit board, shadow vias may be positioned to shape the current flow through the conductive surface layer. Conductive shadow vias may be placed near contact points on the conductive surface layer of members that connect to the ground structure of the connector. This positioning of shadow vias limits the lengths of a primary conductive path from that contact point to a via that couples that current flow into the inner ground layers of the printed circuit board. Limiting current flow in the ground conductors in a direction parallel to the surface of the board, which is perpendicular to the direction of signal current flow, may improve signal integrity.

Figure 20:
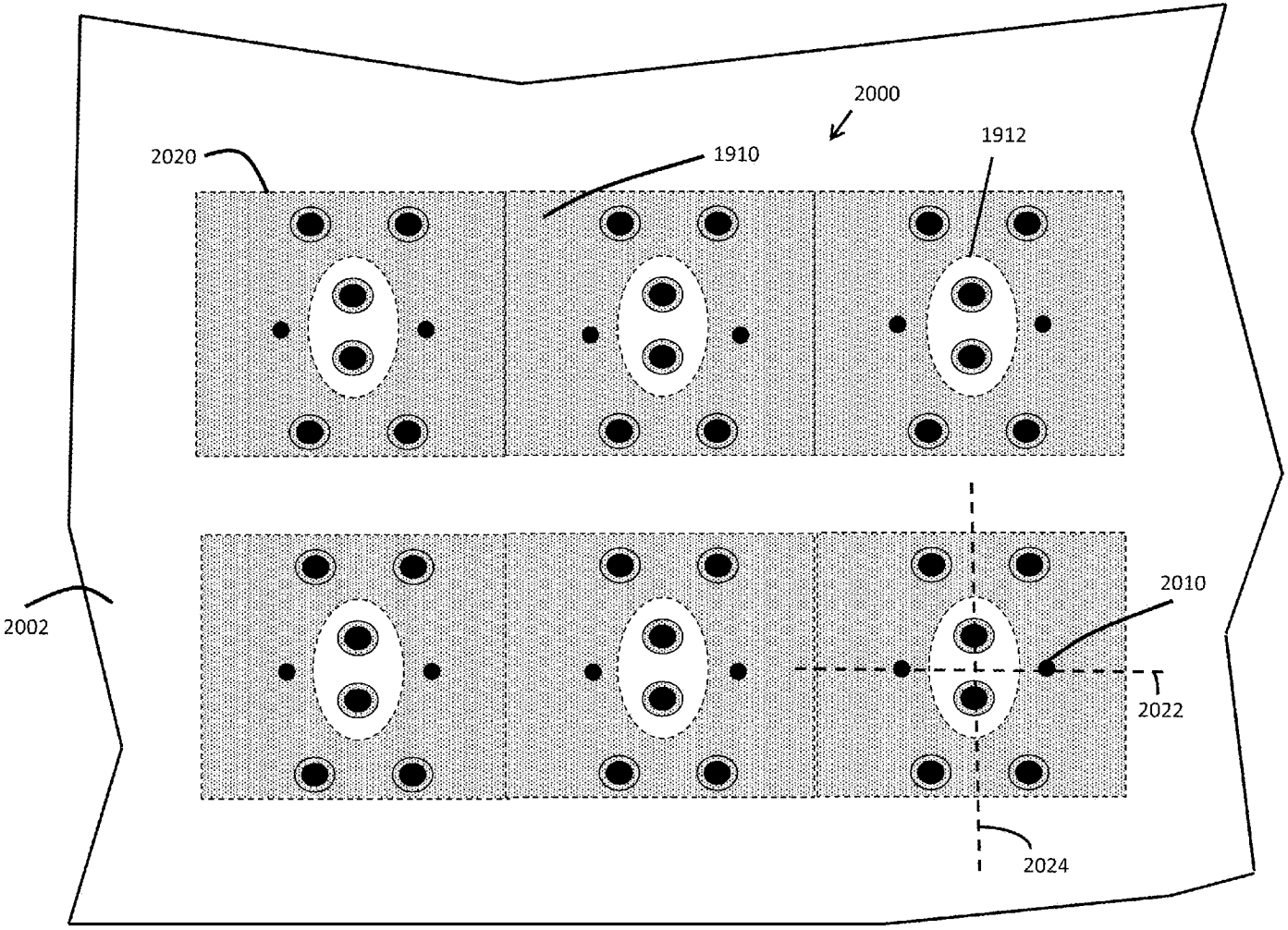
FIG. 20 depicts a connector footprint in a printed circuit board with a surface ground pad and shadow vias, according to some embodiments.

FIG. 20 illustrates a connector footprint 2000 on a printed circuit board 2002 configured for use with a compliant shield, according to a further embodiment. The embodiment of FIG. 20 differs from the embodiment of FIG. 19 in that a pair of shadow vias 2010 are incorporated into the module footprint 2020 adjacent to vias for differential signal conductors 1805A, 1805B. The shadow vias 2010 may be electrically connected to the surface pads 1910. The shadow vias may also electrically connect to one or more internal reference layers (e.g., ground planes) of the printed circuit board such that surface pads are also electrically connected to the ground plane through the shadow vias. When a connector is installed, the conductive compliant material 1506 may press against the reference tabs 1502 and the surface pads 1910 above the shadow vias 2010, and thereby create an essentially direct electrically conductive path from the reference tabs, through the compliant shield, to the surface pads, shadow vias, and to the one or more reference layers of the printed circuit board.

The shadow vias 2010 may be located adjacent to signal vias 1805A, 1805B. In the illustrated example, a pair of shadow vias 2010 are located on a first line 2022 that is perpendicular to a second line 2024 that passes through signal vias 1805A, 1805B in a direction of the column 1340. The first line 2022 may be located midway between signal vias 1805A and 1805B, such that the pair of shadow vias are equally spaced from signal vias 1805A and 1805B. In some embodiments in which more shadow vias are included in each module footprint 2020, shadow vias may be aligned with signal vias in a direction perpendicular to first line 2022.

Shadow vias 2022 may at least partially overlap the edges of holes 1912. In further embodiments, each module footprint 2020 may include more than one pair of shadow vias. Furthermore, the shadow vias may be implemented as one or more circular shadow vias or one or more slot-shaped shadow vias.

According to some embodiments, the shadow vias 2010 may be smaller than vias used to receive contact tails of the connector (e.g., smaller than signal vias 1805A, 1805B, and/or reference vias 1815). In embodiments where the shadow vias do not receive contact tails, they may be filled with conductive material during the manufacture of the printed circuit board. As a result, their unplated diameter may be smaller than the unplated diameter of the vias that receive contact tails. The diameters may be, for example, in the range of 8 to 12 mils, or at least 3 mils less than the unplated diameter of the signal or reference vias.

In some embodiments, the shadow vias may be positioned such that the length of a conducting path through the surface layer to the nearest shadow via coupling the conductive surface layer to an inner ground layer may be less than the thickness of the printed circuit board. In some embodiments, the conducting path through the surface layer may be less than 50%, 40%, 30%, 20% or 10% of the thickness of the board.

In some embodiments, shadow vias may be positioned so as to provide a conducting path through the surface layer that is less than the average length of the conducting paths for signals between the connector, or other component mounted to the board, and inner layers of the board where the signal vias are connected to the conductive traces. In some embodiments, the shadow vias may be positioned such that the conducting path through the surface layer may be less than 50%, 40%, 30%, 20% or 10% of the average length of the signal paths.

In some embodiments, shadow vias may be positioned so as to provide a conducting path through the surface layer that is less than 5 mm. In some embodiments, the shadow vias may be positioned such that conducting path through the surface layer may be less than 4 mm, 3 mm, 2 mm or 1 mm.

Figure 21A:
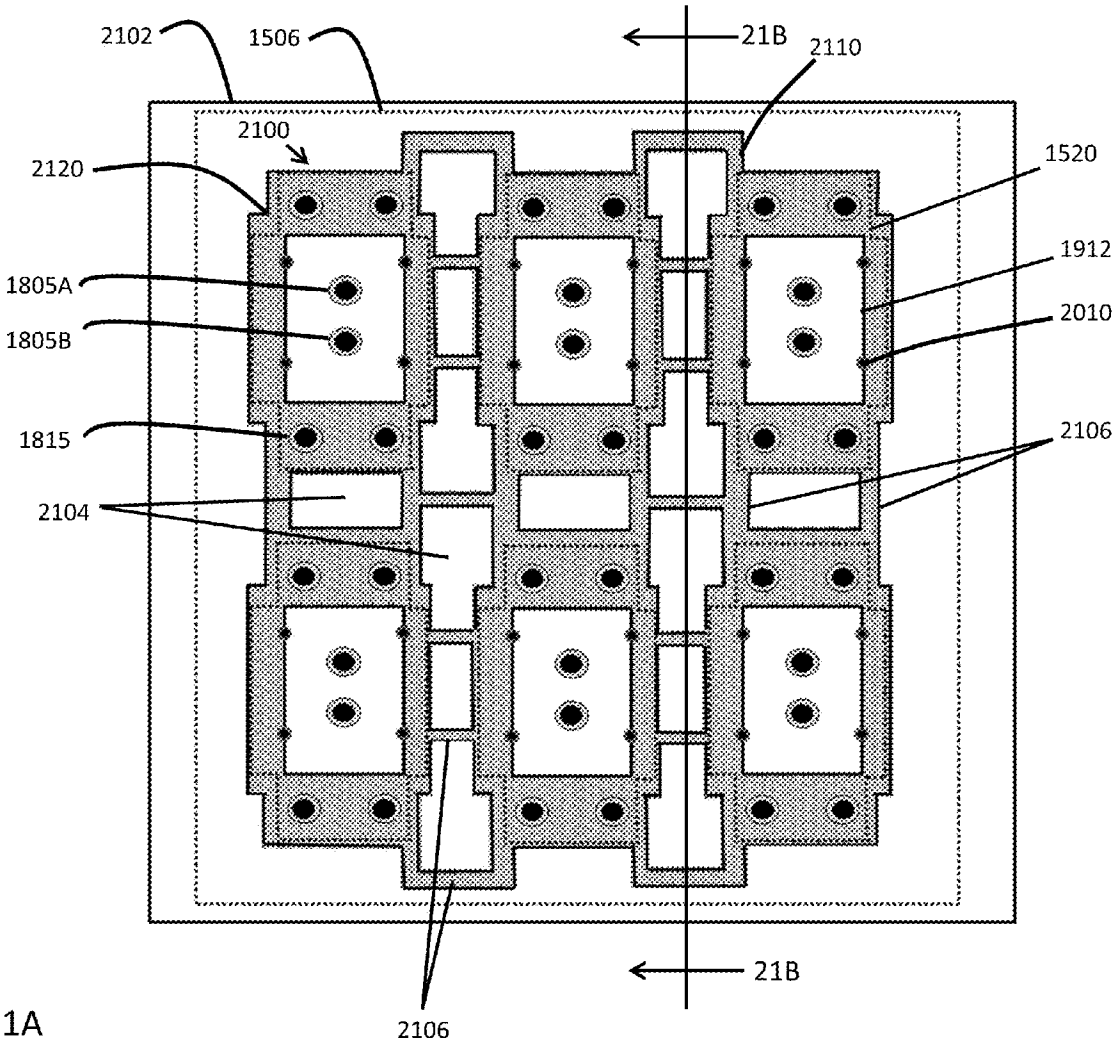
FIG. 21A depicts a connector footprint in a printed circuit board with a surface ground pattern, according to some embodiments. The dashed lines illustrate the location of the compliant conductive member.

FIG. 21A illustrates a plan view of a connector footprint 2100 on a printed circuit board 2102, according to some implementations. For the illustrated embodiment, an outline of a compliant conductive member 1506 is shown by dashed lines. In the embodiment illustrated, a conductive surface pad 2110 is patterned to have additional structure around each module footprint 2120. For example, there may be a plurality of repeated module subpatterns that are linked by bridges 2106. Between the bridges may be voids 2104 into which the compliant conductive member may deform. The bridges may be arranged to create short conduction paths between the compliant conductive member and reference vias and shadow vias that connect to inner reference or ground planes of the printed circuit board. For example, bridges 2106 may be patterned to conductively link adjacent reference vias and adjacent shadow vias. By having raised bridges in close proximity to the reference and shadow vias and allowing the compliant conductive member to deform into the voids 2104, the electrical connectivity between the compliant conductive member and the reference and shadow vias can be improved in the immediate vicinity of the vias. In some embodiments, the thickness d3 of surface pad may be between 1 mil and 4 mils. In some embodiments, the thickness of surface pad may be between 1.5 mils and 3.5 mils.

Each subpattern 2120 may align with a corresponding opening 1520 in the compliant conductive member 1506. In some embodiments, the reference vias 1815 for a module may be within an opening 1520, whereas in other embodiments the reference vias may be partly within an opening and partly covered by the compliant conductive member 1506. In some embodiments, the reference vias 1815 for a module may be fully covered by the compliant conductive member. In some embodiments, shadow vias 1805 for a module may be within an opening 1520, whereas in other embodiments the shadow vias may be partly within an opening and partly covered by the compliant conductive member. In some embodiments, the shadow vias for a module may be fully covered by the compliant conductive member.

Figure 21B:
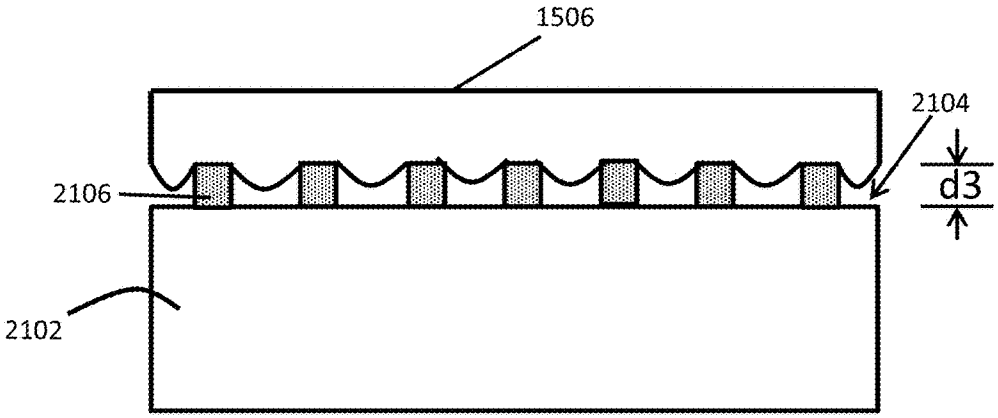
FIG. 21B is a sectional view corresponding to the cut line in FIG. 21A.

FIG. 21B illustrates a cross-sectional view taken along the cutline shown in FIG. 21A. The bridges 2106 and voids 2104 may alternate across a surface of the printed circuit board 2102. When mounted, a compliant conductive member 1506 can extend into the voids and press against the surface of the bridges in the immediate vicinity of reference tabs 1502 and reference contact tails. In order to make reliable contact, the compliant conductive member may be compressed by an amount sufficient to account for any variations in surface heights of the board and any variations in separation between the connector and the board when the connector is inserted. In some embodiments, the deformation of the compliant conductive member may be in a range of 1 mil to 10 mil. The voids provide a volume into which the compliant conductive member may deform, allowing adequate compression of the compliant conductive member, and thereby providing a more uniform amount of contact force between the compliant conductive member and the reference tabs and pads on the printed circuit board. It should be appreciated that voids, enabling adequate compression of the complaint compressive member, may be created in any suitable way. In further embodiments, for example, voids may be created by removing portions of connector housing, such as first level 1508 of insulative portion 1504.

Figure 22B:
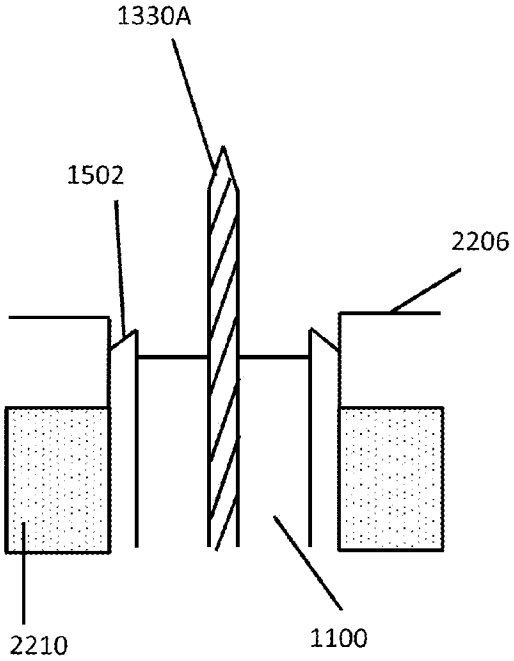
FIG. 22B is a sectional view corresponding to the cutline B-B in FIG. 22A.
Figure 22A:
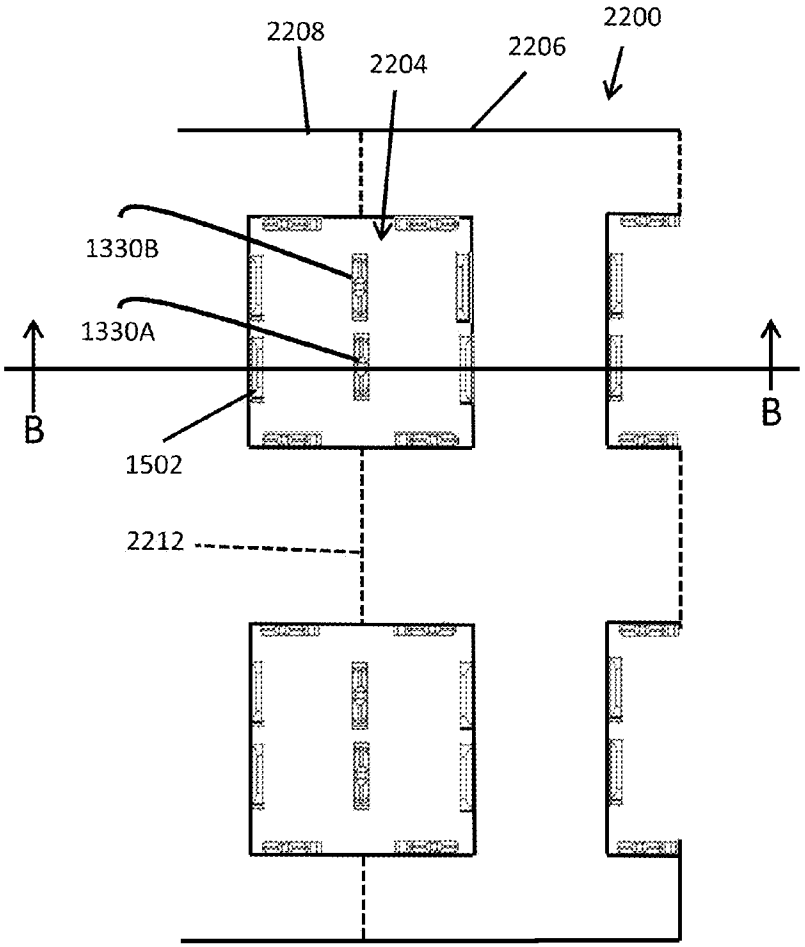
FIG. 22A is a partial plan view of a board-facing surface of a compliant shield mounted to a connector, according to some embodiments.

FIG. 22A shows a partial plan view of a board-facing surface of a compliant shield 2200 mounted to a connector and shows four reference contact tails, reference tabs 1502, and contact tails 1330A, 1330B of differential signal conductors. The compliant shield 2200 may comprise only a compliant conductive member 2206 in some embodiments, and may be formed from a conductive elastomer as described above. According to some embodiments, a retaining member 2210 (or plurality of retaining members abutted at the dashed lines 2212) may be placed over the ends of the wafer modules and inserted in the connector to hold the ends of the wafer modules in an array. The retaining piece 2210 or pieces may be formed from a hard or firm polymer that is insulative. The retaining piece or pieces 2210 may include openings 2204 that are sized and positioned to receive ends of the wafer modules 1000 and may not include islands 1510. In some embodiments, a retaining piece or pieces may not be used. Instead, the compliant conductive member 2206 may contact members 900 that are used to retain the wafer modules 1000.

FIG. 22B illustrates a cross-sectional view taken along the cutline shown in FIG. 22A. Contact tail 1330A of a differential signal conductor may be isolated from tabs 1502 by insulative housing 1100. When mounted, the complaint conductive member 2206 may press against the retaining piece or pieces 2210 (or member 900) and deform laterally to press against tabs 1502 and/or reference contact tails. In the illustrated example, the insulative housing 1100 extrudes from the retaining piece or pieces such that it may provide a backing for the ends of the tabs. In some embodiments, the retaining piece or pieces may have portions that fill the area illustrated as opening 2204 and have a designed height to provide a backing for the ends of the tabs.

Figure 23:
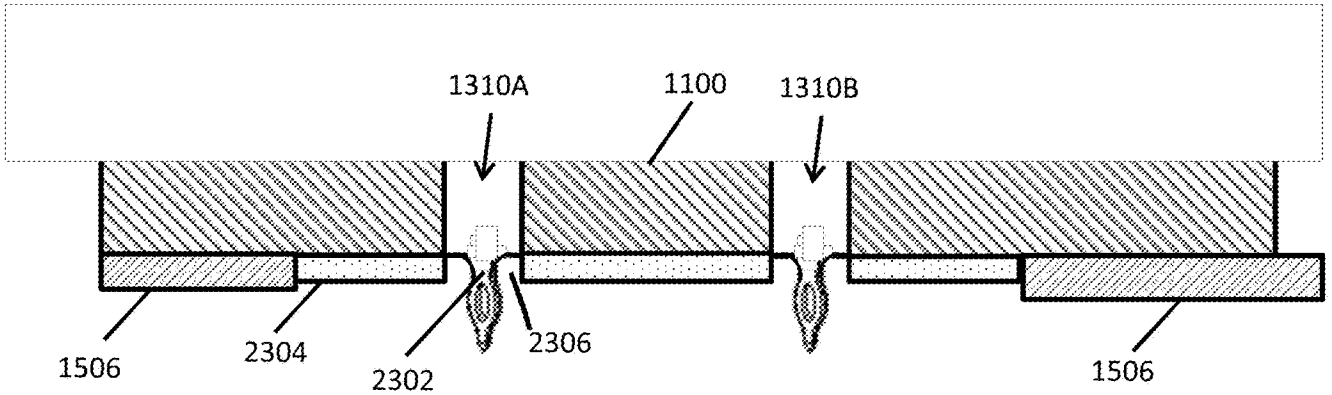
FIG. 23 is a cross-sectional view corresponding to the marked plane 23 in FIG. 17A.

FIG. 23 illustrates further details of a wafer module attached with a compliant shield 1506 by a cross-sectional view of the marked plane 23 in FIG. 17A. An organizer 2304 may be placed over the ends of wafer modules and inserted in the connector to hold the ends of the wafer modules in an array. The organizer may be the insulative portion 1504 or the retaining piece 2210. The organizer may include openings 2306 that are sized and positioned to receive conductive elements 1310A, 1310B that are held in the grooves of insulative housing 1100. To accommodate tolerances the openings 2306 may be larger than the contact tails of the conductive elements 1310A, 1310B, leaving within openings 2306.

Additionally, in the illustrated embodiment, the contact tails of conductive elements are press fit and have necks 2302 that occupy spaces smaller than the openings 2306. The inventors have recognized and appreciated that the spaces left in the openings filled with air may cause impedance spike at the mounting interface of the connector to a PCB (not shown). To compensate for the impedance spike, materials with dielectric constant higher than that of the insulative housing 1100 may be used to form the organizer. For example, the insulative housing may be formed of materials with a relative dielectric constant that is less than 3.5. The organizer may be formed of materials with relative dielectric constant above 4.0, such as in the range of 4.5 to 5.5. In some embodiments, the organizer may be formed by adding filler to a polymer binder. The filler, for example, may be titanium dioxide in a sufficient quantity to achieve a relative dielectric constant in the desired range.

Figure 24:
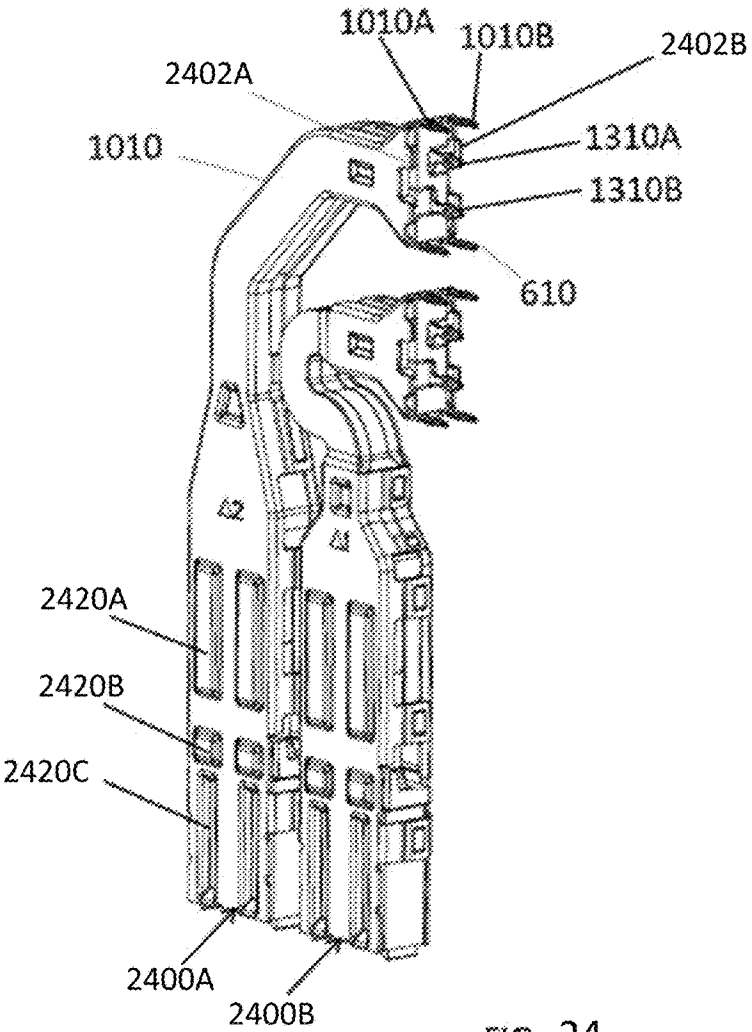
FIG. 24 is an isometric view of two wafer modules, according to some embodiments.

FIG. 24 is an isometric view of two wafer modules 2400A and 2400B, according to some embodiments. The differences between wafer modules 2400A-B and wafer modules 810A-D in FIG. 8 include that wafer modules 2400A-B comprise additional tabs 2402A and 2402B extending from the reference conductors 1010A and 1010B respectively.

In some embodiments, the tabs 2402A and 2402B may be resilient and, when the connector is mated with a board, may deform to accommodate manufacturing variations in separation between the board and the connector. The tabs may be made of any suitable compliant, conductive materials, such as superelastic and shape memory materials. Reference conductors 1010 may include projections with various sizes and shapes, such as 2420A, 2420B, and 2420C. These projections impact the separation, in a direction perpendicular to the axis of the signal conductor pair, between portions of the signal conductor pair and the reference conductors 1010A and 1010B. This separation, in combination with other characteristics, such as the width of the signal conductors in those portions, may control the impedance in those portions such that it approximates the nominal impedance of the connector or does not change abruptly in a way that may cause signal reflections.

In some embodiments, a compliant shield may be implemented as a conductive structure positioned between tails of signal conductors in the space between the mating surface of a connector and an upper surface of a printed circuit board. The effectiveness of the shield may be increased when those conductive portions are electrically coupled to compliant portions that ensure reliable connection of the compliant shields to ground structures in the connector and/or the printed circuit board over substantially all of the area of the connector.

Figure 25A:
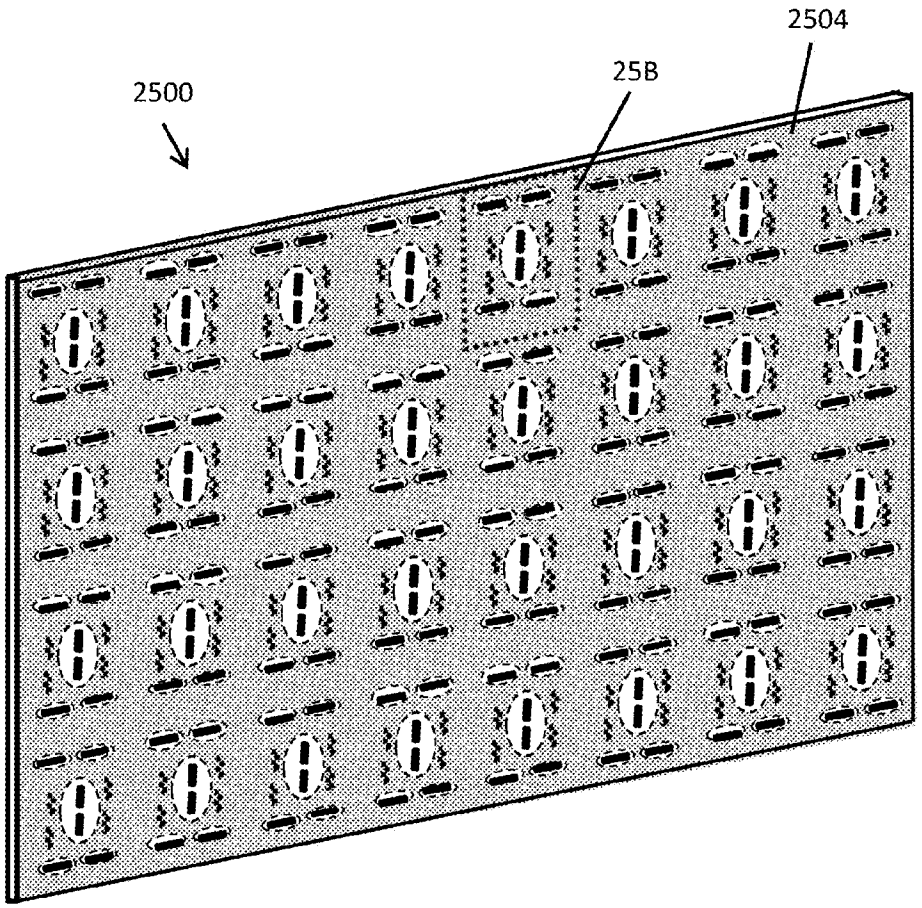
FIG. 25A is an isometric view of a compliant shield, according to some embodiments.

FIG. 25A is an isometric view of a compliant shield 2500 that may be used with a plurality of wafer modules, according to some embodiments. To simplify the drawings, the compliant shield is shown for used with an 8×4 array of wafer modules, though the invention is not limited to this array size.

Figure 25B:
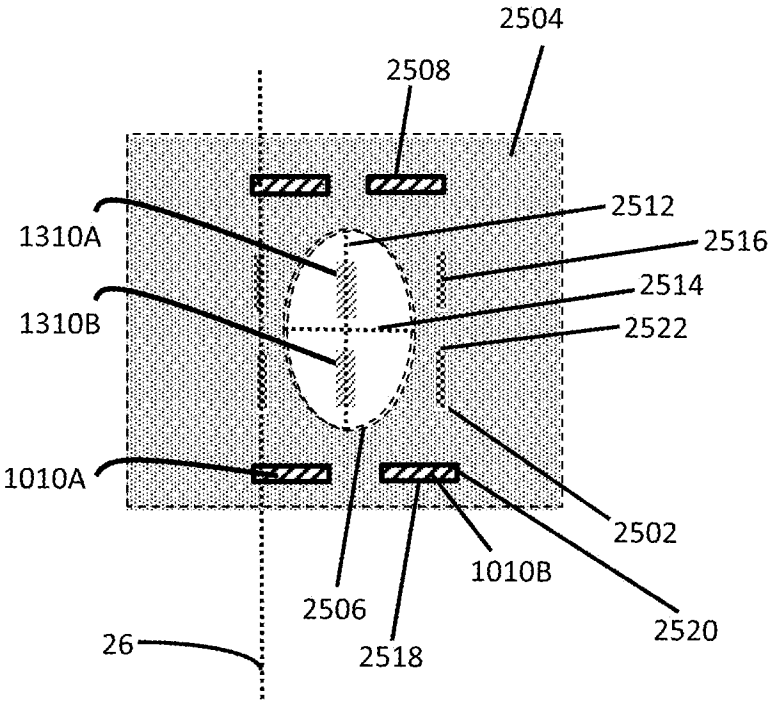
FIG. 25B is an enlarged plan view of the area marked as 25B in FIG. 25A.

FIG. 25B is an enlarged plan view of the area marked as 25B in FIG. 25A, which may correspond to one of multiple wafer modules in a connector. The compliant shield may include a conductive body portion 2504 with a plurality of compliant fingers 2516. The compliant fingers 2516 may be elongated beams. Each beam may have a proximal end integral with the conductive body portion and a free distal end.

The conductive body portion 2504 may include a plurality of first size openings 2506 for contact tails of a pair of differential signal conductors 1310A-B to pass through and second size openings 2508 for contact tails of reference conductors to pass through. The compliant fingers 2516 may be resilient in a direction that may be substantially parallel to the contact tails of the signal conductors. Alternatively or additionally, the compliant fingers may be resilient in a direction, in which the contact tails of the connector insert into the openings.

In some embodiments, the openings 2506 and 2508 may be arranged in a repeating pattern of subpatterns. Each subpattern may correspond to a respective wafer module. Each subpattern may include at least one opening 2506 for signal conductors to pass through without contacting the conductive body portion such that the signal conductors may be electrically isolated from the compliant shield. Each subpattern may include at least one opening 2508 for reference conductors to pass through. The opening 2508 may be positioned and sized such that the reference conductors may be electrically connected to the conductive body portion and thus to the compliant shield. In the illustrated example, the openings 2506 are oval-shaped having longer axes 2512 and shorter axes 2514. The openings 2508 are slots having a ratio between a longer dimension 2518 and a shorter dimension 2520 of at least 2:1. The illustrated subpattern in FIG. 25B has four openings 2508, the longer dimensions of which are disposed in parallel lines that are perpendicular to the longer axis of the opening 2506.

In some embodiments, the conductive body portion 2504 may include a plurality of openings 2502. Each opening 2502 may have a compliant finger extending from an edge 2522 of the opening. Such openings may result from a stamping and forming operation in which compliant beams 2516 are cut from a body portion 2504.

Other openings or features may be present in body portion 2504. In some embodiments, openings may be sized and positioned for tabs 2402A and 2402B to pass through such that the conductive body portion may be electrically connected to the reference conductors of a wafer module. Alternatively or additionally, openings 2508 may have at least one dimension that is smaller than the corresponding dimension of the reference conductor inserted into that opening. The body portion 2504 adjacent that opening may be shaped such that it will flex or deform when a reference conductor is inserted into the opening, enabling the reference conductor to be inserted, but providing contact force on reference conductor once inserted such that there is an electrical connection between the reference conductor and the body portion 2504. Such an electrical connection may be 10 Ohms or less, such as between 10 Ohms and 0.01 Ohms. A connection may be, in some embodiments 5 Ohms, 2 Ohms 1 Ohm, or less. In some embodiments, the contact may be between 2 Ohms and 0.1 Ohms, in some embodiments. Such contacts may be formed by cutting from the body portion 2504 adjacent the opening as a cantilevered beam or a torsional beam affixed to the body portion 2504 at two ends. Alternatively, the body portion may be shaped with an opening bounded by a segment that is placed into compression when a reference conductor is inserted.

The compliant shield 2500 may be made of a material with desired conductivity for the current paths. Suitable conductive materials to make at least a portion of the conductive body portion include metals, metal alloys, superelastic and shape memory materials. In some embodiments, the compliant shield may be made of a first material coated with a second material, the conductivity of which is greater than that of the first material.

In some embodiments, the compliant shield may be manufactured by stamping openings in a piece of metal, which may be substantially planar. Compliant fingers 2516, for example, may be manufactured by cutting elongated beams from the piece of metal with a proximal end attached to the piece of metal. In an embodiment in which the body portion is generally planar, the free distal end will be bent out of the plane of the body portion. Conductive, compliant metals that may be shaped in this way using conventional stamping and forming techniques are known in the art and are suitable for manufacturing a compliant shield.

The beams may be bent out of the plane of the conductive body portion 2504 by an amount exceeding the tolerance in positioning a mounting face of a connector against a surface of a printed circuit board. With beams of this shape, the free distal end of the beam will contact the surface of the printed circuit board whenever the connector is mounted to the printed circuit board, so long whenever the connector is positioned within the tolerance. Moreover, the beam will be at least partially compressed, ensuring that the beam generates contact force that ensures reliable electrical connection. In some embodiments, the contact force will be in the range of 1 to 80 Newtons, or, in some embodiments, between 5 and 50 Newtons, or between 10 and 40 Newtons, such as between 20 and 40 Newtons.

Figure 26A:
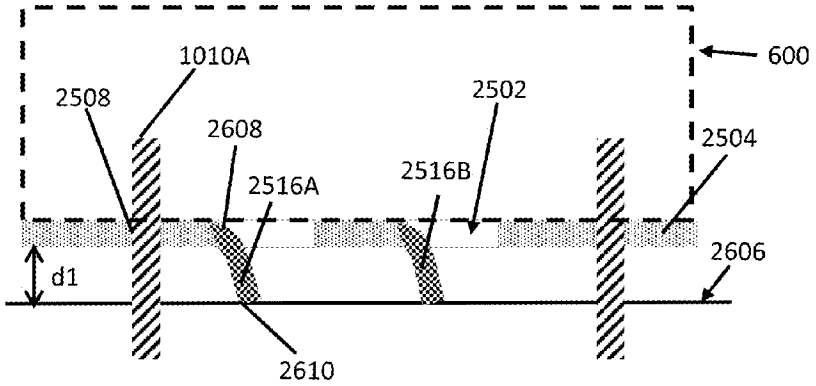
FIG. 26A is a cross-sectional view corresponding to the cutline 26 in FIG. 25B showing the compliant shield in an uncompressed state, according to some embodiments.

FIG. 26A is a cross-sectional view corresponding to the cutline 26 in FIG. 25B, showing the compliant shield mounted to a connector (e.g., connector 600), according to some embodiments. In an uncompressed state, the conductive body portion 2504 of the compliant shield 2500 may be away from surface 2606 of a printed circuit board by a distance d1. In the illustrated example, each of the reference tails 1010A and 1010B extend through a respective opening 2508 and makes contact with the conductive body portion. Each of the compliant fingers 2516A and 2516B has a proximal end 2608 integral with the conductive body portion and a free distal end 2610 pressing against the surface of a printed circuit board to which the connector is to be mounted.

Figure 26B:
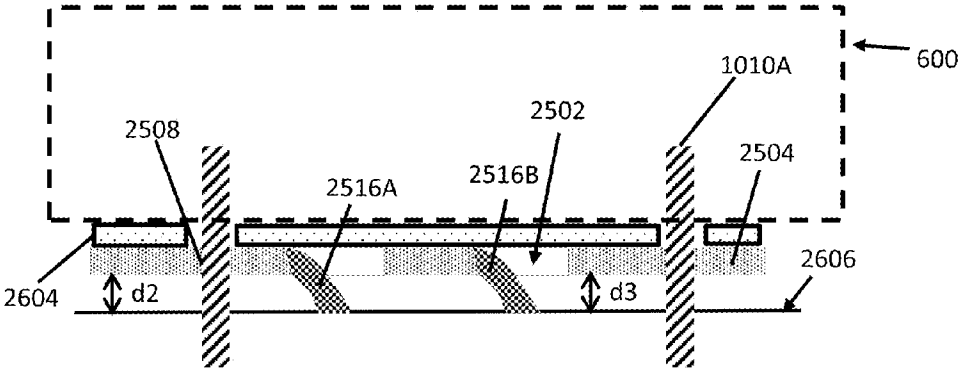
FIG. 26B is a cross-sectional view of the portion of the compliant shield in FIG. 26A in a compressed state.

When the connector is pressed onto a surface 2606 of a PCB engaging the contact tails, the compliant shield is compressed by a normal force (a force substantially normal to the surface of the PCB). FIG. 26B is a sectional view of the portion of the compliant shield in FIG. 26A in a compressed state. The PCB may have ground pads on the surface. The ground pads may be connected to a ground plane of the PCB through vias. The conductive body portion 2504 may press against the ground pads. The compliant fingers 2516A and 2516B may deform as a result of the normal force. The compliant shield may be away from the surface of the printed circuit board by a distance d2 adjacent to compliant finger 2516A and a distance d3 adjacent to compliant finger 2516B. It should be appreciated that, depending on the variations of gaps between the connector and PCB, d2 and d3 may be the same or different within a module; even if d2 and d3 are the same within one module, they may be different across modules. However, as a result of compliance provided by the fingers 2516A and 2516B, both may make contact with a conducting pad on the printed circuit board.

FIG. 26B illustrates a further embodiment. In the embodiment of FIG. 26B, the compliant shield has, in addition to a body portion 2504, which may be formed of metal, a layer 2604 of lossy material. The lossy material may be on the order of 0.1 to 2 mm thick, or may have nay other suitable dimension, such as between 0.1 and 1 mm of thickness.

Figure 27:
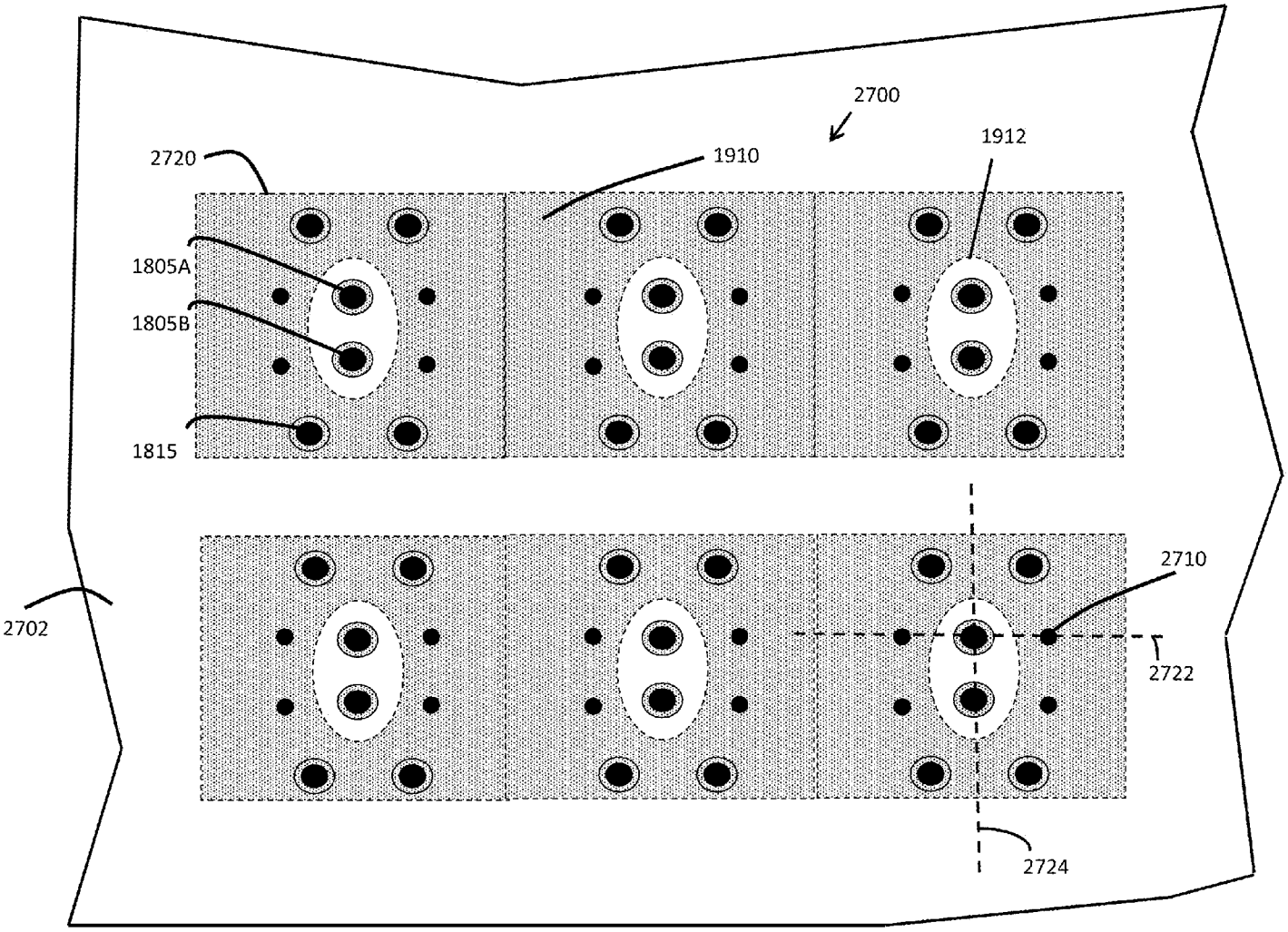
FIG. 27 depicts a connector footprint in a printed circuit board with a surface ground pad and shadow vias, according to some embodiments.

FIG. 27 illustrates a connector footprint 2700 on a printed circuit board 2702 configured for use with a compliant shield, according to a further embodiment. The embodiment of FIG. 27 differs from the embodiment of FIG. 19 in that shadow vias 2710 are incorporated into the module footprint 2720 adjacent to vias for differential signal conductors 1805A, 1805B. The shadow vias 2710 may be electrically connected to the surface pads 1910. The shadow vias may also electrically connect to one or more internal reference layers (e.g., ground planes) of the printed circuit board such that surface pads are also electrically connected to the ground plane through the shadow vias. When a connector is installed, the conductive body portion 2504 may press against the surface pads 1910 above the shadow vias 2710, and thereby create an essentially direct electrically conductive path from the reference tabs, through the compliant shield, to the surface pads, shadow vias, and to the one or more reference layers of the printed circuit board.

The shadow vias 2710 may be located adjacent to signal vias 1805A, 1805B. In the illustrated example, a pair of shadow vias 2710 are located on a first line 2722 that is perpendicular to a second line 2724 that passes through signal vias 1805A, 1805B in a direction of the column 1340. The second line 2724 may be located midway between the pair of shadow vias, such that the pair of shadow vias are equally spaced from signal vias 1805A and 1805B. In the illustrated embodiment shadow vias in each module footprint 2720 are aligned with signal vias in a direction perpendicular to first line 2722. However, it is not a requirement that the shadow vias align with signal vias. For example, in some embodiments, a module footprint 2720 may have one shadow via on each side of line 2724, aligned with a line parallel to line 2722, but that passes between the signal vias, and, in some embodiments may be equidistant from the signal vias that form a differential pair. In some embodiments, for each module footprint 2720, at least one shadow via is positioned between the ground vias 1815, for example, positioned between the pairs of reference vias that are located at opposing ends of the pair of signal vias.

Shadow vias 2722 may at least partially overlap the edges of holes 1912. In further embodiments, each module footprint 2720 may include more than one pair of shadow vias. Furthermore, the shadow vias may be implemented as one or more circular shadow vias or one or more slot-shaped shadow vias.

According to some embodiments, the shadow vias 2710 may be smaller than vias used to receive contact tails of the connector (e.g., smaller than signal vias 1805A, 1805B, and/or reference vias 1815). In embodiments where the shadow vias do not receive contact tails, they may be filled with conductive material during the manufacture of the printed circuit board. As a result, their unplated diameter may be smaller than the unplated diameter of the vias that receive contact tails. The diameters may be, for example, in the range of 8 to 12 mils, or at least 3 mils less than the unplated diameter of the signal or reference vias.

In some embodiments, the shadow vias may be positioned such that the length of a conducting path through the surface layer to the nearest shadow via coupling the conductive surface layer to an inner ground layer may be less than the thickness of the printed circuit board. In some embodiments, the conducting path through the surface layer may be less than 50%, 40%, 30%, 20% or 10% of the thickness of the board. Short conducting paths may be achieved by positioning the shadow vias at or near the point of contact, such as between the conductive boy portion 2504 and the conductive surface pad 1910.

In some embodiments, shadow vias may be positioned so as to provide a conducting path through the surface layer that is less than the average length of the conducting paths for signals between the connector, or other component mounted to the board, and inner layers of the board where the signal vias are connected to the conductive traces. In some embodiments, the shadow vias may be positioned such that the conducting path through the surface layer may be less than 50%, 40%, 30%, 20% or 10% of the average length of the signal paths.

In some embodiments, shadow vias may be positioned so as to provide a conducting path through the surface layer that is less than 5 mm. In some embodiments, the shadow vias may be positioned such that conducting path through the surface layer may be less than 4 mm, 3 mm, 2 mm or 1 mm.

The frequency range of interest may depend on the operating parameters of the system in which such a connector is used, but may generally have an upper limit between about 15 GHz and 50 GHz, such as 25 GHz, 30 or 40 GHz, although higher frequencies or lower frequencies may be of interest in some applications. Some connector designs may have frequency ranges of interest that span only a portion of this range, such as 1 to 10 GHz or 3 to 15 GHz or 5 to 35 GHz. The impact of unbalanced signal pairs, and any discontinuities in the shielding at the mounting interface may be more significant at these higher frequencies.

The operating frequency range for an interconnection system may be determined based on the range of frequencies that can pass through the interconnection with acceptable signal integrity. Signal integrity may be measured in terms of a number of criteria that depend on the application for which an interconnection system is designed. Some of these criteria may relate to the propagation of the signal along a single-ended signal path, a differential signal path, a hollow waveguide, or any other type of signal path. Two examples of such criteria are the attenuation of a signal along a signal path or the reflection of a signal from a signal path.

Other criteria may relate to interaction of multiple distinct signal paths. Such criteria may include, for example, near end cross talk, defined as the portion of a signal injected on one signal path at one end of the interconnection system that is measurable at any other signal path on the same end of the interconnection system. Another such criterion may be far end cross talk, defined as the portion of a signal injected on one signal path at one end of the interconnection system that is measurable at any other signal path on the other end of the interconnection system.

As specific examples, it could be required that signal path attenuation be no more than 3 dB power loss, reflected power ratio be no greater than −20 dB, and individual signal path to signal path crosstalk contributions be no greater than −50 dB. Because these characteristics are frequency dependent, the operating range of an interconnection system is defined as the range of frequencies over which the specified criteria are met.

Designs of an electrical connector are described herein that improve signal integrity for high frequency signals, such as at frequencies in the GHz range, including up to about 25 GHz or up to about 40 GHz, up to about 50 GHz or up to about 60 GHz or up to about 75 GHz or higher, while maintaining high density, such as with a spacing between adjacent mating contacts on the order of 3 mm or less, including center-to-center spacing between adjacent contacts in a column of between 1 mm and 2.5 mm or between 2 mm and 2.5 mm, for example. Spacing between columns of mating contact portions may be similar, although there is no requirement that the spacing between all mating contacts in a connector be the same.

A compliant shield may be used with a connector of any suitable configuration. In some embodiments, a connector with a broadside-coupled configuration may be adopted to reduce skew. The broadside-coupled configuration may be used for at least the intermediate portions of signal conductors that are not straight, such as the intermediate portions that follow a path making a 90 degree angle in a right angle connector.

While a broadside-coupled configuration may be desirable for the intermediate portions of the conductive elements, a completely or predominantly edge-coupled configuration may be adopted at a mating interface with another connector or at an attachment interface with a printed circuit board. Such a configuration, for example, may facilitate routing within a printed circuit board of signal traces that connect to vias receiving contact tails from the connector.

Accordingly, the conductive elements inside the connector may have transition regions at either or both ends. In a transition region, a conductive element may jog out of the plane parallel to the wide dimension of the conductive element. In some embodiments, each transition region may have a jog toward the transition region of the other conductive element. In some embodiments, the conductive elements will each jog toward the plane of the other conductive element such that the ends of the transition regions align in a same plane that is parallel to, but between the planes of the individual conductive elements. To avoid contact of the transition regions, the conductive elements may also jog away from each other in the transition regions. As a result, the conductive elements in the transition regions may be aligned edge to edge in a plane that is parallel to, but offset from the planes of the individual conductive elements. Such a configuration may provide a balanced pair over a frequency range of interest, while providing routing channels within a printed circuit board that support a high density connector or while providing mating contacts on a pitch that facilitates manufacture of the mating contact portions.

Although details of specific configurations of conductive elements, housings, and shield members are described above, it should be appreciated that such details are provided solely for purposes of illustration, as the concepts disclosed herein are capable of other manners of implementation. In that respect, various connector designs described herein may be used in any suitable combination, as aspects of the present disclosure are not limited to the particular combinations shown in the drawings.

Having thus described several embodiments, it is to be appreciated various alterations, modifications, and improvements may readily occur to those skilled in the art. Such alterations, modifications, and improvements are intended to be within the spirit and scope of the invention. Accordingly, the foregoing description and drawings are by way of example only.

Various changes may be made to the illustrative structures shown and described herein. For example, a compliant shield was described in connection with a connector attached to a printed circuit board. A compliant shield may be used in connection with any suitable component mounted to any suitable substrate. As a specific example of a possible variation, a compliant shield may be used with a component socket.

Manufacturing techniques may also be varied. For example, embodiments are described in which the daughtercard connector 600 is formed by organizing a plurality of wafers onto a stiffener. It may be possible that an equivalent structure may be formed by inserting a plurality of shield pieces and signal receptacles into a molded housing.

As another example, connectors are described that are formed of modules, each of which contains one pair of signal conductors. It is not necessary that each module contain exactly one pair or that the number of signal pairs be the same in all modules in a connector. For example, a 2-pair or 3-pair module may be formed. Moreover, in some embodiments, a core module may be formed that has two, three, four, five, six, or some greater number of rows in a single-ended or differential pair configuration. Each connector, or each wafer in embodiments in which the connector is waferized, may include such a core module. To make a connector with more rows than are included in the base module, additional modules (e.g., each with a smaller number of pairs such as a single pair per module) may be coupled to the core module.

Furthermore, although many inventive aspects are shown and described with reference to a daughterboard connector having a right angle configuration, it should be appreciated that aspects of the present disclosure is not limited in this regard, as any of the inventive concepts, whether alone or in combination with one or more other inventive concepts, may be used in other types of electrical connectors, such as backplane connectors, cable connectors, stacking connectors, mezzanine connectors, I/O connectors, chip sockets, etc.

In some embodiments, contact tails were illustrated as press fit "eye of the needle" compliant sections that are designed to fit within vias of printed circuit boards. However, other configurations may also be used, such as surface mount elements, spring contacts, solderable pins, etc., as aspects of the present disclosure are not limited to the use of any particular mechanism for attaching connectors to printed circuit boards.

The present disclosure is not limited to the details of construction or the arrangements of components set forth in the foregoing description and/or the drawings. Various embodiments are provided solely for purposes of illustration, and the concepts described herein are capable of being practiced or carried out in other ways. Also, the phraseology and terminology used herein are for the purpose of description and should not be regarded as limiting. The use of "including," "comprising," "having," "containing," or "involving," and variations thereof herein, is meant to encompass the items listed thereafter (or equivalents thereof) and/or as additional items.

What is claimed is:

1. A compliant shield for an electrical connector, the electrical connector comprising a plurality of contact tails for attachment to a printed circuit board, the compliant shield comprising:

a conductive body portion comprising a plurality of openings sized and positioned for the contact tails from the electrical connector to pass therethrough, and a layer of lossy material, wherein the conductive body portion provides current flow paths between shields internal to the electrical connector and ground structures of the printed circuit board.

2. The compliant shield of claim 1 comprising:

a plurality of compliant fingers attached to and extending from the conductive body portion.

3. The compliant shield of claim 2, wherein:

the plurality of compliant fingers comprise elongated beams, each beam having a proximal end integral with the conductive body portion and a free distal end.

4. The compliant shield of claim 2, wherein:

the compliant shield comprises a second plurality of openings; and each of the plurality of compliant fingers extends from an edge of a respective one of the second plurality of openings.

5. The compliant shield of claim 4, wherein:

the second plurality of openings are sized and positioned to receive reference tabs of the electrical connector.

6. The compliant shield of claim 2, wherein:

the plurality of compliant fingers are resilient in a direction, in which the contact tails of the connector insert into the plurality of openings of the conductive body portion of the compliant shield.

7. The compliant shield of claim 2, wherein:

the compliant shield is made of superelastic material.

8. The compliant shield of claim 2, wherein:

the plurality of openings have a first size for a pair of differential signal contact tails and a second size for reference contact tails.

9. The compliant shield of claim 8, wherein the plurality of openings are arranged in a repeating pattern of subpatterns, each subpattern comprising a first size opening and at least two second size openings.

10. A compliant shield for an electrical connector, the electrical connector comprising a plurality of contact tails for attachment to a printed circuit board, the compliant shield comprising:

a conductive body portion comprising a plurality of openings sized and positioned for the contact tails from the electrical connector to pass therethrough, wherein the conductive body portion provides current flow paths between shields internal to the electrical connector and ground structures of the printed circuit board;

an insulative member comprising:

a plurality of openings sized and positioned for the contact tails from the electrical connector to pass therethrough;

a first portion; and a plurality of islands extending from the first portion;

wherein the conductive body portion is a compliant, conductive member comprising a plurality of openings sized and shaped to conform to the plurality of islands.

11. The compliant shield of claim 10, wherein:

the plurality of islands have walls extending from the first portion; and the walls have channels extending from a plurality of second openings in the first portion.

12. The compliant shield of claim 11, wherein:

the openings in the compliant, conductive member are further sized and shaped to press against tabs inserted in the channels when the compliant, conductive member is mounted to the insulative member.

13. The compliant shield of claim 10, wherein:

the compliant, conductive member is filled with conductive particles at a loading providing a lossy conductor.

14. The compliant shield of claim 10, wherein each of the plurality of openings of the insulative member is a slot having a ratio between a longer dimension and a shorter dimension of at least 2:1.

15. The compliant shield of claim 14, wherein the plurality of openings of the insulative member are arranged in a repeating pattern of subpatterns, each subpattern comprising a pair of slots aligned with longer dimensions disposed in a line and at least two additional slots.

16. The compliant shield of claim 15, wherein:

the slots of each of the plurality subpatterns extend through a respective island.

17. An electrical connector, comprising:

a board mounting face comprising a plurality of conductive structures extending therefrom;

a plurality of internal shields; and a compliant shield comprising a conductive body portion, the conductive body portion comprising a plurality of openings sized and positioned for the plurality of conductive structures to pass therethrough, wherein the conductive body portion is in electrical connection with the plurality of internal shields, and the conductive body portion presses against conductive structures of the plurality of conductive structures in a direction parallel to the board mounting face.

18. The electrical connector of claim 17, wherein:

the contact tails of the plurality of contact tails that the conductive body portion presses against in the direction parallel to the board mounting face are tabs of the plurality of internal shields, and the compliant shield comprises a plurality of compliant fingers attached to and extending from the conductive body portion.

19. An electronic device comprising:

a printed circuit board comprising a surface;

the connector of claim 17 mounted to the printed circuit board, the connector further comprising:

a plurality of signal conductive elements comprising a first plurality of contact tails, wherein:

the board mounting face is parallel to the surface of the printed circuit board, the plurality of internal shields comprise a second plurality of contact tails and a plurality of tabs separate from the second plurality of contact tails, and the conductive body portion of the compliant shield comprises elastomer filled with conductive particles, and contacts the second plurality of contact tails and the plurality of tabs such that the compliant shield provides current flow paths between the plurality of internal shields and ground structures of the printed circuit board.

20. The electronic device of claim 19, wherein:

the printed circuit board has a ground pad on the surface; and the compliant shield presses against the ground pad.

21. The electronic device of claim 20, wherein:

the printed circuit board further comprises:

a ground plane at an inner layer of the printed circuit board; and a plurality of shadow vias connecting the ground pad to the ground plane.

22. The electrical connector of claim 21, wherein:

a conductive body portion of the compliant shield comprises a plurality of first openings sized and positioned for the contact tails from the plurality of signal conductive elements to pass through in a repeating pattern of first locations, and a plurality of second openings sized and positioned for the contact tails from the plurality of internal shield to pass through in a repeating pattern of second locations;

the shadow vias are located in a repeating pattern of third locations, with each of the third locations having the same positioning relative to a respective first location.

23. An electrical connector, comprising:

a board mounting face comprising a plurality of contact tails extending therefrom;

a plurality of internal shields; and a compliant shield comprising a conductive body portion, the conductive body portion comprising a plurality of openings sized and positioned for the plurality of contact tails to pass therethrough, wherein the conductive body portion is in electrical connection with the plurality of internal shields, wherein the compliant shield comprises an insulative portion having walls; and the conductive body portion is compliant, conductive material between the walls;

wherein at least a portion of the plurality of contact tails extend through the insulative portion.

24. The electrical connector of claim 23, wherein:

the walls comprise a plurality of channels;

the electrical connector further comprises conductive structures disposed in the plurality of channels; and the compliant, conductive material contacts the conductive structures.

25. The electrical connector of claim 24, wherein:

the conductive structures extend from the plurality of internal shields.

26. The electrical connector of claim 25, wherein:

the electrical connector comprises a plurality of signal conductors arranged in a plurality of pairs, each signal conductor comprising a respective contact tail of a first portion of the plurality of contact tails; and the plurality of internal shields are arranged to separate adjacent pairs of the plurality of pairs.

27. The electrical connector of claim 26, wherein:

the plurality of internal shields comprise respective contact tails of a second portion of the plurality of contact tails.

28. The electrical connector of claim 27, wherein:

the conductive structures are tabs that are separate from the contact tails of the second portion.

29. An electronic device comprising:

a printed circuit board comprising a surface;

a connector mounted to the printed circuit board, the connector comprising:

a face parallel with the surface;

a plurality of conductive elements extending through the face;

a plurality of internal shields; and a compliant shield providing current flow paths between the plurality of internal shields and ground structures of the printed circuit board, wherein the compliant shield comprises a conductive, compliant member compressed between the connector and the printed circuit board, wherein the connector is configured such that the compressed, compliant, conductive member presses against the printed circuit board in a direction perpendicular to the surface of the printed circuit board and presses against conductive elements of the plurality of conductive elements in a direction parallel to the surface of the printed circuit board.

30. The electronic device of claim 29, wherein:

the printed circuit board has a ground pad on the surface; and the conductive, compliant member presses against the ground pad.

31. The electronic device of claim 30, wherein:

the printed circuit board further comprises:

a ground plane at an inner layer of the printed circuit board; and a plurality of shadow vias connecting the ground pad to the ground plane.

32. The electrical connector of claim 31, wherein:

the compressed, compliant, conductive member presses against the conductive elements of the plurality of conductive elements in a repeating pattern of first locations;

the shadow vias are located in a repeating pattern of second locations, with each of the second locations having the same positioning relative to a respective first location.

33. The electronic device of claim 31, wherein:

a portion of the plurality of conductive elements comprise a plurality of contact tails;

the connector is assembled from a plurality of modules;

each module comprises at least one signal conductor and a respective internal shield disposed on at least two sides of the signal conductor;

the at least one signal conductor and the respective internal shield each comprises contact tails of the plurality of contact tails; and the contact tails of each module are positioned in a pattern with the contact tails of the signal conductors in the center and contact tails of the internal shields at the periphery.

34. The electronic device of claim 33, wherein:

the printed circuit board comprises a plurality of signal vias receiving the contact tails of the signal conductors and a plurality of ground vias receiving the contact tails of the internal shields; and the plurality of shadow vias are disposed such that at least one shadow via is positioned between the ground vias receiving the contact tails of the internal shields of each of the plurality of modules.

35. The electronic device of claim 33, wherein:

each module further comprises at least one conductive structure extending from the respective internal shield and that is separate from the contact tails of the internal shields; and the plurality of shadow vias are disposed such that the length of a conducting path through the ground pad from a location at which a portion of the conductive, compliant member adjacent the extending conductive structure presses against the ground pad to one of the plurality of shadow vias is less than the thickness of the printed circuit board.

36. The electronic device of claim 33, wherein each module further comprises at least one conductive structure extending from the respective internal shield and that is separate from the contact tails of the internal shields; and the plurality of shadow vias are disposed such that the length of a conducting path through the ground pad from a location at which a portion of the conductive, compliant member adjacent the extending conductive structure presses against the ground pad to one of the plurality of shadow vias is less than the average length of conducting paths along signal conductors to inner conductive traces of the printed circuit board.

37. A compliant shield for an electrical connector, the electrical connector comprising a plurality of contact tails for attachment to a printed circuit board, the compliant shield comprising:

a conductive body portion comprising a plurality of openings sized and positioned for the contact tails from the electrical connector to pass therethrough, and a plastic component comprising a conductive coating, wherein the conductive body portion provides current flow paths between shields internal to the electrical connector and ground structures of the printed circuit board.

38. The compliant shield of claim 37, wherein:

the conductive body portion presses against conductive structures of the electrical connector in a direction parallel to the printed circuit board.

39. The compliant shield of claim 37, further comprising:

an insulative retaining member holding the plurality of contact tails of the electrical connector in an array.

* * * * *